US007756437B2

(12) United States Patent
Kadota

(10) Patent No.: US 7,756,437 B2
(45) Date of Patent: Jul. 13, 2010

(54) IMAGE FORMING SYSTEM AND DISPLAY CONTROL METHOD THEREFOR

(75) Inventor: Masatoshi Kadota, Takahama (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 196 days.

(21) Appl. No.: 11/961,226

(22) Filed: Dec. 20, 2007

(65) Prior Publication Data

US 2008/0152375 A1 Jun. 26, 2008

(30) Foreign Application Priority Data

Dec. 22, 2006 (JP) ..... 2006-346371

(51) Int. Cl.
*G03G 15/00* (2006.01)
*G03G 21/00* (2006.01)

(52) U.S. Cl. ..... 399/81; 358/1.12; 399/16

(58) Field of Classification Search ..... 399/81, 399/388, 393, 381, 16; 358/1.12, 1.18
See application file for complete search history.

(56) References Cited

U.S. PATENT DOCUMENTS 6,278,524 B1 8/2001 Kujirai et al.
7,248,809 B2 * 7/2007 Kim et al. ..... 399/81
2005/0073696 A1 * 4/2005 Mackenzie et al. ..... 358/1.6

FOREIGN PATENT DOCUMENTS

| | | | |
|---|---|---|---|
| JP | 05-011529 | | 1/1993 |
| JP | 07-009703 | | 1/1995 |
| JP | 07-156457 | | 6/1995 |
| JP | 09-146419 A | * | 6/1997 |
| JP | 11-020271 | | 1/1999 |
| JP | 11-020272 | | 1/1999 |
| JP | 2004-279450 | | 10/2004 |
| JP | 2006-224491 A | * | 8/2006 |

* cited by examiner

*Primary Examiner*—Sophia S Chen
(74) *Attorney, Agent, or Firm*—Banner & Witcoff, Ltd

(57) ABSTRACT

In an image forming system wherein manual duplex printing can be performed by printing an image on one side of a sheet and thereafter printing an image on the other side of the manually-fed printed sheet, a first instruction screen is displayed on a display apparatus at the beginning of manual duplex printing for showing how to set the sheet onto a paper rest of the image forming apparatus for the first half of manual duplex printing. The first instruction screen includes instruction on whether a distinctive side of the sheet should face up or down on the paper rest.

20 Claims, 60 Drawing Sheets

IMAGE FORMING SYSTEM AND DISPLAY CONTROL METHOD THEREFOR

CROSS REFERENCE TO RELATED APPLICATION

This application claims priority from Japanese Patent Application No. 2006-346371 filed on Dec. 22, 2006. The entire content of this priority application is incorporated herein by reference.

TECHNICAL FIELD

The present disclosure relates to an image forming system and a display control method to be used therein.

BACKGROUND OF THE INVENTION

Using an image forming apparatus that does not have a duplex printing unit for enabling printing on both sides of paper, duplex printing can be achieved as follows, for example. Printing is first performed on one side of paper, and the printed paper is ejected onto a catch tray. Next, a user sets the printed paper into a feeder tray again, and then printing is performed on the other side of the paper. Thus duplex printing can be completed.

However, when the user reinserts the printed paper into the feeder tray, he/she has to decide whether the other side of paper to be printed on should face up or down in the feeder tray. Thus, the reinsert operation is complicated for the user.

In view of this, there has been proposed that instruction on how to set the printed paper is provided as an image displayed on a display device for the user (as shown in JP-A-H11-20272, for example). Thereby the user's burden when reinserting the printed paper into the feeder tray can be reduced.

However, printing may be performed using two-faced paper of which two sides are distinguishable. In the case that printing is thus performed using two-faced paper such as paper having a company logo on its one side, the user may have to decide whether the side of the paper to be first printed on should face up or down when he/she first sets paper into the feeder tray. For example, the user may have to decide whether the side with a company logo should face up or down in the feeder tray, in order to enable printing of odd-numbered pages (e.g., Page 1, Page 3 and Page 5) thereon. This is bothersome to the user.

Thus, there is a need in the art to provide an image forming system and a display control method to be used therein for enabling a user to set sheets of paper readily.

SUMMARY OF THE INVENTION

One aspect according to the present invention can include an image forming system including an image forming apparatus, a display apparatus, a memory for storing a printer driver and a display control program, and a processor being capable of accessing the memory and executing the printer driver and the display control program. The display control program is executed interfacing with the printer driver being executed. The processor is further capable of communicating to the image forming apparatus and the display apparatus.

In the image forming system, the image forming apparatus can be controlled by the processor executing the printer driver so as to perform manual duplex printing by printing an image on one side of a sheet during the first half of manual duplex printing and thereafter printing an image on the other side of the manually-fed printed sheet during the second half of manual duplex printing.

The processor causes the display apparatus by execution of the display control program to display a first instruction screen at the beginning of manual duplex printing for showing how to set the sheet onto a paper rest of the image forming apparatus for the first half of manual duplex printing. The first instruction screen includes instruction on whether a distinctive side of the sheet should face up or down on the paper rest.

According to the present invention, a user can know, by the first instruction screen, whether the sheet should face up or down on the paper rest, when he/she sets the sheet for the first half of duplex printing. Therefore the user does not need to decide by himself/herself whether the sheet should face up or down, and can readily set the sheet onto the paper rest.

BRIEF DESCRIPTION OF THE DRAWINGS

Illustrative aspects in accordance with the present invention will be described in detail with reference to the following figures wherein.

DETAILED DESCRIPTION OF THE INVENTION

<Illustrative Aspect>

An illustrative aspect of the present invention will be explained with reference to FIGS. 1 through 24.

1. Laser Printer

Figure 1:
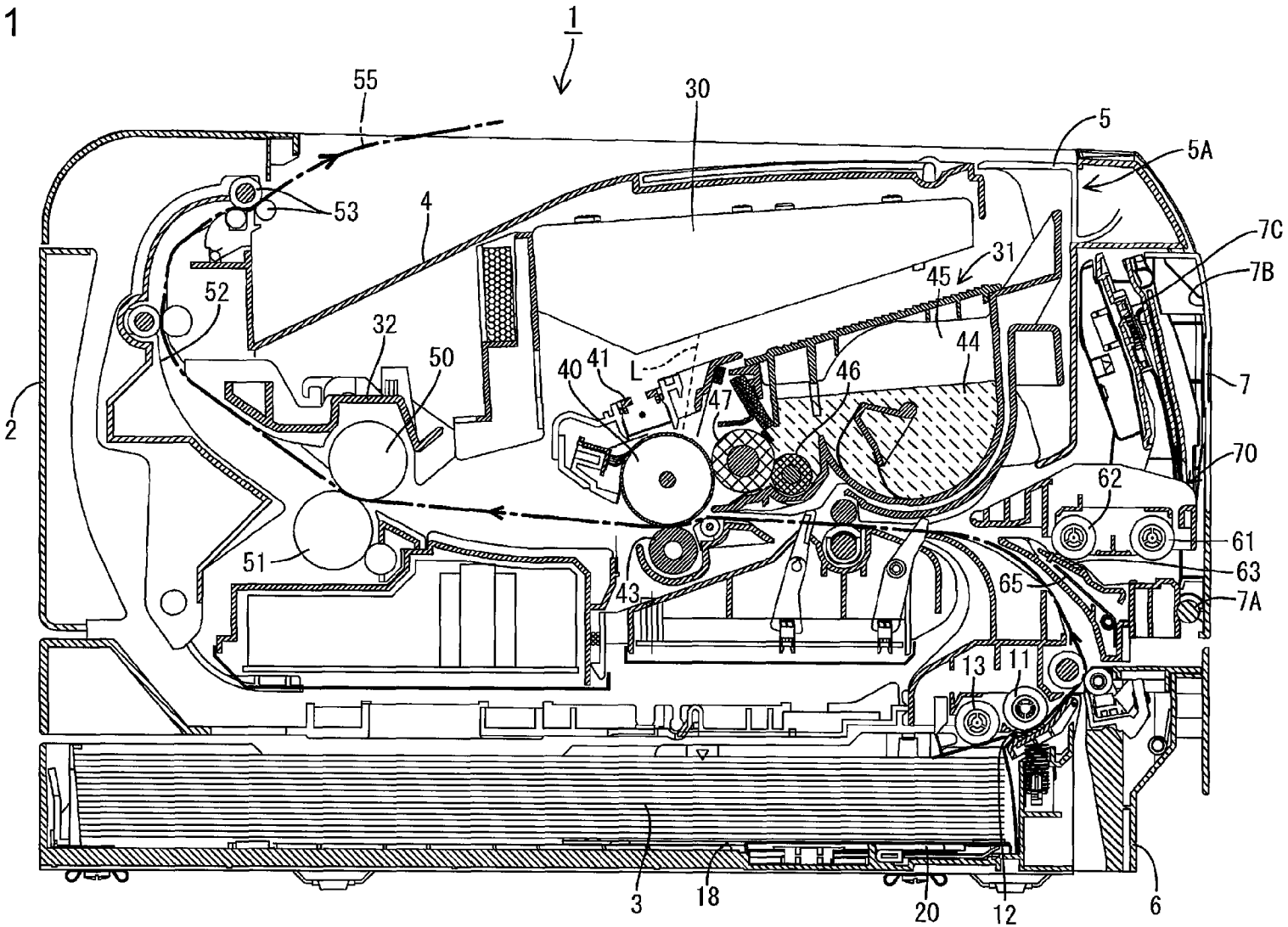
FIG. 1 is a sectional side view of the main part of a laser printer according to an illustrative aspect of the present invention.

FIG. 1 is a sectional side view of a laser printer 1 (i.e., an example of "an image forming apparatus"). Hereinafter, explanation will be made supposing that the right-hand side of FIG. 1 is "the front side" and the opposite side thereof is "the back side".

As shown in FIG. 1, the laser printer 1 forms a box shape as a whole, and includes a body casing 2. A front cover 5 is pivotally mounted to the front surface of the body casing 2. The front cover 5 can be opened for enabling replacement of a process cartridge 31 described below, for example.

A paper cassette 6 (i.e., an example of "a paper rest") for holding paper 3 (i.e., an example of "a sheet"; paper is broadly referred to as any medium able to be recorded on) to be printed on is provided below the front cover 5. The paper cassette 6 can be pulled anteriorly so as to be opened for feeding paper 3. Further, the laser printer 1 includes a catch tray 4 (i.e., an example of "a sheet stacker") on its top surface. Printed paper 3 (i.e., paper on which image has been formed) is ejected onto the catch tray 4.

Paper 3 as a stack of recording media is loaded in the paper cassette 6. A lever 20 is provided on the front-end section of the paper cassette 6 so as to be rotatable in the counterclockwise direction in FIG. 1. The lever 20 (when rotating) can raise a platen 18 to a feeding position, so that the paper 3 on the platen 18 is pressed by a feeder roller 13 and separated by a separation roller 11 and a separation pad 12 into sheets for feeding.

Figure 2:
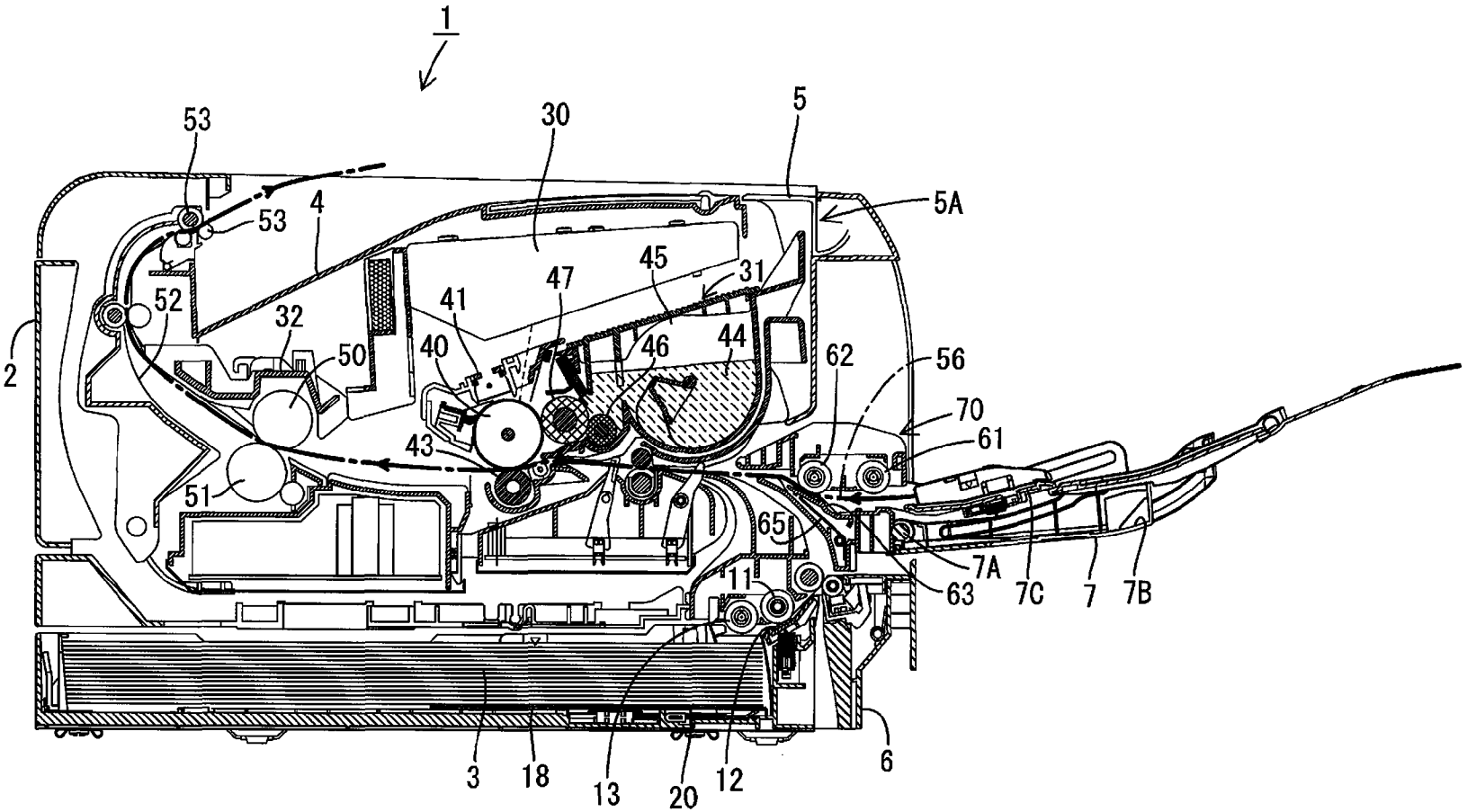
FIG. 2 is a sectional side view of the main part of the laser printer in which an MP tray is opened.

Referring to FIG. 2, a multi-purpose tray 7 (i.e., an example of "a paper rest", and hereinafter referred to as "an MP tray 7") is further provided so as to cover a rectangular opening 5A formed through the front cover 5. The MP tray 7 can be opened for feeding paper, and FIG. 2 shows when the MP tray 7 is opened. Thus, in the present aspect, the laser printer 1 includes the paper cassette 6 and the MP tray 7 as "paper rests".

The MP tray 7 has a rotating shaft 7A on its lower-end side, and the body casing 2 supports the rotating shaft 7A so as to hold the MP tray 7. Thereby the MP tray 7 can rotate around the rotating shaft 7A when it is opened or closed. When opened, the MP tray 7 is latched so that its inner surface 7B faces up (See FIG. 2).

A tray section 7C is provided on the inner surface 7B, and the user can stack paper (not shown) of any acceptable size as manually-fed paper on the tray section 7C. When the MP tray 7 is opened, the tray section 7C slopes to the back side so that the first-in edge of stacked paper is held slightly lower than the last-in edge.

A multi-purpose unit (hereinafter, referred to as "an MP unit 70") is disposed above the front-end section of the paper cassette 6. The MP unit 70 includes an MP separation roller 62 and an MP separation pad 63 opposite to and in contact with each other. The MP separation pad 63 is pressed against the MP roller 62 by the biasing force of a biasing member 65. The top sheet of paper on the MP tray 7 is fed between the MP separation roller 62 and MP separation pad 63 by rotation of an MP feeder roller 61. Thus paper on the MP tray 7 is separated into sheets for feeding by cooperation among the MP roller 61, MP separation roller 62 and MP separation pad 63.

The process cartridge 31 is disposed above the paper cassette 6 and behind the MP tray 7. When maintenance such as toner replacement is required, the process cartridge 31 can be detached from the body casing 2. For detaching the process cartridge 31, the front cover 5 is opened and the process cartridge 31 is pulled out.

Toner 44 in a toner container 45 is positively charged due to friction between a supply roller 46 and a developer roller 47. While a photosensitive drum 40 rotates, its surface is charged homogeneously and positively by a charger 41 (e.g., scorotron type) and thereafter exposed to the laser beam L from a scanner unit 30. Thereby an electrostatic latent image corresponding to an image to be formed on paper 3 is formed on the surface of the photosensitive drum 40.

While the developer roller 47 rotates, the toner thereon is supplied to the surface of the photosensitive drum 40 so as to adhere to the electrostatic latent image. Thus the electrostatic latent image is visualized, that is, a toner image is formed. While paper 3 passes between the photosensitive drum 40 and a transfer roller 43, the toner image on the surface of the photosensitive drum 40 is transferred to the upper side of the paper 3 by a transfer bias voltage applied to the transfer roller 43. In the present aspect, the image to be printed is transferred to the paper 3 from the top of the image down.

A fixation unit 32 for fixing the toner to the paper 3 is disposed behind the process cartridge 31. The fixation unit 32 includes a heating roller 50 and a pressure roller 51, which are disposed opposite to each other. The heating roller 50 fuses the transferred toner on the paper 3, and the pressure roller 51 presses the passing paper 3 against the heating roller 50.

A sheet discharge path 52 is formed behind the heating roller 50 and the pressure roller 51 so as to extend vertically toward the top surface of the body casing 2. After passing through the fixation unit 32, the paper 3 is conveyed along the sheet discharge path 52, and ejected onto the catch tray 4 by discharge rollers 53 provided on the upper side of the sheet discharge path 52.

In the case that an image is formed on paper 3 fed from the paper cassette 6, the paper 3 is conveyed so as to turn round, and thereby reversed in the vicinity of the front section of the paper cassette 6 as shown in FIG. 1. Thereafter, in the laser printer 1, the paper 3 is conveyed backward along a first paper path 55 shown by arrows in FIG. 1. The paper 3 passes between the photosensitive drum 40 and the transfer roller 43 in the middle of the first paper path 55, and then an image is formed on the upper side of the paper 3.

Thereafter the paper 3 is conveyed along the sheet discharge path 52 so as to turn round, and thereby the paper 3 is reversed again. Then the paper 3 is ejected onto the catch tray 4 with the printed side facing down. This discharging method is called "face-down sheet discharging". According to this construction, paper 3 should be set into the paper cassette 6 with the side to be printed on facing down.

On the other hand, in the case that an image is formed on paper 3 fed from the MP tray 7, the paper 3 from the MP tray 7 is conveyed along a second paper path 56 shown by arrows in FIG. 2. In the laser printer 1, the paper 3 is conveyed backward so as to pass between the photosensitive drum 40 and the transfer roller 43 on the way, and thereby an image is formed on the upper side of the paper 3.

Thus the second paper path 55 partly coincides with the first paper path 56, and shares the sheet discharge path 52. Therefore, after passing between the photosensitive drum 40 and the transfer drum 43, the paper 3 is conveyed along the sheet discharge path 52 in a similar manner to the way the paper 3 from the paper cassette 6 is conveyed after passing between the photosensitive drum 40 and the transfer drum 43.

However, the paper 3 from the MP tray 7 is fed between the photosensitive drum 40 and the transfer drum 43 without being reversed, contrary to the paper 3 from the paper cassette 6 which is reversed on the upstream side of the photosensitive drum 40 and the transfer drum 43. Therefore, paper 3 should be set into the MP tray 7 with the side to be printed on facing up.

2. Hardware Configuration

Figure 3:
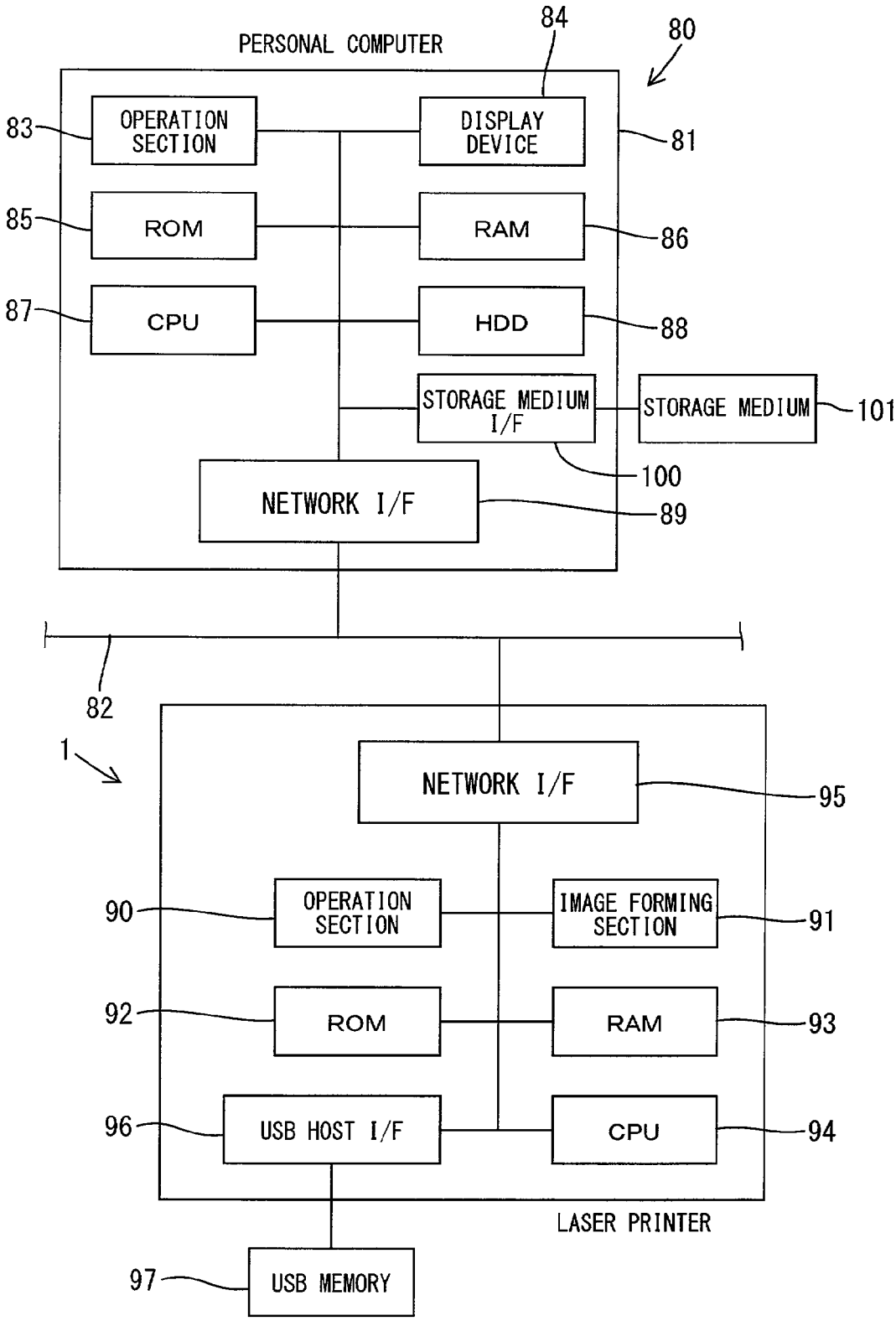
FIG. 3 is a block diagram showing the general configuration of an image forming system.

FIG. 3 is a block diagram showing an image forming system 80. The image forming system 80 includes a personal computer 81 and the above laser printer 1, which are connected to each other via a LAN cable 82, for example. When the laser printer 1 receives image data from the personal computer 81, the laser printer 1 forms an image based on the received image data.

The personal computer 81 includes an operation section 83 (e.g., a keyboard or a mouse), a display device 84 (i.e., an example of "a display apparatus"), a ROM 85, a RAM 86, a CPU 87 (i.e., an example of "a processor"), a hard disk drive (HDD) having a hard disk 88, a network interface 89 (hereinafter, referred to as "a network I/F"), and a storage medium interface 100 (hereinafter, referred to as "a storage medium I/F").

The operation section 83 receives an external input operation. The display device 84 can display the preview of an image to be printed, the user-interface screens and the like.

The display control program of the present aspect, applications software for generating image data to be outputted to the laser printer 1, a printer driver and the like are stored in the hard disk 88. The CPU 87 retrieves and executes the display control program, the applications software, the printer driver and the like in response to a start-up command or the like from the operation section 83.

The display control program can be provided as a computer-readable storage medium 101 such as a DVD, a CD-ROM, or a floppy (TM) disk, on which the display control program is stored. The personal computer 81 can retrieve the display control program from the storage medium 101 via the storage medium I/F 100. Alternatively, the personal computer 81 can download the display control program via an external network such as the Internet.

The display control program is installed onto the hard disk 88, and executed in order to achieve the display control described below. The CPU 87 executing the display control program is an example of "a display controller". The CPU 87 executing the printer driver is an example of "a printer controller".

Various control programs for controlling the personal computer 81, various set values, initial values and the like are preliminarily stored in the ROM 85.

The control programs, the set values, the initial values and the like are retrieved from the ROM 85 by the CPU 87, and temporarily stored in the RAM 86. Further, image data generated on the personal computer 81 during execution of the applications software, the printer driver and the like are temporarily stored on the RAM 86.

The printing preference as to Printing Mode (single-side printing or duplex printing), Number of copies, N pages per sheet for N-in-1 mode and the like, and the duplex printing preference as to Duplex Type (binding style), Two-faced Mode and the like are inputted by the user via the operation section 83 of the personal computer 81 or the operation section 90 (described below) of the laser printer 1, and also temporarily stored on the RAM 86.

If the user performs a predetermined operation on the operation section 83, the operation section 83 outputs a print request to the CPU 87. When the CPU 87 receives the print request from the operation section 83, image data generated by execution of the applications software is sent to the printer driver being executed, and converted (or developed) to PDL data by execution of the printer driver, for example. Thereafter the image data is outputted to the laser printer 1 via the network I/F 89 and the LAN cable 82.

The laser printer 1 includes an operation section 90 for receiving an external input operation, an image forming section 91 for performing an image forming operation, a ROM 92, a RAM 93, a CPU 94, a network interface 95 (hereinafter, referred to as "a network I/F"), and a USB host interface 96 (hereinafter, referred to as "a USB host I/F").

Further, a USB memory can be detachably attached to the laser printer 1, and information stored in the USB memory may be retrieved via the USB host I/F 96. An image file to be printed can be stored in the USB memory 97, and the laser printer 1 can retrieve and print the image file stored in the USB memory 97.

A program for responding to inquiries from the personal computer 81, a program for executing a process based on instructions from the personal computer 81, and a program for controlling the overall operation of the laser printer 1 are stored in the ROM 92.

The CPU 94 performs control based on the programs stored in the ROM 92, so that printer language processing (PDL processing) is performed for PDL data received from the personal computer 81 via the network I/F 95. The processed data is sent to the image forming section 91.

The image forming section 91 performs an image forming operation based on the received data, so that information corresponding to an image to be formed is printed on paper 3.

3. Printing Modes

In the present aspect, the laser printer 1 can operate in single-side printing mode for printing on one side of paper 3, and in manual duplex printing mode for printing on both sides of paper 3. The user can select the printing mode on the setting screen provided by execution of the printer driver as described below.

(1) Single-Side Printing Mode

Figure 4A:
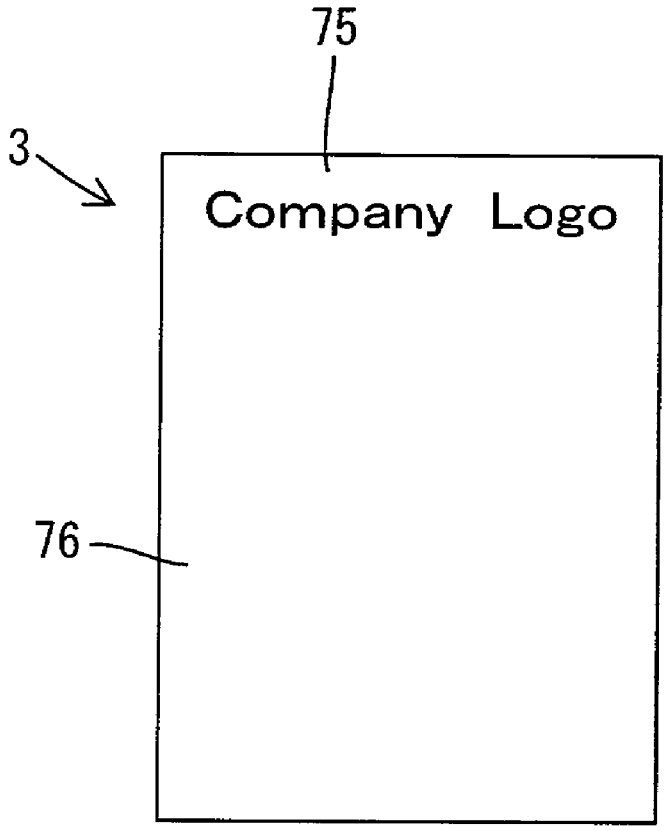
FIGS. 4A and 4B are plain views showing the two sides of paper respectively.
Figure 4B:
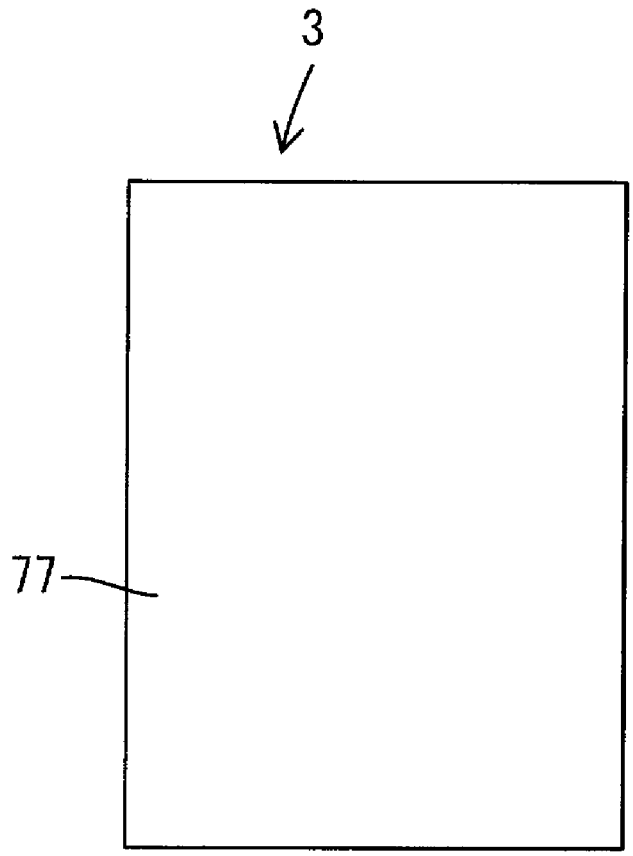
Figure 5A:
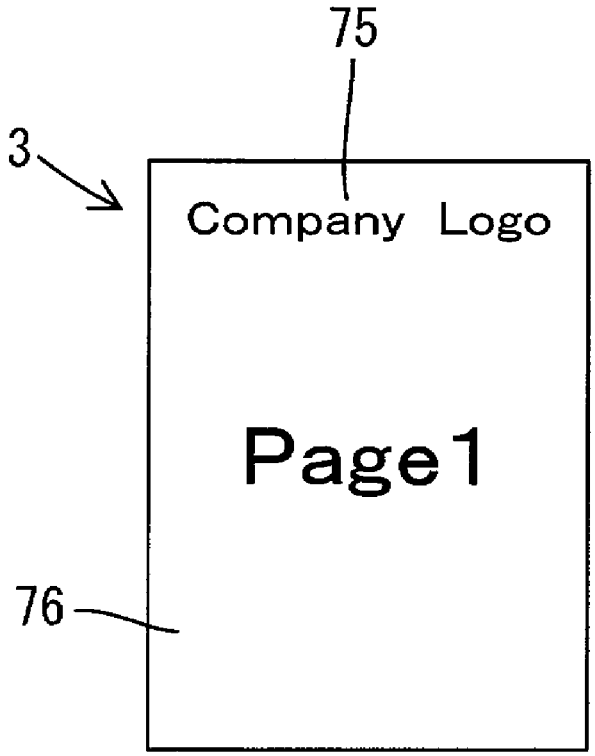
FIGS. 5A to 5D are plain views showing the obverse sides of four sheets as a result of single-side printing.
Figure 5B:
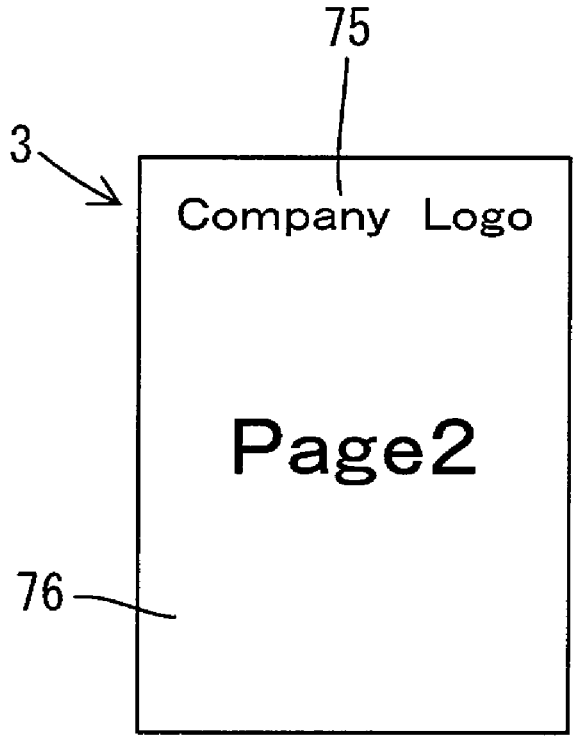
Figure 5C:
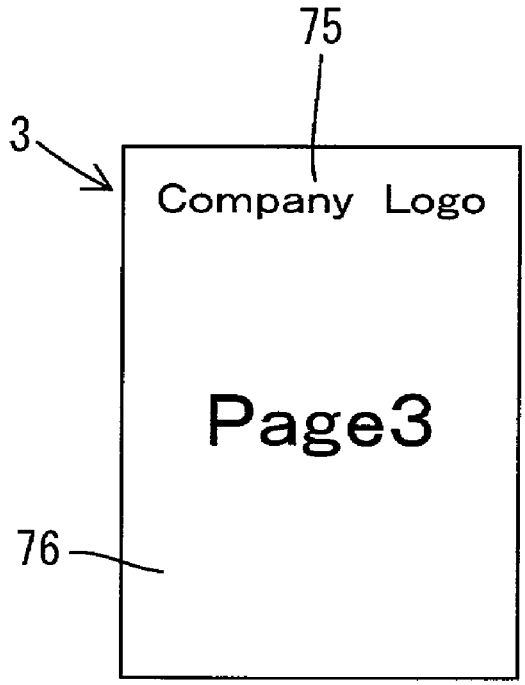
Figure 5D:
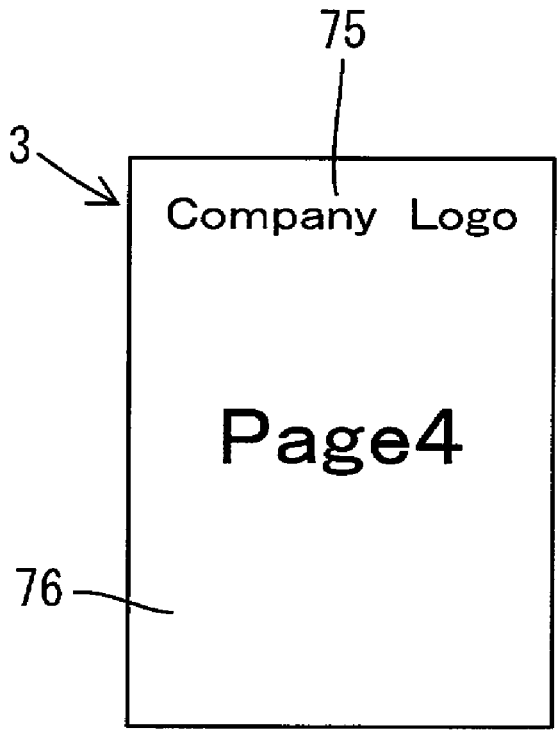

Hereinafter, single-side printing mode will be explained, pointing to the case wherein printing is performed using two-faced paper. Two-faced paper has two sides which are in some way different from each other or are distinguishable. For example, a company logo 75 is printed near the top of one side (obverse side) 76 as shown in FIG. 4A, while the other side (reverse side) 77 is blank as shown in FIG. 4B. Thus, in some two-faced paper 3, its head (i.e., the top of the obverse side) can be identified.

In the case that images are formed on such paper 3 (headed paper), the laser printer 1 receives, from the CPU 87, data containing images to be printed, which are arranged in ascending order by the CPU 87 when the user selects the single-side printing mode, and prints the images on the obverse side 76 of paper 3 in ascending order as shown in FIGS. 5A to 5D, for example. In FIGS. 5A to 5D, "Page 1", "Page 2", "Page 3" and "Page 4" represent the printed images, and also represent the page numbers.

Figure 6A:
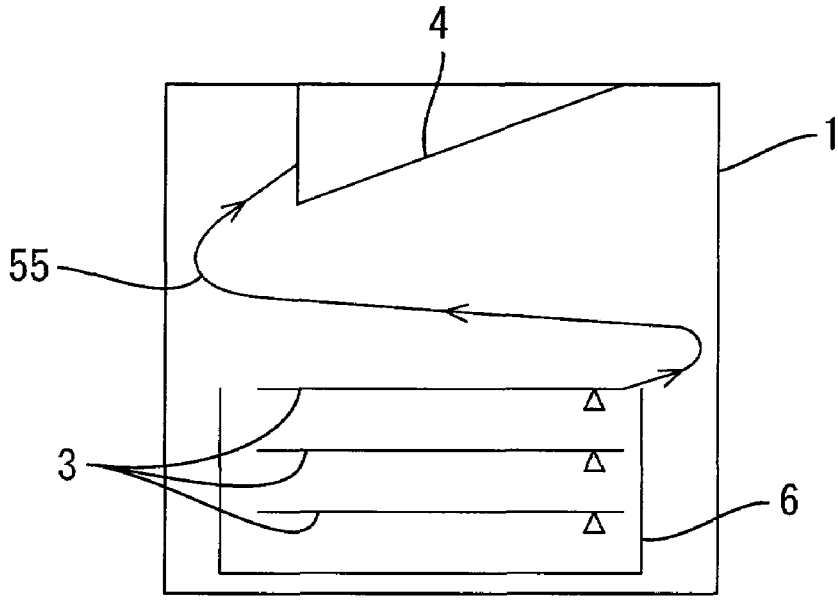
FIG. 6A is a schematic diagram showing how to set paper into a paper cassette for single-side printing.
Figure 6B:
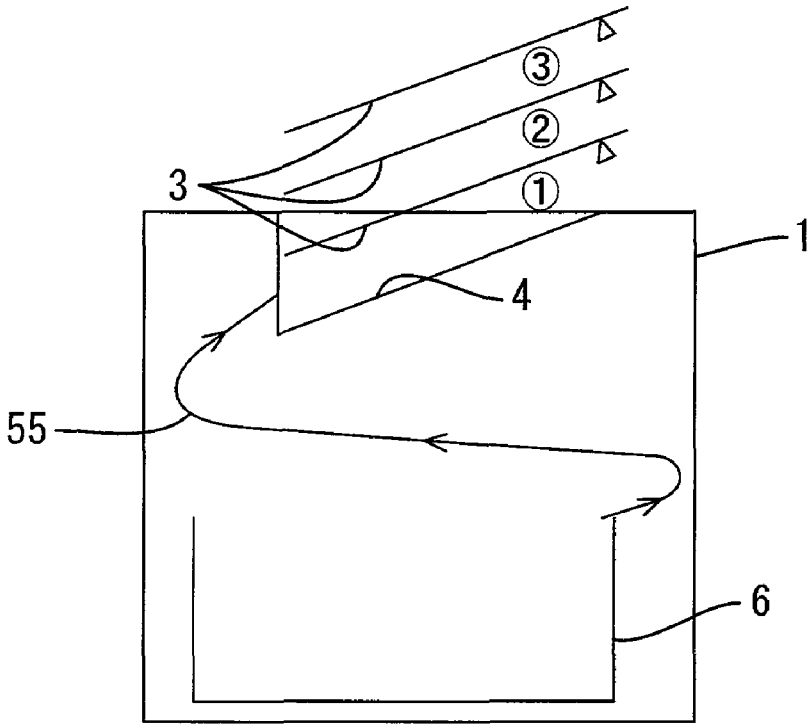
FIG. 6B is a schematic diagram showing how the printed paper is ejected onto a catch tray at the end of single-side printing.

FIG. 6A schematically shows how paper 3 should be set into the paper cassette 6, and FIG. 6B shows the printed paper 3 ejected onto the catch tray 4 when images has been printed on the paper 3 fed from the paper cassette 6. In FIGS. 6A and 6B, symbols "Δ" indicate the head of paper 3. In FIG. 6B, encircled numbers represent the page numbers.

As described above and shown in FIG. 6A, paper 3 should be set into the paper cassette 6 with the side to be printed on (i.e., obverse side 76) facing down. Further, the head of the paper 3 should be at the front (first-out end) of the paper cassette 6, in order that images are printed as upright images. FIG. 6B shows three sheets of paper 3, on which three pages of images are printed and which are ejected onto the catch tray 4 facing down.

Figure 7A:
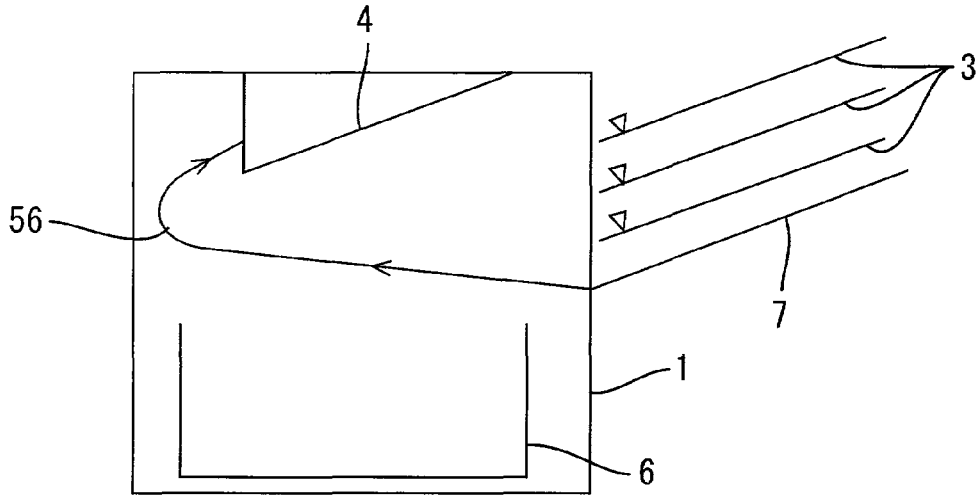
FIG. 7A is a schematic diagram showing how to set paper into the MP tray for single-side printing.
Figure 7B:
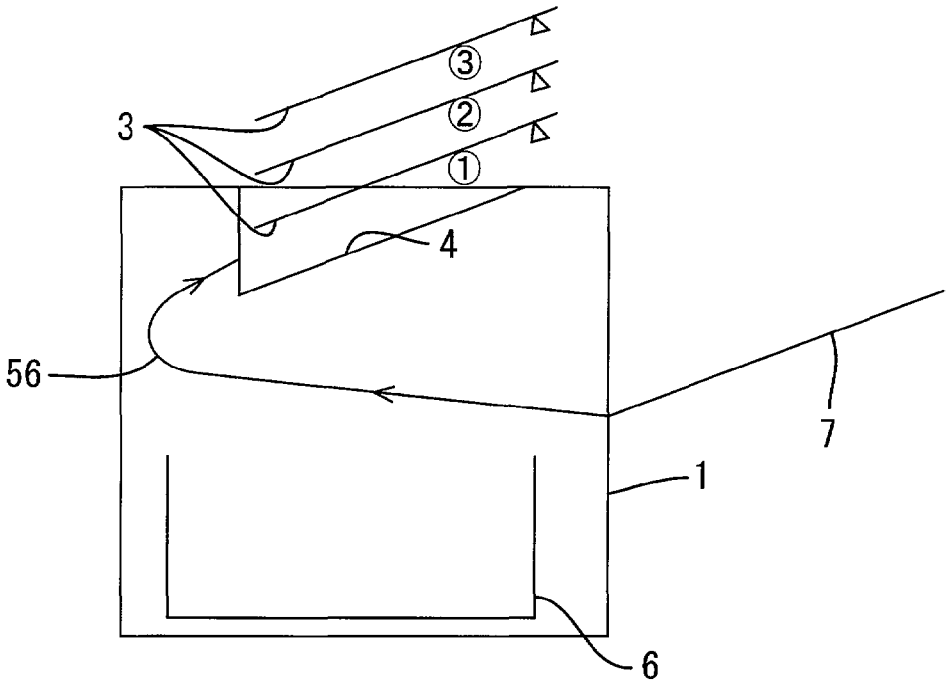
FIG. 7B is a schematic diagram showing how the printed paper is ejected onto the catch tray at the end of single-side printing.

FIG. 7A schematically shows how paper 3 should be set into the MP tray 7, and FIG. 7B shows the printed paper 3 ejected onto the catch tray 4 when images has been printed on the paper 3 fed from the MP tray 7.

As described above and shown in FIG. 7A, paper 3 should be set into the MP tray 7 with the side to be printed on (i.e., obverse side 76) facing up. Further, the head of the paper 3 should be at the back (first-in end) of the MP tray 7. FIG. 7B shows three sheets of paper 3, on which three pages of images are printed and which are ejected onto the catch tray 4 facing down.

Thus, in the laser printer 1 of the present aspect, paper 3 should be set into the MP tray 7 so that the obverse side 76 and head thereof face the opposite directions from those of paper 3 set into the paper cassette 6, in order to achieve the same printing results.

(2) Duplex Printing Mode

In the laser printer 1 of the present aspect, a duplex printing unit, which can automatically refeed the printed paper after one side thereof is printed on so that the other side of the paper can be printed on, is not provided.

However, in the present aspect, duplex printing can be achieved by execution of the printer driver as follows. The even-numbered pages are printed on the reverse side 77 of paper 3 during the first half of duplex printing. Next, during the second half of duplex printing, the odd-numbered pages are printed on the obverse side 76 of the printed paper 3 which is fed from the MP tray 7.

Therefore, if the user selects the duplex printing mode, he/she needs to manually set the printed paper 3 into the MP tray 7 after one side of the paper 3 is printed on, so that the other side of the paper 3 can be printed on.

Figure 8A:
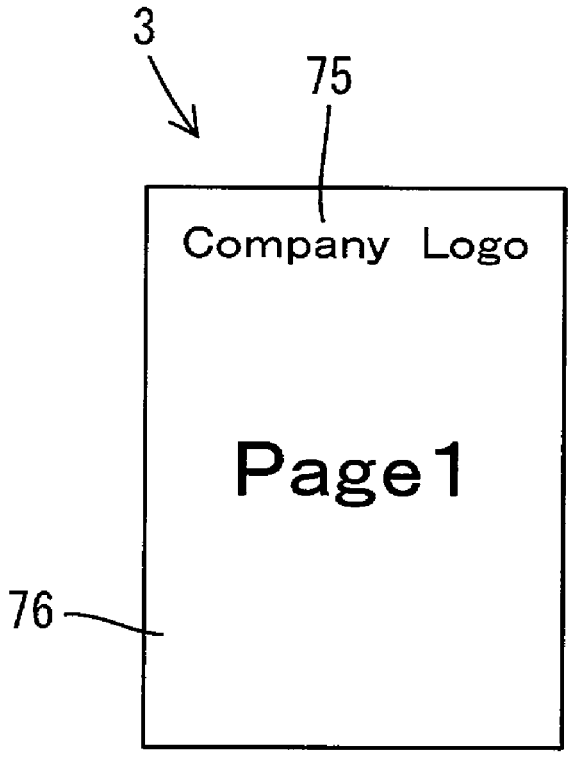
FIGS. 8A to 8D are plain views showing the two sides of two sheets on which images are formed as upright images on the respective sides by duplex printing.
Figure 8B:
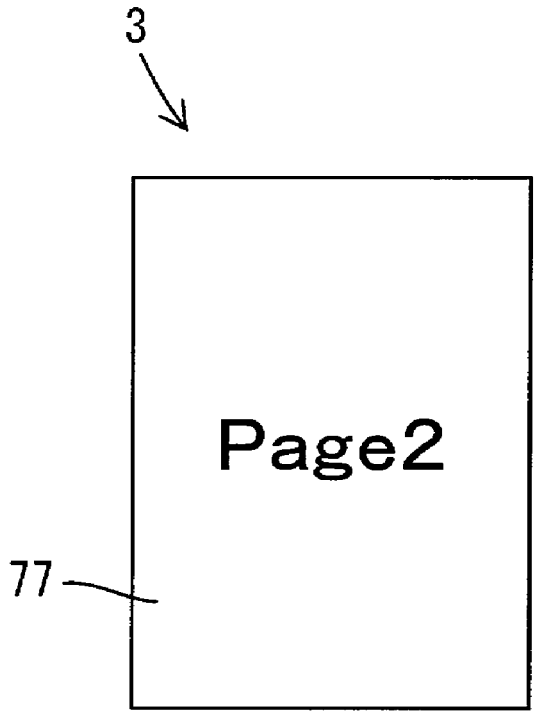
Figure 8C:
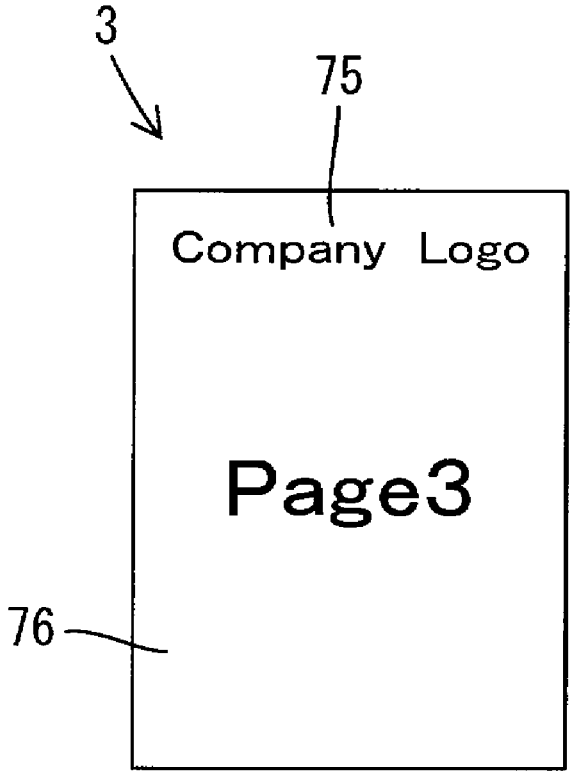
Figure 8D:
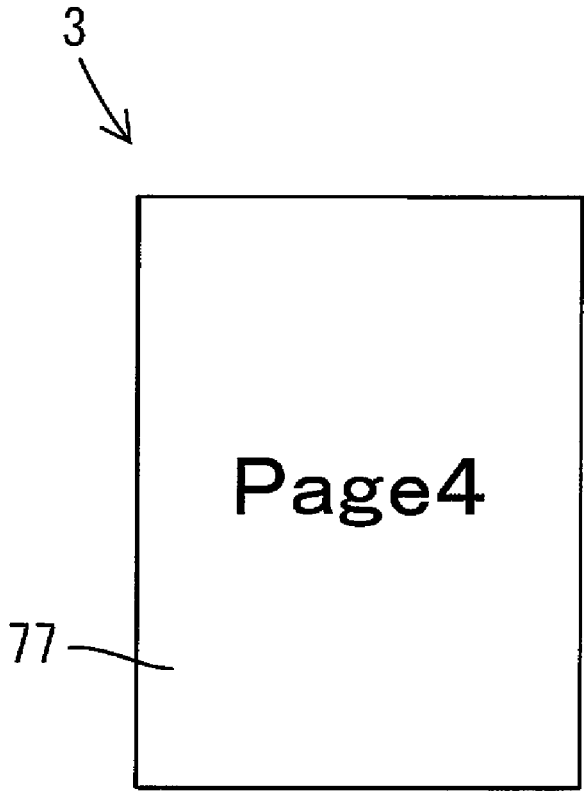

Thereby images can be printed on the obverse side 76 and reverse side 77 of paper 3 as shown in FIGS. 8A to 8D, for example. FIGS. 8A and 8B show the obverse side 76 and reverse side 77 of one sheet of paper 3, on which Page 1 and Page 2 of the images are printed respectively. FIGS. 8C and 8D show the obverse side 76 and reverse side 77 of another sheet of paper 3, on which Page 3 and Page 4 of the images are printed respectively.

In the example shown in FIGS. 8A to 8D, images are printed as upright images on both sides of headed paper 3, that is, the top of the image printed on the reverse side 76 of the paper 3 corresponds to the top (head) of the obverse side 77.

Figure 9A:
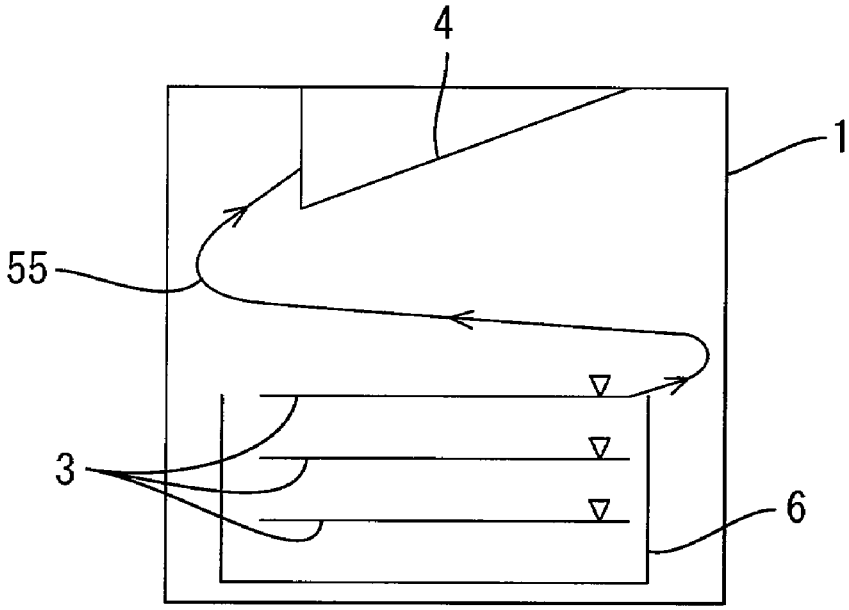
FIG. 9A is a schematic diagram showing how to set paper into the paper cassette for the first half of duplex printing.
Figure 9B:
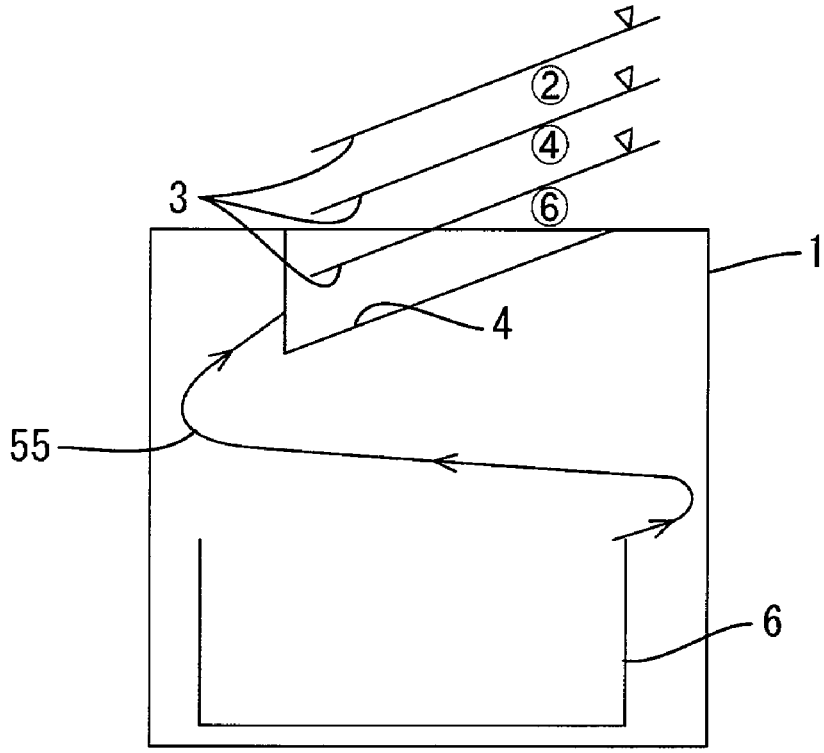
FIG. 9B is a schematic diagram showing how the printed paper is ejected onto the catch tray at the end of the first half of duplex printing.

Hereinafter, the manual duplex printing mode will be explained, pointing to the case wherein printing is performed using headed paper. FIG. 9A shows how headed paper 3 should be set into the paper cassette 6 for the first half of duplex printing, in order to achieve the printing results shown in FIGS. 8A to 8D. FIG. 9B shows the printed paper 3 ejected onto the catch tray 4 when the first half of duplex printing is finished.

When the user selects the duplex printing mode, the CPU 87 sorts the even-numbered pages from the image file to be printed, and arranges the even-numbered pages in descending order. Then the CPU 87 sends the resultant data to the laser printer 1. If the user sets paper 3 into the paper cassette 6 with the obverse side 76 facing up and with the head of the paper at the front (first-out end) of the paper cassette 6 as shown in FIG. 9A, the laser printer 1 can print the even-numbered pages on the reverse side 77 of the paper 3 according to the data received from the CPU 87.

Thus the even-numbered pages are printed in descending order, and the printed paper 3 is ejected onto the catch tray 4 with the printed side (reverse side 77) facing down as shown in FIG. 9B. FIG. 9B shows three sheets of paper 3, on which Page 2, Page 4 and Page 6 are printed.

As described above, contrary to the single-side printing mode wherein paper 3 is set with the obverse side 76 facing down, the user should set paper 3 with the obverse side 76 facing up for the first half of duplex printing as shown in FIG. 9A. This is because printing on the reverse side 77 of paper 3 is performed during the first half of duplex printing in the present aspect.

Further, in order to achieve the printing results wherein images are printed as upright images on both sides 76, 77 of paper 3 as shown in FIGS. 8A to 8D, the user should set paper 3 with the head of the paper 3 at the front (first-out end) of the paper cassette 6 as shown in FIG. 9A. This is because the top of the image is printed on the first-out side of the paper 3 in the present aspect, as described above.

Figure 10A:
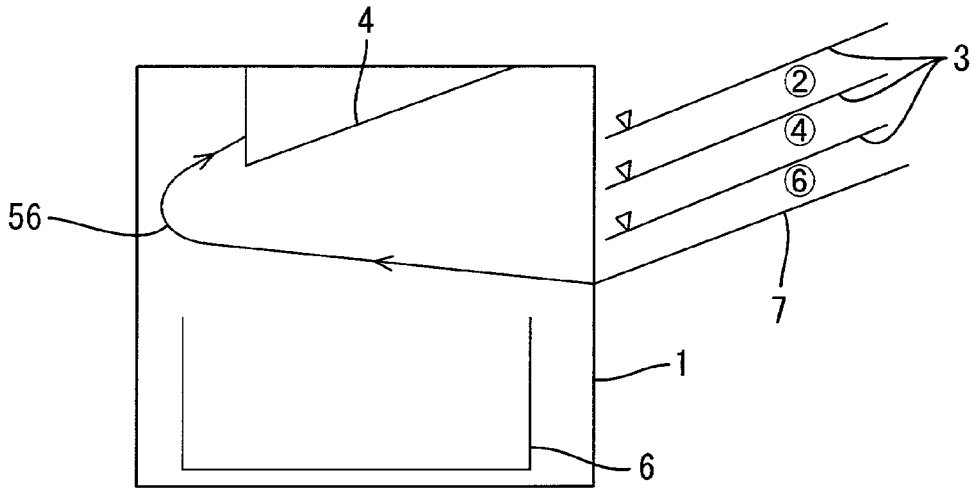
FIG. 10A is a schematic diagram showing how to set paper into the MP tray for the second half of duplex printing.

Next, for the second half of duplex printing, the user should set the printed paper 3, which has been ejected onto the catch tray 4, into the MP tray 7 with the obverse side 76 facing up and the head of the paper 3 at the back (first-in end) of the MP tray 7 as shown in FIG. 10A.

For the second half of duplex printing, the CPU 87 sorts the odd-numbered pages from the image file to be printed, and arranges the odd-numbered pages in ascending order. Then the CPU 87 sends the resultant data to the laser printer 1. According to the data received from the CPU 87, the laser printer 1 prints the odd-numbered pages in ascending order.

Figure 10B:
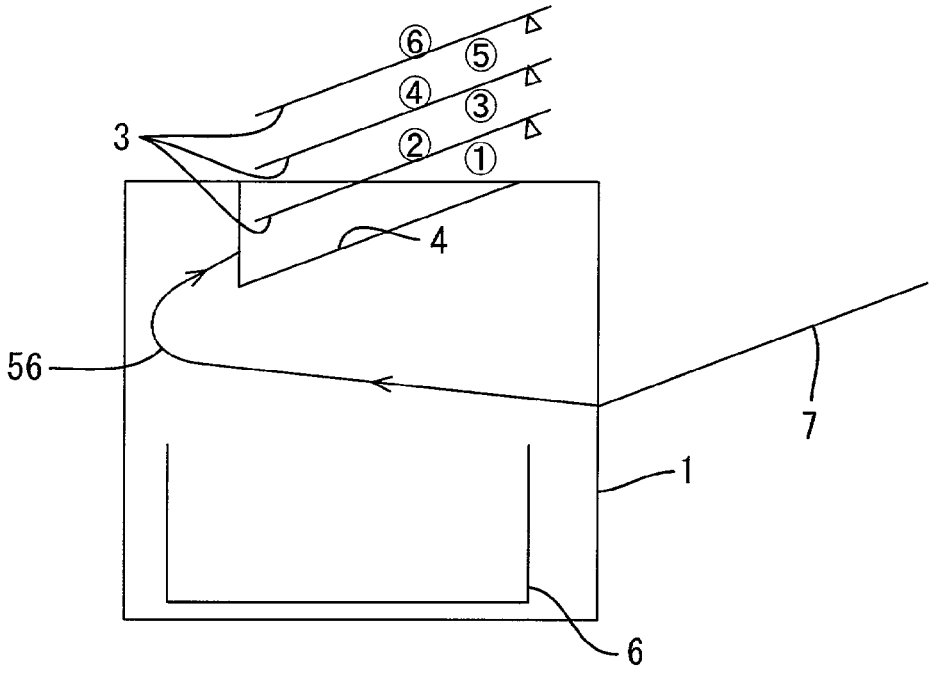
FIG. 10B is a schematic diagram showing how the printed paper is ejected onto the catch tray at the end of the second half of duplex printing.

Thus the odd-numbered pages are printed on the obverse side 76 of the printed paper 3 which is fed from the MP tray 7. The printed paper 3 is ejected onto the catch tray 4 with the just-printed side (obverse side 76) facing down as shown in FIG. 10B, and then the manual duplex printing is completed. FIG. 10B shows three sheets of paper 3, on which Page 1, Page 3 and Page 5 are printed on the obverse sides, and Page 2, Page 4 and Page 6 are printed on the reverse sides.

In this way, duplex printing can be manually achieved using the laser printer 1 of the present aspect, and thereby the printing results shown in FIGS. 8A to 8D can be obtained, for example. cl 4. Display Control Hereinafter, the display control program will be explained with reference to FIGS. 11 through 24. The display control program is executed by the CPU 87 interfacing with the printer driver being executed. The operation based on the display control program and the printer driver is as follows.

Figure 11:
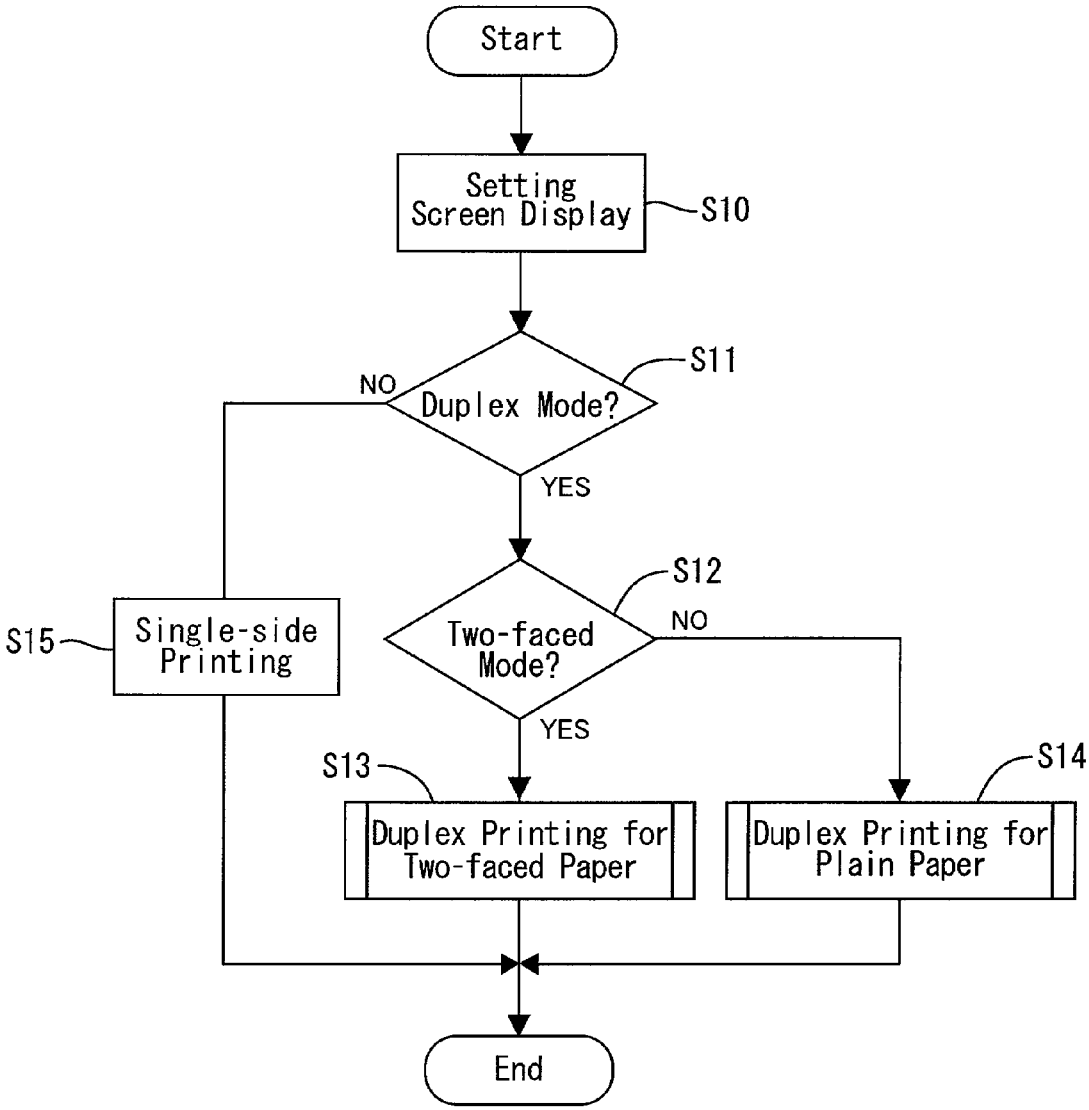
FIG. 11 is a flowchart of a printing process.

When the user inputs a start-up command for printing, the CPU 87 executes a printing process shown in FIG. 11 based on the printer driver.

Figure 12:
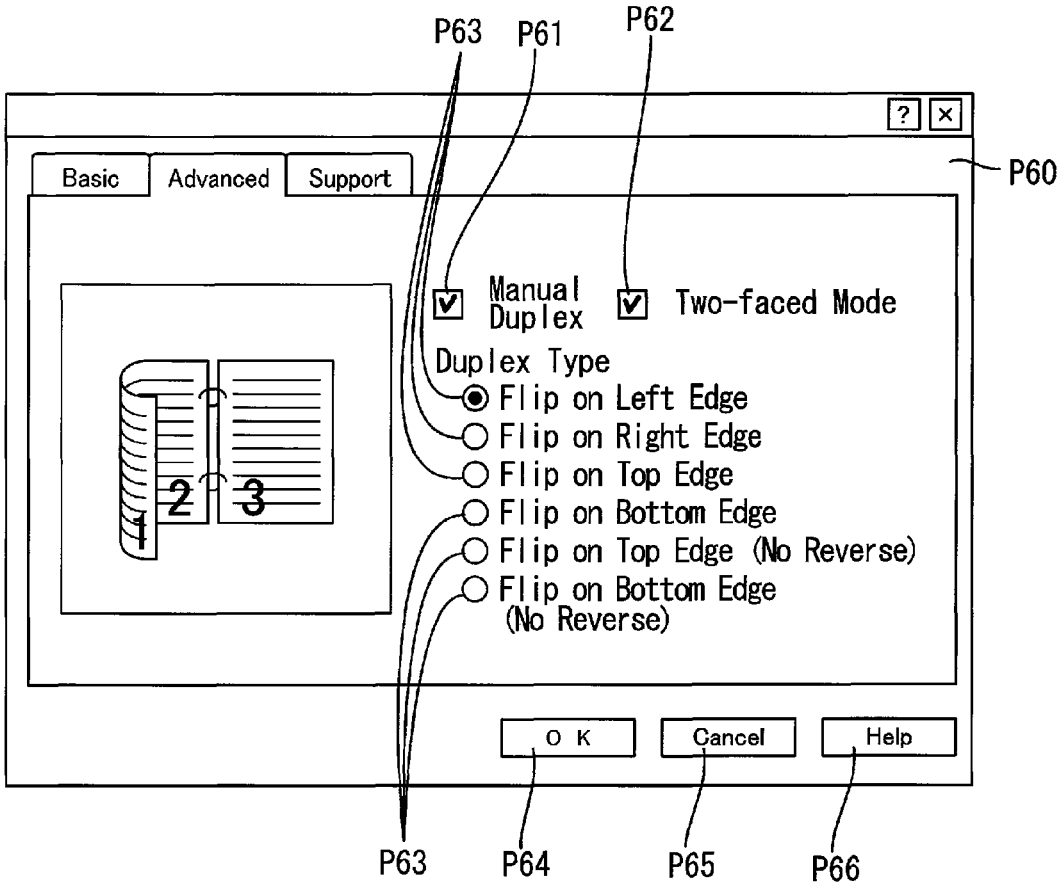
FIG. 12 shows an example of an advanced setting screen.
Figure 13:
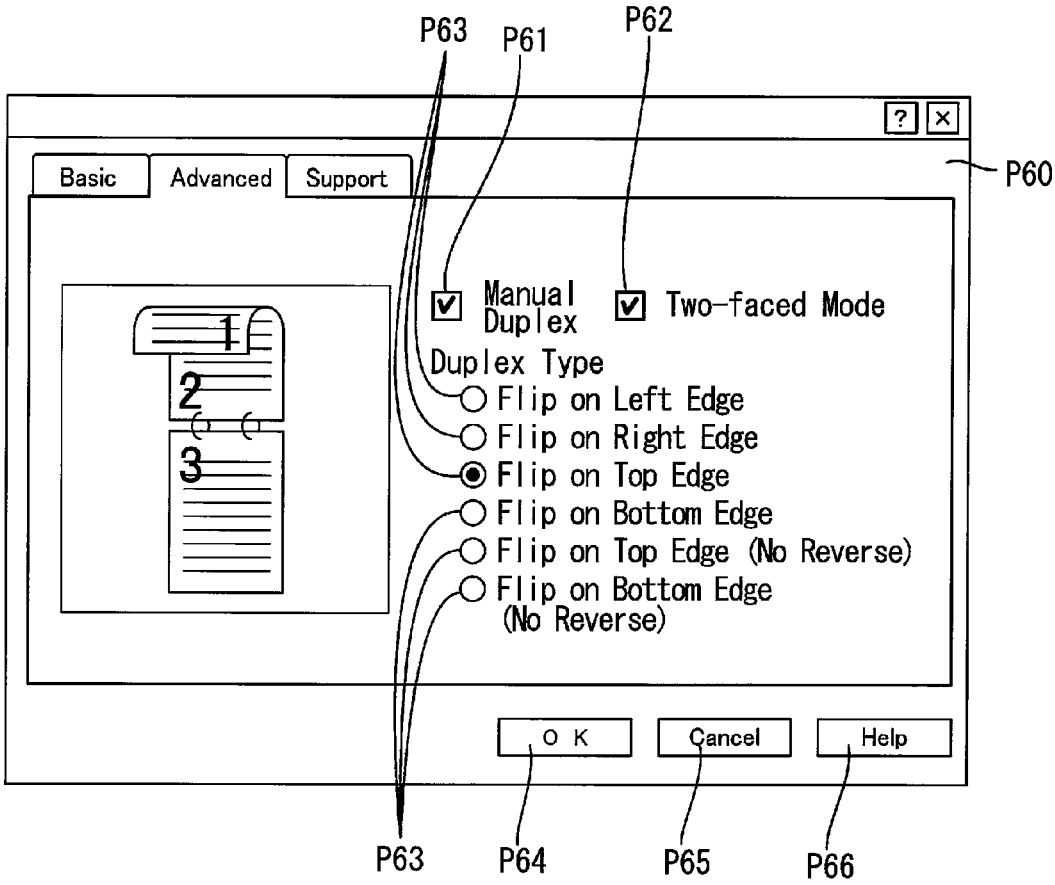
FIG. 13 shows another example of the advanced setting screen.

First, the CPU 87 executes a printer setting display process at step S10 for causing the display device 84 of the personal computer 81 to display an advanced setting screen P60 shown in FIG. 12 or 13.

The advanced setting screen P60 includes "Manual Duplex" checkbox P61 and "Two-faced Mode" checkbox P62, and further includes "Duplex Type" radio buttons P63 below the checkboxes P61, P62. "OK" button P64, "Cancel" button P65 and "Help" button P66 are provided at the bottom of the advanced setting screen P60.

The user can select the duplex printing mode by ticking the checkbox P61. When the user will request duplex printing using two-faced paper, the checkbox P62 should be ticked. Further, the user can specify the duple type (i.e., the binding style for duplex-printed sheet) using the radio buttons P63.

If the user clicks "OK" button P64 after he/she ticks or un-checks the checkboxes P61, P62 and selects the radio button P63 so as to enable printing in desired mode, the CPU 87 executes a first a determination process at step S11 for determining whether the duplex printing mode has been selected or not.

If it is determined that the duplex printing mode has not been selected (i.e., No at step S11), a single-side printing process is executed at step S15. During the single-side printing process, the CPU 87 arranges images to be printed in the ascending order and sends the resultant data to the laser printer 1, so as to cause the laser printer 1 to print the images on paper 3. When the single-side printing process is finished, the present printing process terminates.

On the other hand, if it is determined that the duplex printing mode has been selected (i.e., Yes at step S11), a second determination process is executed at step S12 for determining whether the two-faced mode has been selected or not. If it is determined that the two-faced mode has been selected (i.e., Yes at step S12), a duplex printing process for two-faced paper is executed at step S13. If No is determined at step S12, a duplex printing process for plain paper is executed at step S14.

(Duplex Printing for Two-Faced Paper)

Figure 14:
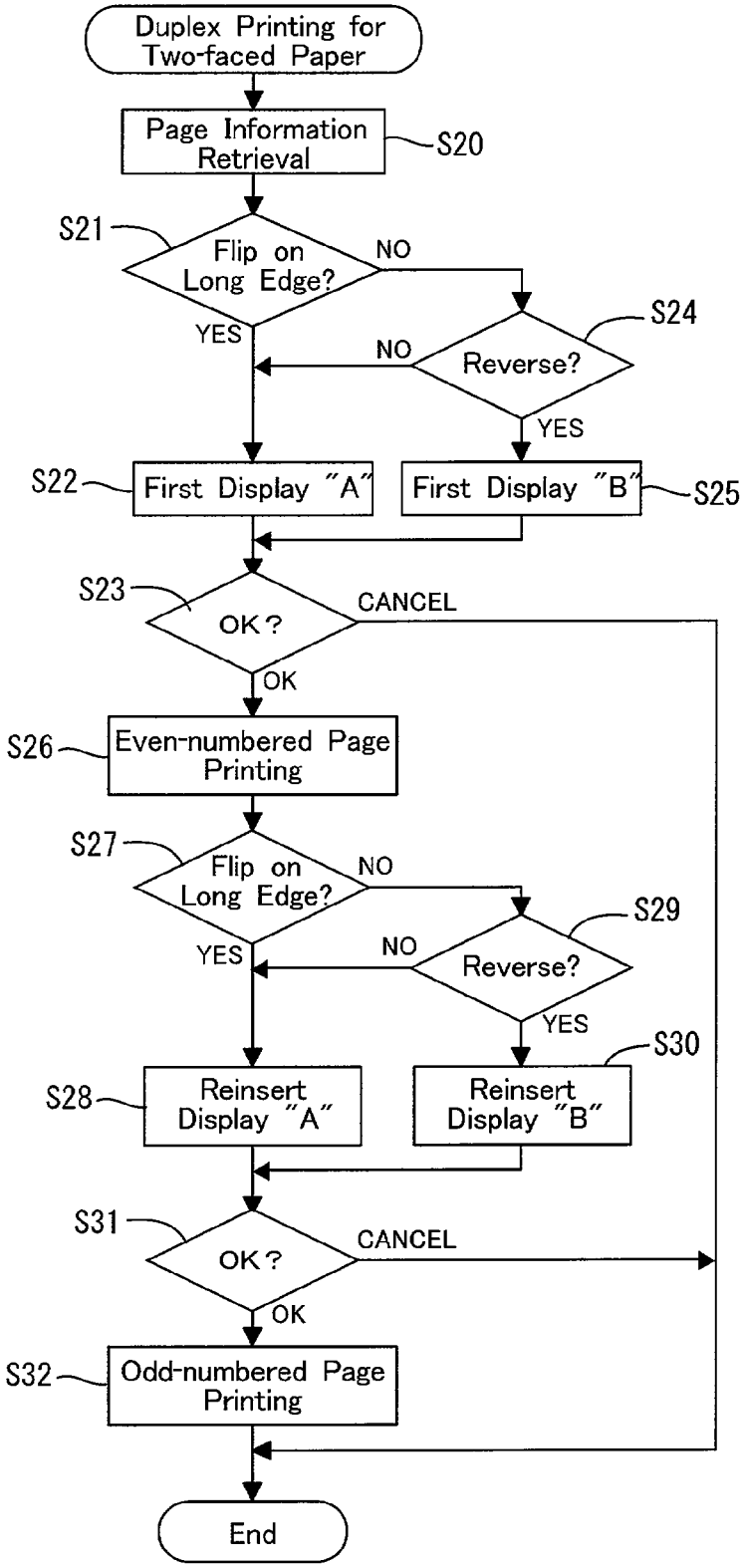
FIG. 14 is a flowchart of a duplex printing process for printing on two-faced paper.

FIG. 14 shows details of the duplex printing process for two-faced paper executed at step S13. First, at step S20, the CPU 87 obtains the page information of a file to be printed from a control process executed based on the printer driver. The page information includes information related to the number n of pages. Using this information, the number of sheets to be actually used for printing is calculated as the integral part of (n+1)/2 at step S20.

Next, it is determined at step S21 whether one of "Flip on Left Edge" and "Flip on Right Edge" has been selected as the duplex type on the advanced setting screen. If No is determined at step S21, it is determined at step S24 whether one of "Flip on Top Edge" and "Flip on Bottom Edge" has been selected as the duplex type on the advanced setting screen.

Figure 16:
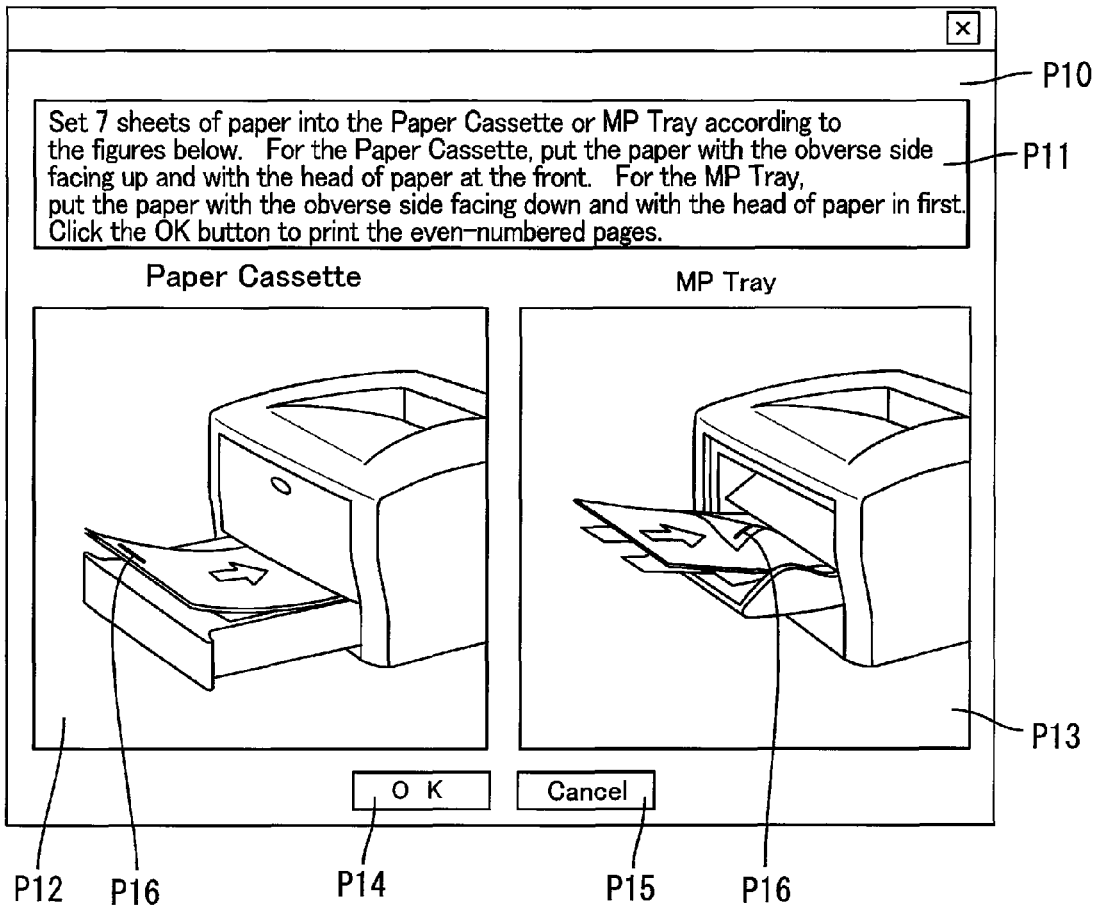
FIG. 16 shows an example of a first instruction screen.

If Yes is determined at step S21 or No is determined at step S24 (i.e., if any of "Flip on Left Edge", "Flip on Right Edge", "Flip on Top Edge (No Reverse)" and "Flip on Bottom Edge (No Reverse)" has been selected as shown in FIG. 12), the CPU 87 executes a first display process "A" (described below) at step S22 for causing the display device 84 to display a first instruction screen P10 as shown in FIG. 16. The first instruction screen P10 shows how to set paper 3 for the first half of duplex printing, as described in detail below.

When any of "Flip on Left Edge", "Flip on Right Edge", "Flip on Top Edge (No Reverse)" and "Flip on Bottom Edge (No Reverse)" has been thus selected, images should be printed as upright images on both of the obverse side 76 and the reverse side 77. That is, the top of the image printed on the obverse side 76 should correspond to the head of paper 3, and also the top of the image printed on the obverse side 77 should correspond to the head of paper 3.

Figure 15A:
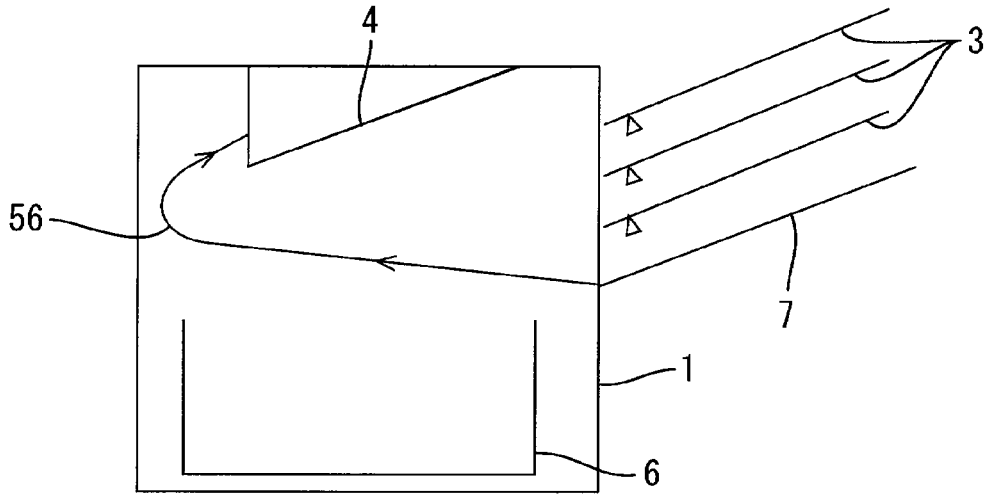
FIG. 15A is a schematic diagram showing how to set paper into the MP tray for the first half of duplex printing.

Therefore, in this case, the even-numbered pages of images should be printed as upright images on the reverse side 77 of paper 3 during the first-half of duplex printing. This can be achieved by setting paper 3 into the paper cassette 6 as shown in FIG. 9A or into the MP tray 7 as shown in FIG. 15A.

That is, the user should set paper 3 into the paper cassette 6 with the obverse side 76 facing up and with the head of paper 3 at the front (first-out end) of the paper cassette 6. Alternatively, the user should set paper 3 into the MP tray 7 with the obverse side 76 facing down and with the head of paper 3 at the back (first-in end) of the MP tray 7.

Therefore, if paper 3 previously set into the paper cassette 6 or the MP tray 7 for single-side printing is diverted to use for the present duplex printing, the user should reverse the paper 3 in the paper cassette 6 or the MP tray 7.

If paper 3 is newly set into the paper cassette 6 or the MP tray 7 for the present duplex printing, the user should determine proper orientation of the paper 3 based on the logo 75 printed on the obverse side 76 of the paper 3. Thus, it is bothersome for the user to set paper 3 into the paper cassette 6 or the MP tray 7 so that upright images can be printed on the reverse side 77 of the paper 3.

In view of this, according to the present aspect, the CPU 87 executes the first display process "A" at step S22 of FIG. 14 for causing the display device 84 to display the first instruction screen P10 shown in FIG. 16. The first instruction screen P10 provides, for the user, instructions on how to place paper 3 in the paper cassette 6 or the MP tray 7.

As shown in FIG. 16, the first instruction screen P10 includes a text box P11 at the top thereof, which provides instructions in words. The text box P11 provides instructions on:

(a) The number of sheets (calculated at step S20);

(b) How to set paper 3 into the paper cassette 6, or specifically:

(b1) Which direction the obverse side (i.e., an example of "a distinctive side") of paper should face in the paper cassette 6; and (b2) Orientation of paper in the paper cassette 6 (i.e., which side the head of paper in the paper cassette 6 should be on); and (c) How to set paper 3 into the MP tray 7, or specifically:

(c1) Which direction the obverse side of paper should face in the MP tray 7; and (c2) Orientation of paper in the MP tray 7 (i.e., which side the head of paper in the MP tray 7 should be on).

Specifically, the instructions are provided as follows: "Set 7 sheets (as (a)) of paper into the Paper Cassette or MP Tray according to the figures below. For the Paper Cassette, put the paper with the obverse side facing up (b1) and with the head of paper at the front (b2). For the MP Tray, put the paper with the obverse side facing down (c1) and with the head of paper in first (c2). Click the OK button to print the even-numbered pages."

The first instruction screen P10 further includes a cassette instruction P12 and an MP-tray instruction P13 below the text box P11. In FIG. 16, the cassette instruction P12 is displayed on the left-hand side, and the MP-tray instruction P13 is displayed on the right-hand side. The cassette instruction P12 provides pictorial instructions on how to set paper 3 into the paper cassette 6. The MP-tray instruction P13 provides pictorial instructions on how to set paper 3 into the MP tray 7.

The cassette instruction P12 includes a schematic perspective view of the appearance of the laser printer 1, in which the paper cassette 6 is pulled out and open. Further, paper with a company logo P16 is displayed. In the drawing, the paper is set into the paper cassette 6 with the logo P16 facing up and at the front (i.e., with the obverse side of paper facing up and with the head of paper at the front of the paper cassette 6).

The MP-tray instruction P13 also includes a schematic perspective view of the laser printer 1, in which the MP tray 7 is open and paper with a company logo P16 is also displayed. In the drawing, the paper is set into the MP tray 7 with the logo P16 facing down and in first (i.e., with the obverse side of paper facing down and with the head of paper at the back of the MP tray 7).

Thus the first instruction screen P10 is provided, and the user can obtain the textual information from the text box P11 and the image information from the cassette instruction P12 and the MP-tray instruction P13 on how to set paper 3. Thereby, the user can readily set paper 3 into the paper cassette 6 or the MP tray 7 for the first half of duplex printing.

The first instruction screen P10 includes, at the bottom thereof, "OK" button P14 and "Cancel" button P15 placed next to each other. The "OK" button P14 is clicked to initiate the first half of duplex printing. The "Cancel" button P15 is clicked to cancel printing processing.

The user sets paper 3 according to the first instruction screen P10, and clicks "OK" button P14. Then, returning to FIG. 14, "OK" is determined at step S23, and the CPU 87 executes an even-numbered page printing process at step S26.

In the present aspect, during the even-numbered page printing process at step S26, the CPU 87 sorts the even-numbered pages of an image file to be printed, and arranges the even-numbered pages in descending order (i.e., in the order such as Page 6, Page 4 and Page 2) as described above. The CPU 87 sends the resultant data to the laser printer 1, and thereby causes the laser printer 1 to print the even-numbered pages in descending order.

Figure 15B:
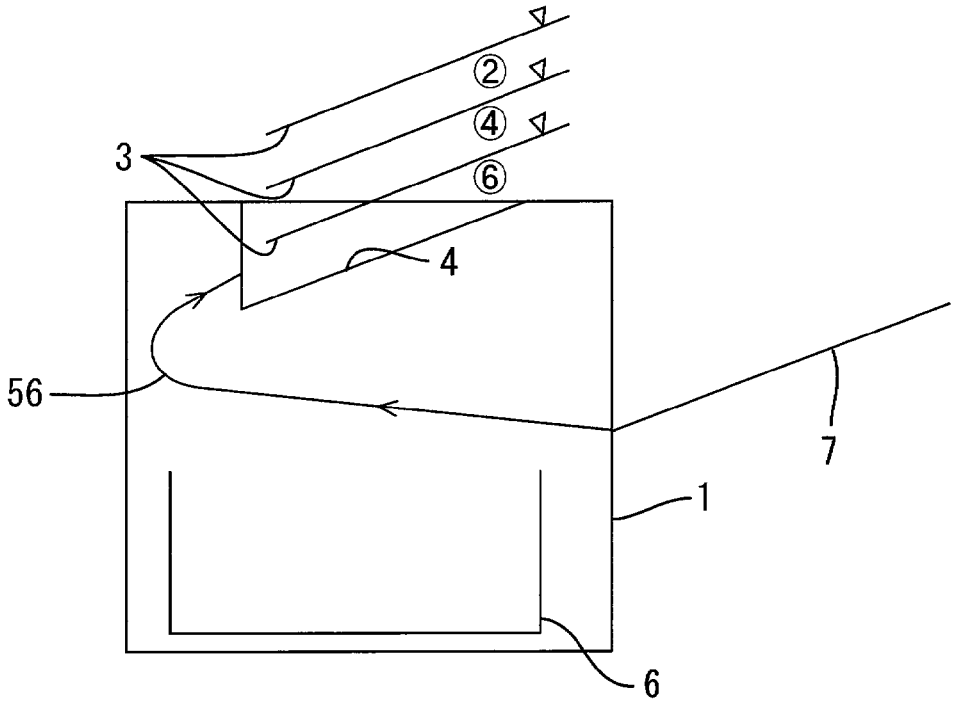
FIG. 15B is a schematic diagram showing how the printed paper is ejected onto the catch tray at the end of the first half of duplex printing.

Thus the even-numbered pages are printed on the reverse side 77 of the paper 3, and the printed paper 3 is ejected onto the catch tray 4 as shown in FIG. 9B or 15B. Then the first half of duplex printing is finished.

When step S26 is finished (i.e., the first half of duplex printing is finished), it is determined at step S27 whether one of "Flip on Left Edge" and "Flip on Right Edge" has been selected on the advanced setting screen. If No is determined at step S27, it is determined at step S29 whether one of "Flip on Top Edge" and "Flip on Bottom Edge" has been selected on the advanced setting screen.

Figure 17:
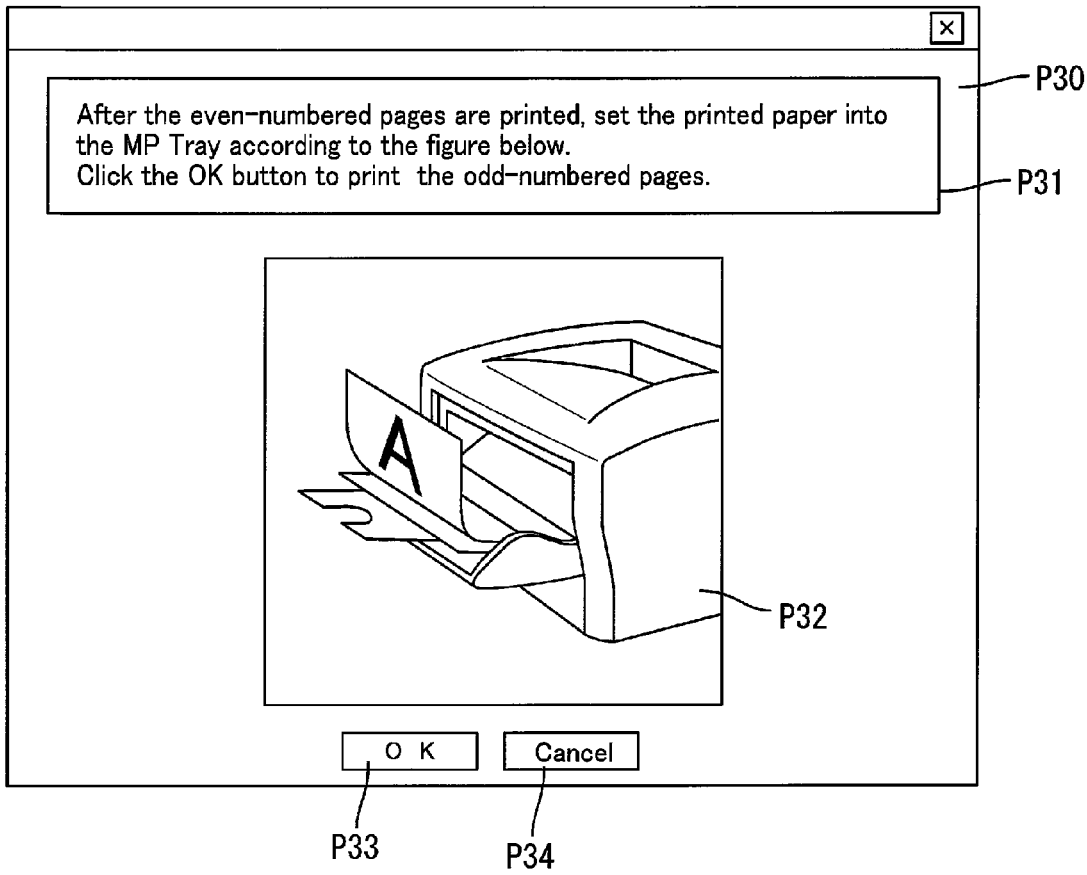
FIG. 17 shows an example of a reinsert instruction screen.
Figure 18A:
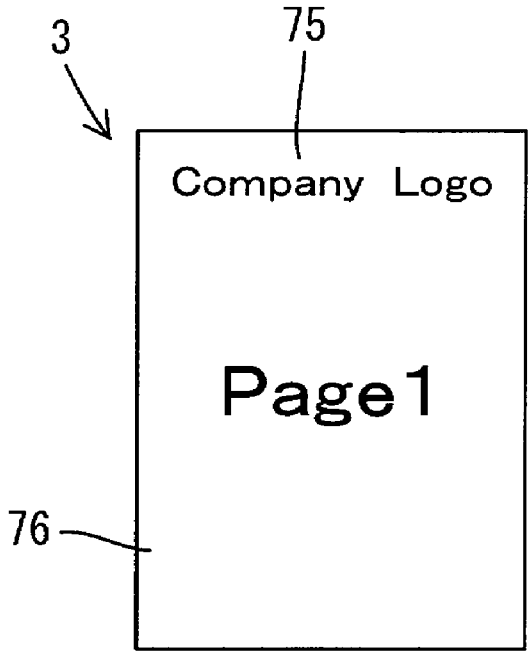
FIGS. 18A to 18D are plain views showing the two sides of two sheets on which images are formed as upright images on the obverse sides and as inverted images on the reverse sides by duplex printing.
Figure 18B:
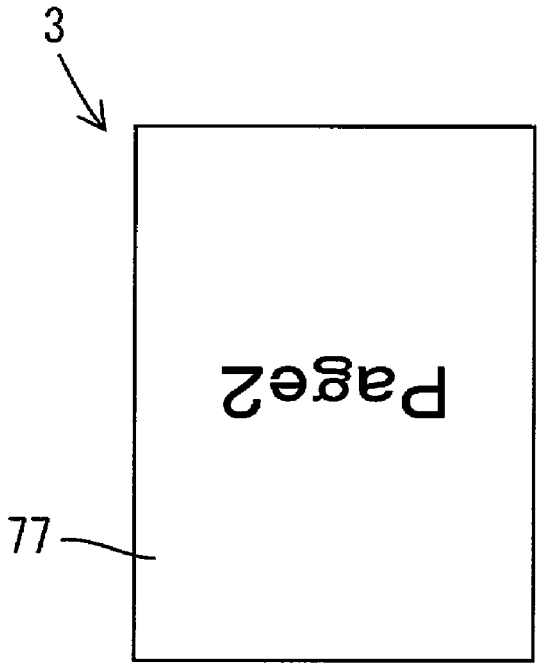
Figure 18C:
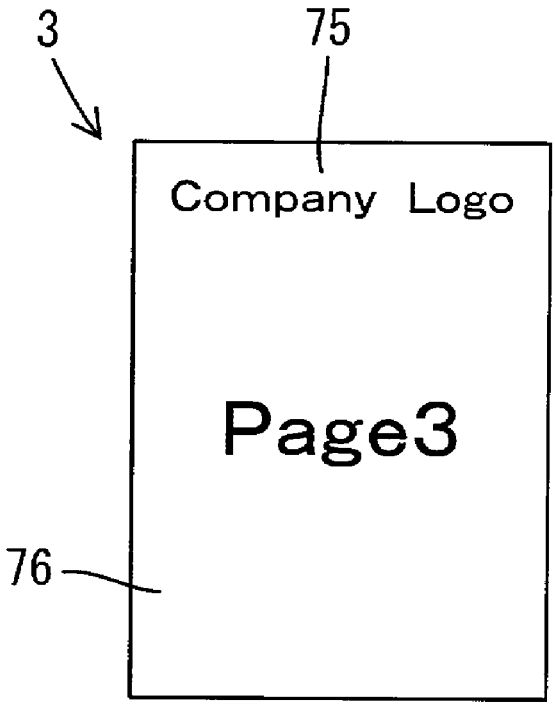
Figure 18D:
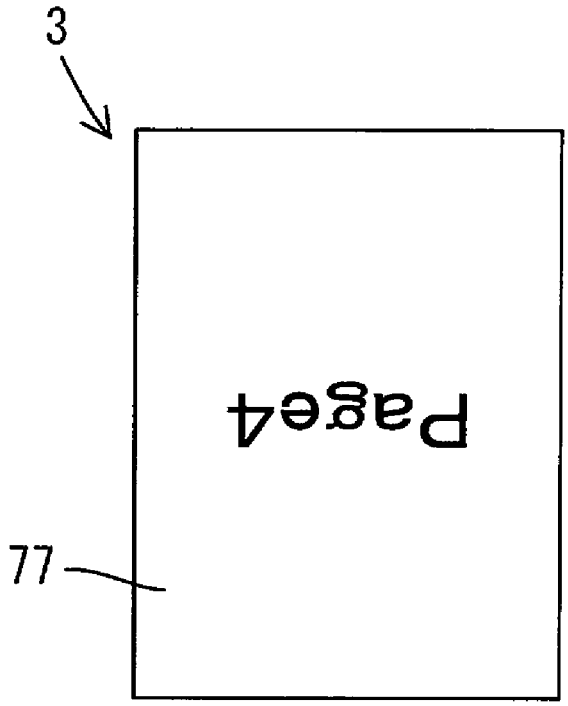

In this case, Yes is determined at step S27 or No is determined at step S29, because one of "Flip on Left Edge", "Flip on Right Edge", "Flip on Top Edge (No Reverse)" and "Flip on Bottom Edge (No Reverse)" has been selected on the advanced setting screen as determined at step S21 or S24. Then the CPU 87 executes a reinsert display process "A" (described below) at step S28 for causing the display device 84 to display a reinsert instruction screen P30 as shown in FIG. 17. The reinsert instruction screen P30 shows how to set paper 3 for the second half of duplex printing, as described in detail below.

When the first half of duplex printing is finished (i.e., the even-numbered page printing process at step S26 is finished), the user should refeed the printed paper 3, which has been ejected onto the catch tray 4, to the MP tray 7 for the second half of duplex printing.

During the second half of duplex printing, the odd-numbered pages of images should be printed as upright images on the obverse side 76 of the printed paper 3. This can be achieved by setting the printed paper 3 into the MP tray 7 as shown in FIG. 10A. That is, the user should set the printed paper 3 into the MP tray 7 with the obverse side 76 facing up and with the head of paper 3 at the back (first-in end) of the MP tray 7.

For helping the user, according to the present aspect, the CPU 87 executes the reinsert display process "A" at step S28 of FIG. 14 for causing the display device 84 to display the reinsert instruction screen P30 shown in FIG. 17. The reinsert instruction screen P30 provides, for the user, instructions on how to place the printed paper 3 in the MP tray 7.

As shown in FIG. 17, the reinsert instruction screen P30 includes a text box P31 at the top thereof, which provides instructions in words. Specifically, the instructions are provided as follows:

"After the even-numbered paged are printed, set the printed paper into MP Tray according to the figure below. Click the OK button to print the odd-numbered pages."

The reinsert instruction screen P30 further includes an MP-tray instruction P32 below the text box P31. The MP-tray instruction P32 provides pictorial instructions on how to set the printed paper 3 into the MP tray 7. Specifically, the MP-tray instruction P32 shows that the printed paper 3 should be set into the MP tray 7 with the printed side facing down and with the top of the printed image in first (i.e., with the top of the printed image at the back of the MP tray 7).

Thus the reinsert instruction screen P30 is provided, and thereby the user can readily set the printed paper 3 into the MP tray 7 for the second half of duplex printing.

The reinsert instruction screen P30 includes, at the bottom thereof, "OK" button P33 and "Cancel" button P34 placed next to each other. The "OK" button P33 is clicked to initiate the second half of duplex printing. The "Cancel" button P34 is clicked to cancel printing processing.

The user sets the printed paper 3 according to the reinsert instruction screen P30, and clicks "OK" button P33. Then, returning to FIG. 14, "OK" is determined at step S31, and the CPU 87 executes an odd-numbered page printing process at step S32.

In the present aspect, during the odd-numbered page printing process at step S32, the CPU 87 sorts the odd-numbered pages from the image file to be printed, and arranges the odd-numbered pages in ascending order (i.e., in the order such as Page 1, Page 3 and Page 5) as described above. The CPU 87 sends the resultant data to the laser printer 1, and thereby causes the laser printer 1 to print the odd-numbered pages in ascending order.

Thus the odd-numbered pages are printed on the obverse side 76 of the paper 3, and the printed paper 3 is ejected onto the catch tray 4 as shown in FIG. 10B. Then duplex printing for two-faced paper is finished, and the printing results include sheets on which the upright images are printed on both of the obverse sides 76 and the reverse sides 77.

Figure 21:
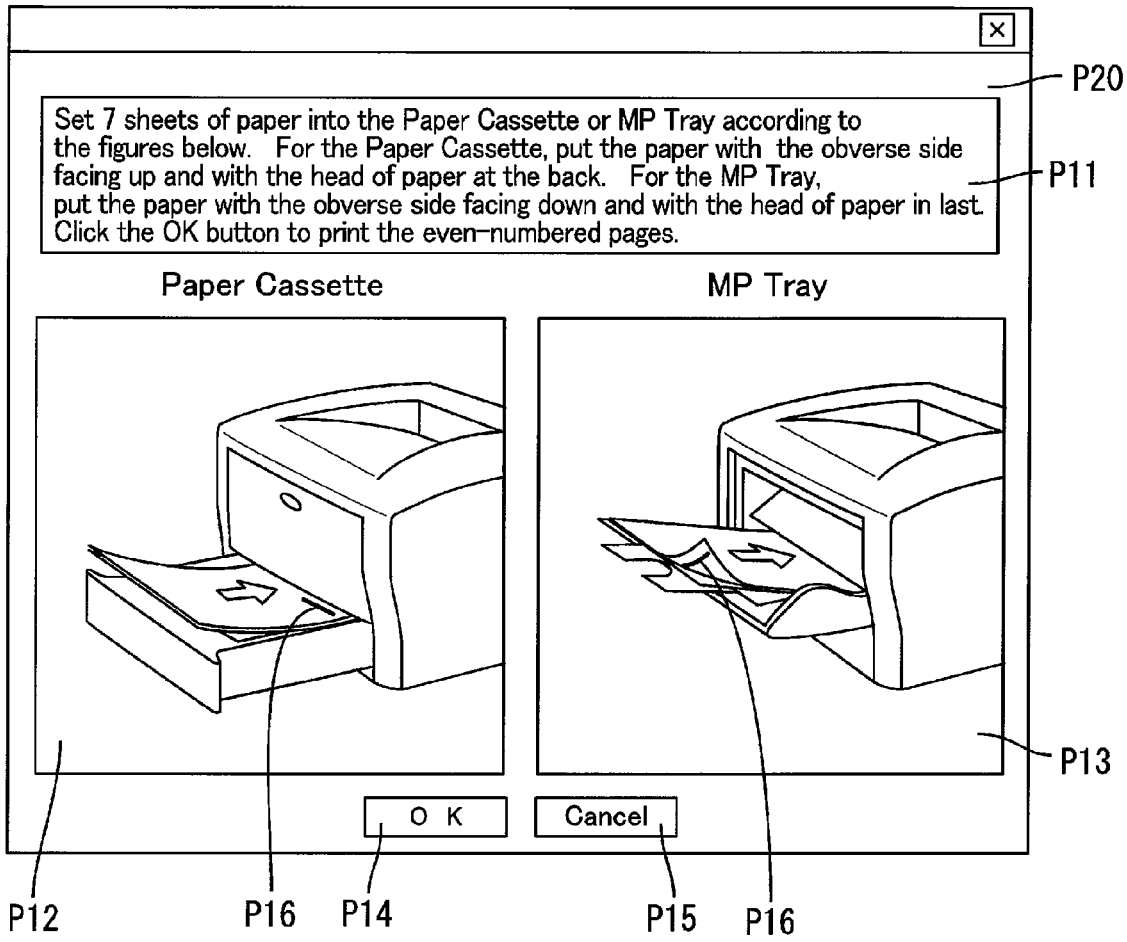
FIG. 21 shows an example of the first instruction screen.

On the other hand, referring to FIG. 14, if No is determined at step S21 and Yes is determined at step S24 (i.e., if one of "Flip on Top Edge" and "Flip on Bottom Edge" has been selected on the advanced setting screen P60 as shown in FIG. 13), the CPU 87 executes a first display process "B" (described below) at step S25 for causing the display device 84 to display a first instruction screen P20 as shown in FIG. 21. The first instruction screen P20 shows how to set paper 3 for the first half of duplex printing, as described in detail below.

When one of "Flip on Top Edge" and "Flip on Bottom Edge" has been thus selected, images should be printed as an upright image on the obverse side 76, and as an inverted image on the reverse side 77 as shown in FIGS. 18A to 18D. That is, the top of the image printed on the obverse side 76 should correspond to the head of paper 3, while the bottom of the image printed on the reverse side 77 should correspond to the head of paper 3.

Figure 19A:
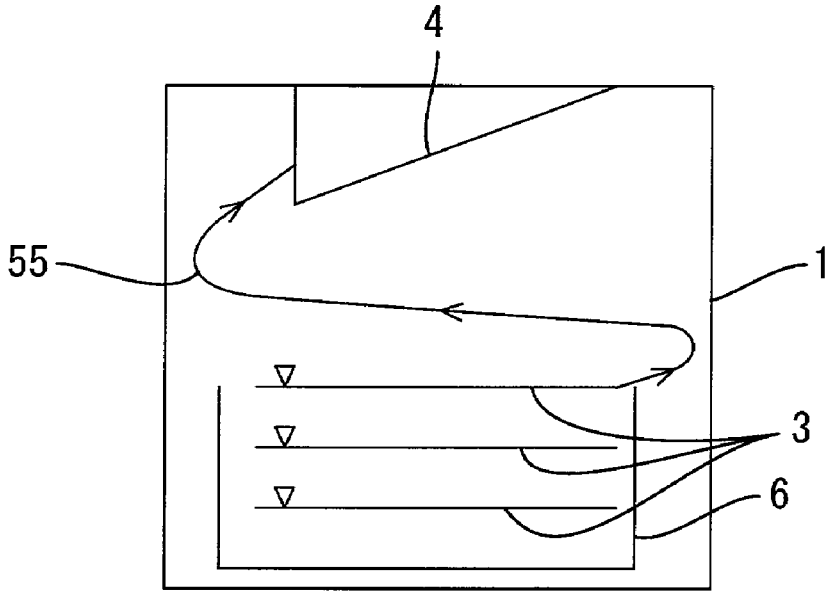
FIG. 19A is a schematic diagram showing how to set paper into the paper cassette for the first half of duplex printing.
Figure 20A:
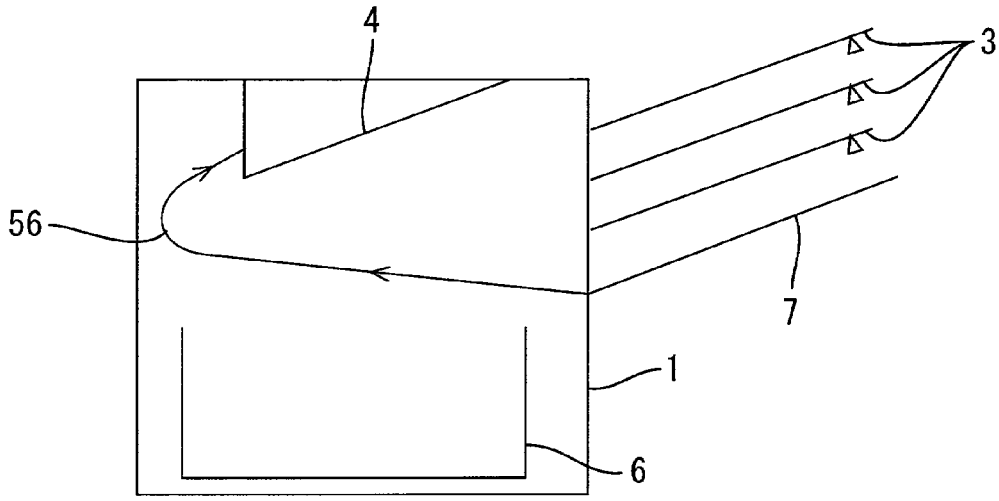
FIG. 20A is a schematic diagram showing how to set paper into the MP tray for the second half of duplex printing.

Therefore, in this case, the even-numbered pages of images should be printed as inverted images on the reverse side 77 of paper 3 during the first half of duplex printing. This can be achieved by setting paper 3 into the paper cassette 6 as shown in FIG. 19A or into the MP tray 7 as shown in FIG. 20A.

That is, the user should set paper 3 into the paper cassette 6 with the obverse side 76 facing up and with the head of paper 3 at the back (last-out end) of the paper cassette 6. Alternatively, the user should set paper 3 into the MP tray 7 with the obverse side 76 facing down and with the head of paper 3 at the front (last-in end) of the MP tray 7.

Therefore, if paper 3 previously set into the paper cassette 6 or the MP tray 7 for single-side printing is diverted to use for the present duplex printing, the user should reverse the paper 3 in the paper cassette 6 or the MP tray 7 and further turn the paper 3 on its head.

If paper 3 is newly set into the paper cassette 6 or the MP tray 7 for the present duplex printing, the user should determine proper orientation of the paper 3 based on the logo 75 printed on the obverse side 76 of the paper 3. Thus, it is bothersome for the user to set paper 3 into the paper cassette 6 or the MP tray 7 so that inverted images can be printed on the reverse side 77 of the paper 3.

In view of this, according to the present aspect, the CPU 87 executes the first display process "B" at step S25 of FIG. 14 for causing the display device 84 to display the first instruction screen P20 shown in FIG. 21. The first instruction screen P20 provides, for the user, instructions on how to place paper 3 in the paper cassette 6 or the MP tray 7.

The first instruction screen P20 is similar to the above first instruction screen P10, but differs in how to set paper 3 shown therein. Therefore the similar section is designated by the same symbol, and redundant explanations are omitted.

As shown in FIG. 21, the first instruction screen P20 includes a text box P11, a cassette instruction P12 and an MP-tray instruction P13.

The text box P11 provides instructions as follows:

"Set 7 sheets (as (a)) of paper into the Paper Cassette or MP Tray according to the figures below. For the Paper Cassette, put the paper with the obverse side facing up (b1) and with the head of paper at the back (b2). For the MP Tray, put the paper with the obverse side facing down (c1) and with the head of paper in last (c2). Click the OK button to print the even-numbered pages."

The cassette instruction P12 includes a drawing in which how to set paper 3 into the paper cassette 6 is shown. In the drawing, the paper 3 is set into the paper cassette 6 with the logo P16 facing up and at the back (i.e., with the obverse side of paper facing up and with the head of paper at the back of the paper cassette 6).

The MP-tray instruction P13 also includes a drawing in which how to set paper 3 into the MP tray 7 is shown. In the drawing, the paper 3 is set into the MP tray 7 with the logo P16 facing down and in last (i.e., with the obverse side of paper facing down and with the head of paper at the front of the MP tray 7).

Thus the first instruction screen P20 is provided, and thereby the user can readily set paper 3 into the paper cassette 6 or the MP tray 7 for the first half of duplex printing.

Figure 19B:
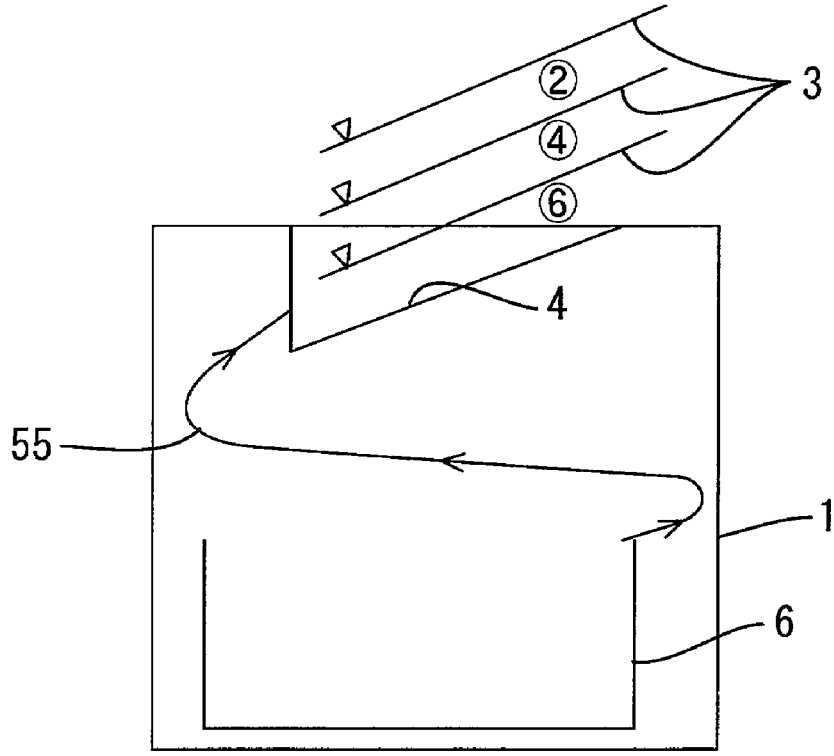
FIG. 19B is a schematic diagram showing how the printed paper is ejected onto the catch tray at the end of the first half of duplex printing.
Figure 20B:
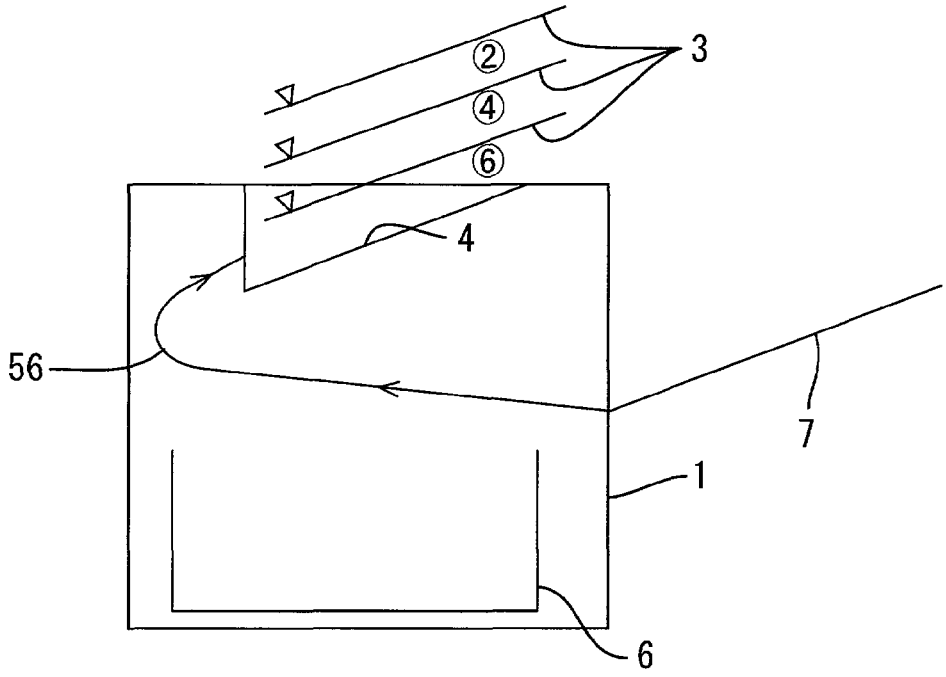
FIG. 20B is a schematic diagram showing how the printed paper is ejected onto the catch tray at the end of the second half of duplex printing.

If the user sets paper 3 according to the first instruction screen P20 and clicks "OK" button P14, returning to FIG. 14, "OK" is determined at step S23. Then the CPU 87 executes the even-numbered page printing process at step S26, and thereby the even-numbered pages are printed on the reverse side 77 of the paper 3. The printed paper 3 is ejected onto the catch tray 4 as shown in FIG. 19B or 20B, and the first half of duplex printing is finished.

Figure 22:
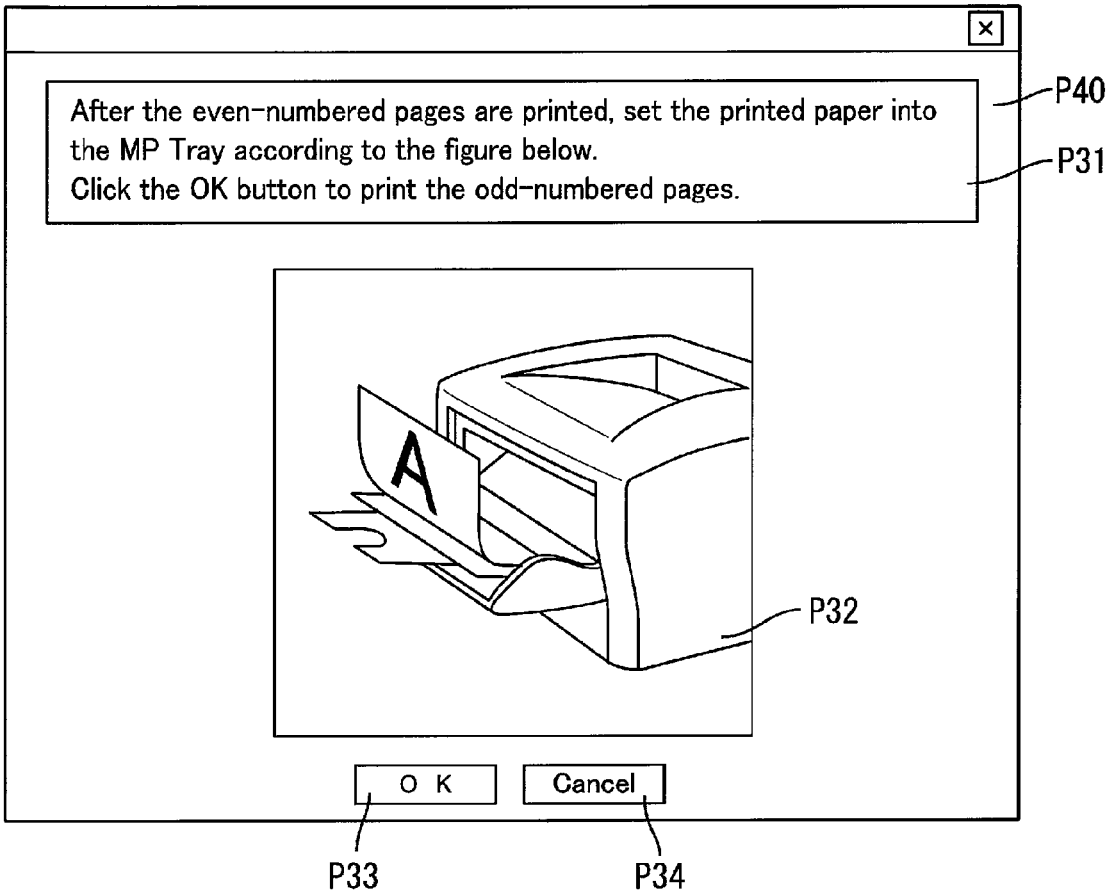
FIG. 22 shows an example of the reinsert instruction screen.

Next, No is determined at step S27 and Yes is determined at step S29, because one of "Flip on Top Edge" and "Flip on Bottom Edge" has been selected on the advanced setting screen in this case as determined at steps S21 and S24. Then the CPU 87 executes a reinsert display process "B" (described below) at step S30 for causing the display device 84 to display a reinsert instruction screen P40 as shown in FIG. 22. The reinsert instruction screen P40 shows how to set the printed paper 3 for the second half of duplex printing, as described in detail below.

When the first half of duplex printing is finished (i.e., the even-numbered page printing process at step S26 is finished), the user should refeed the printed paper, which has been ejected onto the catch tray 4, to the MP tray 7 for the second half of duplex printing.

During the second half of duplex printing, the odd-numbered pages of images should be printed as upright images on the obverse side 76 of the printed paper 3. This can be achieved by setting the printed paper 3 into the MP tray 7 as shown in FIG. 10A. That is, the user should set the printed paper 3 into the MP tray 7 with the obverse side 76 facing up and with the head of paper 3 at the back (first-in end) of the MP tray 7.

In this case, the user likely determines proper orientation of the paper 3 based on the images printed on the reverse side 77 of the paper 3. However, the printed images are inverted images, and therefore the user may be confused about how to set the printed paper 3 into the MP tray 7.

In view of this, according to the present aspect, the CPU 87 executes the reinsert display process "B" at step S30 of FIG. 14 for causing the display device 84 to display the reinsert instruction screen P40 shown in FIG. 22. The reinsert instruction screen P40 provides, for the user, instructions on how to place the printed paper 3 in the MP tray 7.

The reinsert instruction screen P40 is similar to the above reinsert instruction screen P30, but differs in how to set the printed paper 3 shown therein. Therefore, similar reference numerals are used, and redundant explanations are omitted.

As shown in FIG. 22, the reinsert instruction screen P40 includes a text box P31 and an MP-tray instruction P32. The text box P31 includes the same text information as that of the reinsert instruction screen P30.

The MP-tray instruction P32 provides pictorial instructions on how to set the printed paper 3 into the MP tray 7. Specifically, the MP-tray instruction P32 shows that the printed paper 3 should be set into the MP tray 7 with the printed side facing down and with the top of the printed image in last (i.e., with the top of the printed image at the front of the MP tray 7).

Thus the reinsert instruction screen P40 is provided, and thereby the user can readily set the printed paper 3 into the MP tray 7 for the second half of duplex printing.

If the user sets the printed paper 3 according to the reinsert instruction screen P40 and clicks "OK" button P33, returning to FIG. 14, "OK" is determined at step S31. Then the CPU 87 executes the odd-numbered page printing process at step S32, and thereby the odd-numbered pages are printed on the obverse side 76 of the printed paper 3.

The printed paper 3 is ejected onto the catch tray 4 as shown in FIG. 10B. Then duplex printing for two-faced paper is finished, and the printing results include sheets on which the upright images are printed on the obverse sides 76 and the inverted images are printed on the reverse sides 77.

If the user clicks "Cancel" button P15 or P34 on the first instruction screen P10 or P20, or on the reinsert instruction screen P30 or P40, the duplex printing is canceled. Thereby the duplex printing process immediately terminates.

When the duplex printing process for two-faced paper (i.e., step S13 in FIG. 11) is finished, the printing process shown in FIG. 11 terminates.

In the duplex printing process shown in FIG. 14, steps S20-S25 and S27-S31 are executed based on the display control program of the present aspect.

The code of the display control program corresponding to the first display process "A" at step S22 is an example of "first display code", and the CPU 87 executing the first display process "A" is an example of "a first means". The code of the display control program corresponding to the first display process "B" at step S25 is also an example of "first display code", and the CPU 87 executing the first display process "B" is an example of "a first means".

(Duplex Printing for Plain Paper)

Figure 23:
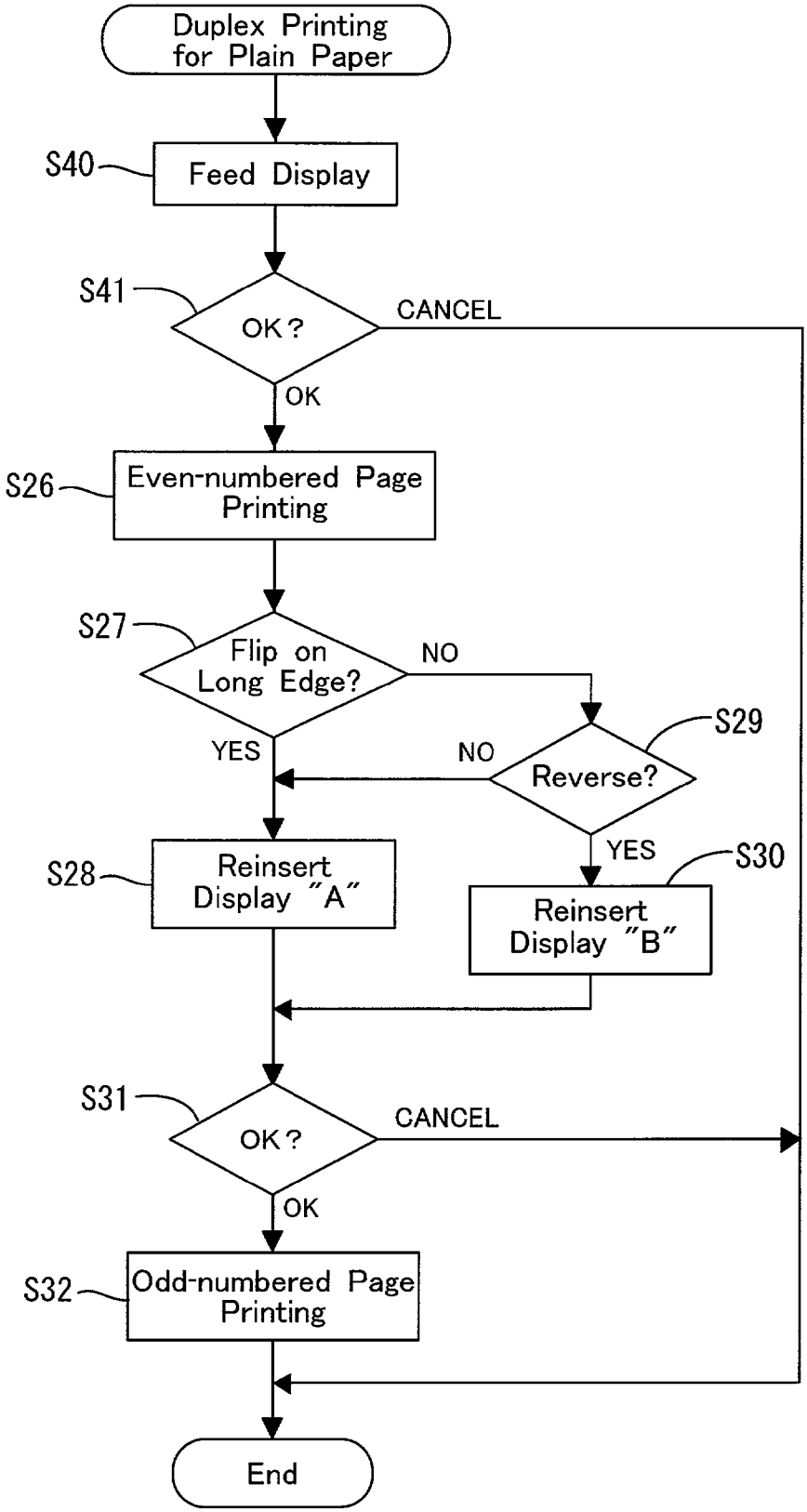
FIG. 23 is a flowchart of a duplex printing process for printing on plain paper.

FIG. 23 shows details of the duplex printing process for plain paper executed at step S14 of the printing process shown in FIG. 11. The steps, in which processing similar to that of the duplex printing process shown in FIG. 14 is performed, are designated by the same symbol, and redundant explanations are omitted.

Figure 24:
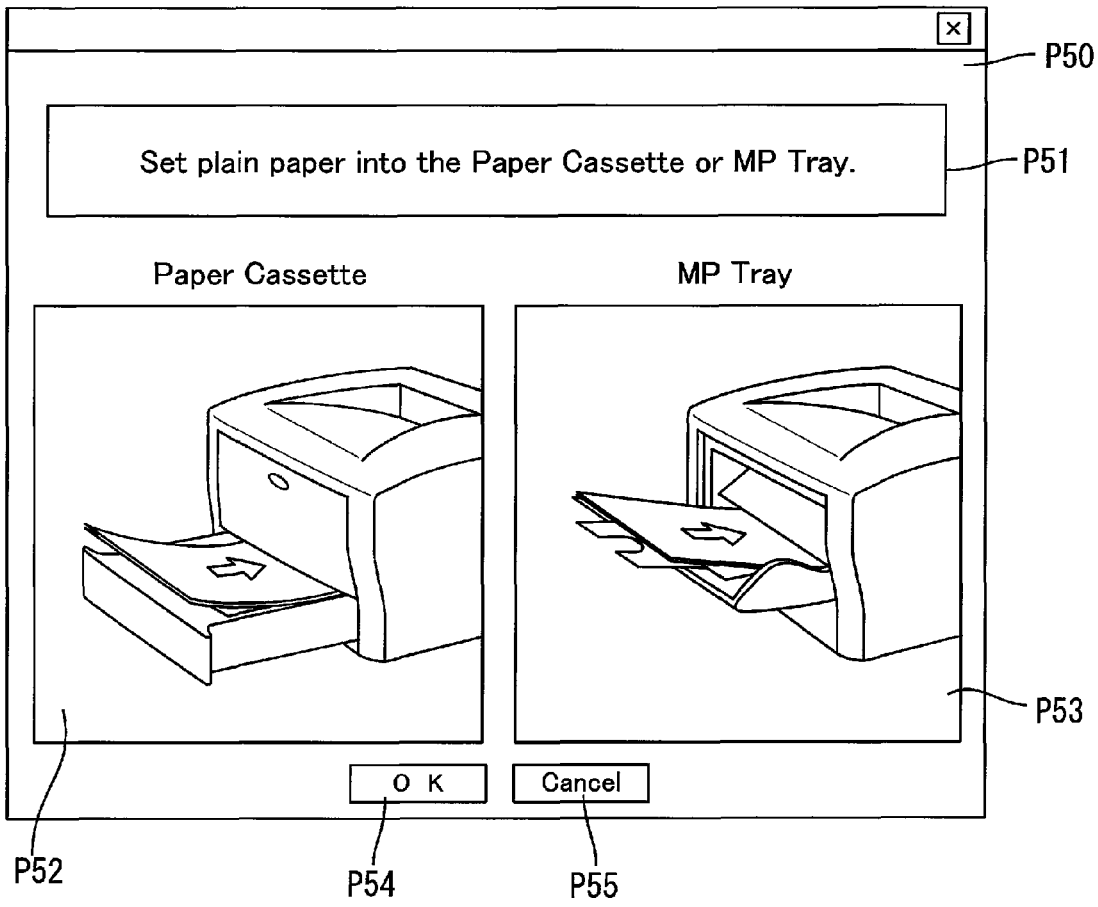
FIG. 24 shows an example of a feed instruction screen.

First, the CPU 87 executes a feed display process at step S40 for causing the display device 84 to display a feed instruction screen P50 as shown in FIG. 24.

The feed instruction screen P50 instructs the user to set paper 3 into the paper cassette 6 or the MP tray 7 for the first half of duplex printing. As shown in FIG. 24, the feed instruction screen P50 includes a text box P51 at the top thereof, which provides instructions in words. Specifically, the instructions are provided as follows: "Set plain paper into the Paper Cassette or MP Tray."

The feed instruction screen P50 further includes a cassette instruction P52 and an MP-tray instruction P53 below the text box P51. In FIG. 24, the cassette instruction P52 is displayed on the left-hand side, and the MP-tray instruction P53 is displayed on the right-hand side. The cassette instruction P52 provides pictorial instructions on how to set paper 3 into the paper cassette 6. The MP-tray instruction P53 provides pictorial instructions on how to set paper 3 into the MP tray 7.

The cassette instruction P52 includes a schematic perspective view of the appearance of the laser printer 1, in which the paper cassette 6 is pulled out and open. In the drawing, how to set paper 3 into the paper cassette 6 is shown.

The MP-tray instruction P53 also includes a schematic perspective view of the laser printer 1, in which the MP tray 7 is open. In the drawing, how to set paper 3 into the MP tray 7 is shown.

In the duplex printing process for plain paper, the user does not have to think about paper orientation when he/she sets paper 3 for the first half of duplex printing, because he/she is requesting duplex printing using plain paper (i.e., paper of which two sides are essentially the same or are not distinguishable) as determined at step S12 of the printing process shown in FIG. 11. Therefore, paper 3 previously set into the paper cassette 6 or the MP tray 7 for single-side printing can be directly diverted to use for the present duplex printing.

Therefore the simpler instructions are thus provided as the feed instruction screen P50, in which details of paper orientation is not specified.

If the user sets paper 3 according to the feed instruction screen P50 and clicks "OK" button P54, returning to FIG. 23, "OK" is determined at step S41. Then the CPU 87 executes an even-numbered page printing process at step S26 in a similar manner to step S26 of FIG. 14.

Thereby the even-numbered pages are printed on one side of the paper 3, and the printed paper 3 is ejected onto the catch tray 4. Then the first half of duplex printing is finished.

When step S26 is finished (i.e., the first half of duplex printing is finished), it is determined at step S27 whether one of "Flip on Left Edge" and "Flip on Right Edge" has been selected on the advanced setting screen. If No is determined at step S27, it is determined at step S29 whether one of "Flip on Top Edge" and "Flip on Bottom Edge" has been selected on the advanced setting screen.

If Yes is determined at step S27 or No is determined at step S29, the CPU 87 executes a reinsert display process "A" at step S28 for causing the display device 84 to display the reinsert instruction screen P30 as shown in FIG. 17.

If the user sets the printed paper 3 for the second half of duplex printing according to the reinsert instruction screen P30 and clicks "OK" button P33, returning to FIG. 23, "OK" is determined at step S31. Then the CPU 87 executes an odd-numbered page printing process at step S32 in a similar manner to step S32 of FIG. 14.

Thereby the odd-numbered pages are printed on the other side of the paper 3, and the printed paper 3 is ejected onto the catch tray 4. Then duplex printing for plain paper is finished, and the printing results include sheets on which images are printed on the both sides so that the top of the printed image on one side corresponds to the top of the printed image on the other side.

On the other hand, if No is determined at step S27 and Yes is determined at step S29, the CPU 87 executes a reinsert display process "B" at step S30 for causing the display device 84 to display the reinsert instruction screen P40 as shown in FIG. 22.

If the user sets the printed paper 3 for the second half of duplex printing according to the reinsert instruction screen P40 and clicks "OK" button P33, returning to FIG. 23, "OK" is determined at step S31. Then the CPU 87 executes the odd-numbered page printing process at step S32.

Thereby the odd-numbered pages are printed on the other side of the paper 3, and the printed paper 3 is ejected onto the catch tray 4. Then duplex printing for plain paper is finished, and the printing results include sheets on which images are printed on the both sides so that the top of the printed image on one side corresponds to the bottom of the printed image on the other side.

If the user clicks "Cancel" button P55 or P34 on the feed instruction screen P50 or on the reinsert instruction screen P30 or P40, the duplex printing is canceled. Thereby the duplex printing process immediately terminates.

When the duplex printing for plain paper (i.e., step S14 in FIG. 11) is finished, the printing process shown in FIG. 11 terminates.

In the duplex printing process shown in FIG. 23, steps S40, S41 and S27-S31 are executed based on the display control program of the present aspect.

5. Effects of the Present Aspect

According to the present aspect, the user can know, by the first instruction screen P10 or P20, whether the obverse side 76 of paper 3 should face up or down in the paper cassette 6 or the MP tray 7, when he/she sets two-faced paper 3 for the first half of duplex printing. Therefore the user does not need to decide by himself/herself whether the obverse side 76 of paper 3 should face up or down, and can readily set two-faced paper 3 into the paper cassette 6 or the MP tray 7.

Further, in the case that duplex printing is performed using headed paper 3 such as paper with a company logo 75, the user should determine paper orientation, i.e., which side the logo 75 (head) of the paper 3 should be on in the paper cassette 6 or the MP tray 7, in order to obtain the desired printing results.

According to the present aspect, the proper orientation of paper 3 is displayed in the first instruction screen P10 or P20. Thereby the user can readily set the paper 3 into the paper cassette 6 or the MP tray 7 for the first half of duplex printing, and thus the user's burden can be reduced.

In the case that printing of even-numbered pages is performed during the first half of duplex printing as in the present aspect, paper 3 should be set for the first half of duplex printing so that printing on the reverse side 77 can be performed. Therefore, the user should reverse paper 3 in the paper cassette 6 or the MP tray 7, if the paper 3 previously set into the paper cassette 6 or the MP tray 7 for single-side printing is diverted to use for duplex printing.

In this case, if the user reverses more-than-necessary or less-than-necessary sheets of paper 3 for the first half of duplex printing, an even-numbered page of image may be printed on the obverse side 76 of paper 3 during the duplex printing or an image maybe printed on the reverse side 77 of paper 3 during later single-side printing, contrary to the user's expectation.

Therefore, the user should accurately determine the number of sheets to be used for duplex printing, when he/she sets paper for the first half of duplex printing. This is bothersome to the user.

According to the present aspect, the number of sheets to be used for duplex printing is preliminarily calculated and displayed in the text box P11 of the first instruction screen P10 or P20. Therefore, the user does not need to determine the number of sheets by himself/herself, and can set paper 3 for the first half of duplex printing readily according to the instruction.

Further, the laser printer 1 of the present aspect includes two paper rests, that is, the paper cassette 6 and the MP tray 7. Paper 3 should be set into the MP tray 7 so that the obverse side 76 and head thereof face the opposite directions from those of paper 3 set into the paper cassette 6 as shown in FIGS. 9A and 15A, in order to achieve the same printing results. This may confuse the user about how to set the paper 3.

According to the present aspect, the first instruction screen P10 or P20 includes instructions on how to set paper 3 into the paper cassette 6 and the MP tray 7. Therefore, the user can set paper 3 readily in both cases without being confused.

In the case that printing for plain paper of which two sides are not distinguishable is performed, paper 3 previously set into the paper cassette 6 or the MP tray 7 for single-side printing, if any, can be directly diverted to use for duplex printing.

In this case, excessively complicated instructions may confuse the user. Therefore, according to the present aspect, simpler instructions shown in FIG. 24 are provided on the feed instruction screen P50, in which details of paper orientation is not specified. Thereby, the user can be prevented from considering how to set paper 3 in vain.

<Another Illustrative Aspect>

Next, another illustrative aspect different from the aspect shown in FIGS. 1 to 24 will be explained with reference to FIGS. 25 through 28. The present aspect has difference from the above aspect in a duplex printing process for two-faced paper executed at step S13 of FIG. 11. The other portions are similar to the aspect shown in FIGS. 1 to 24. Therefore the same components and steps are designated by the same symbols as the above aspect, and redundant explanations are omitted.

Figure 25:
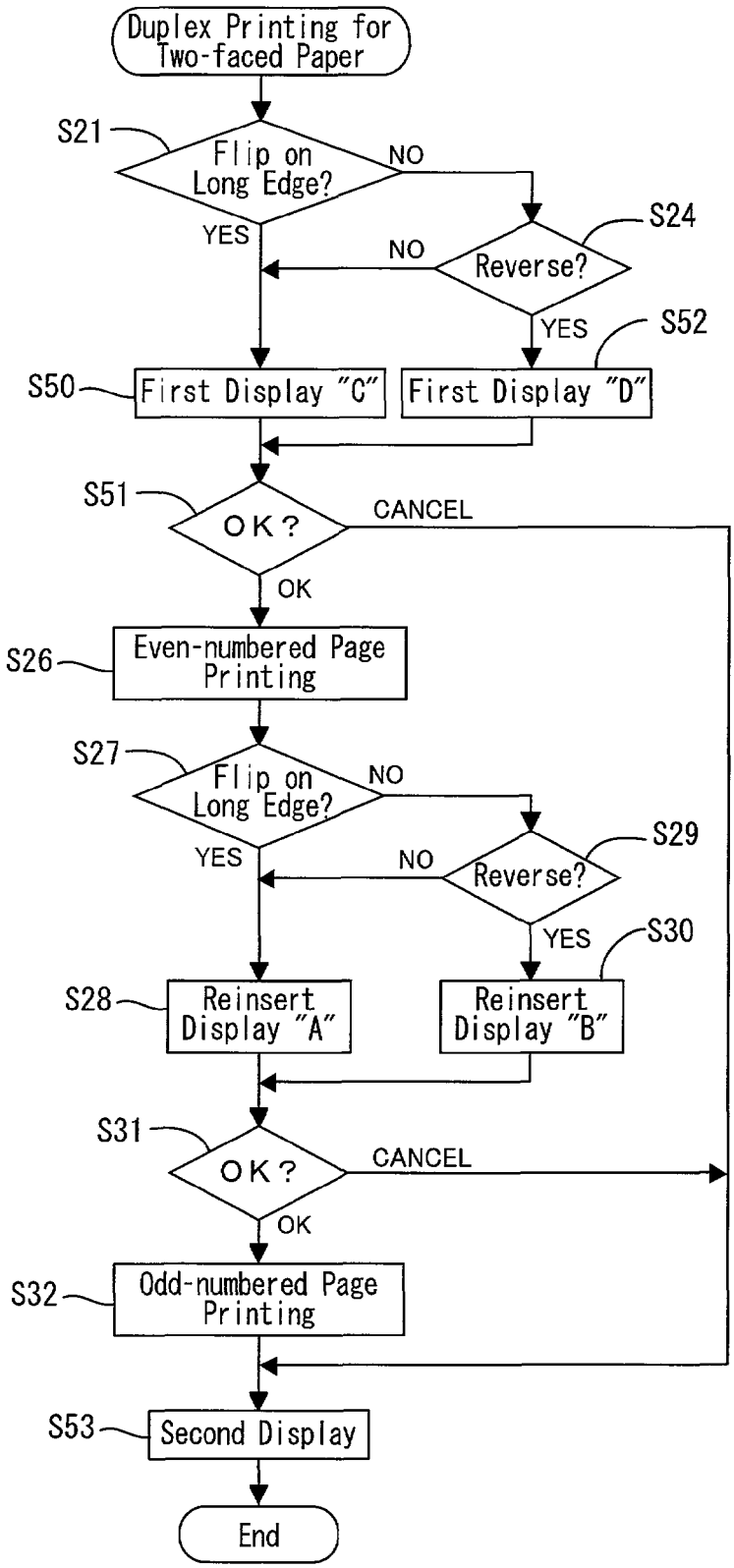
FIG. 25 is a flowchart of a duplex printing process for printing on two-faced paper according to an illustrative aspect other than the aspect shown in FIGS. 1 to 24.

FIG. 25 shows details of the duplex printing process for two-faced paper, which is executed at step S13 according to the present aspect. The CPU 87 determines at step S21 whether one of "Flip on Left Edge" and "Flip on Right Edge" has been selected on the advanced setting screen. If No is determined at step S21, it is determined at step S24 whether one of "Flip on Top Edge" and "Flip on Bottom Edge" has been selected on the advanced setting screen.

Figure 26:
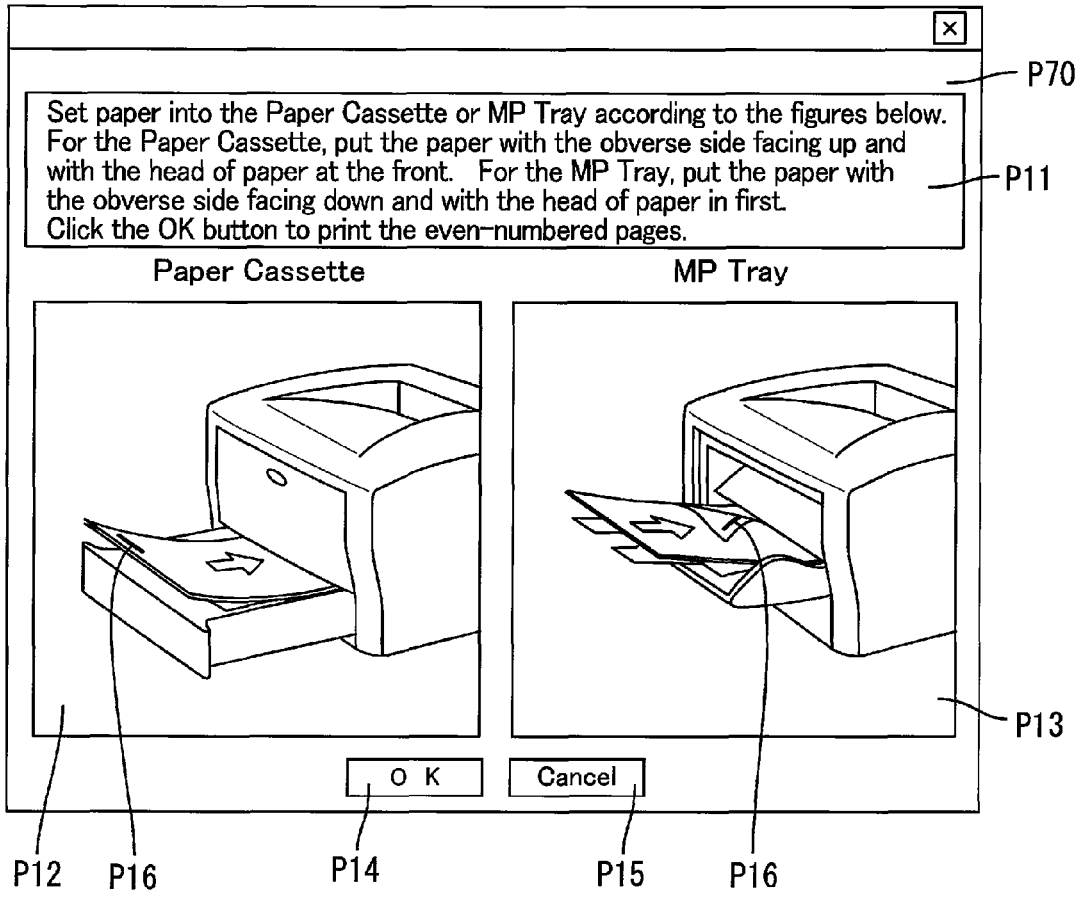
FIG. 26 shows an example of a first instruction screen.

If Yes is determined at step S21 or No is determined at step S24 (i.e., if any of "Flip on Left Edge", "Flip on Right Edge", "Flip on Top Edge (No Reverse)" and "Flip on Bottom Edge (No Reverse)" has been selected as shown in FIG. 12), the CPU 87 executes a first display process "C" at step S50 for causing the display device 84 to display a first instruction screen P70 as shown in FIG. 26. The first instruction screen P70 provides, for the user, instructions on how to place paper 3 in the paper cassette 6 or the MP tray 7 for the first half of duplex printing.

As shown in FIG. 26, the first instruction screen P70 includes a text box P11 at the top thereof, which provides instructions in words. The text box P11 provides instructions on:

(b) How to set paper 3 into the paper cassette 6, or specifically:

(b1) Which direction the obverse side of paper should face in the paper cassette 6; and (b2) Orientation of paper in the paper cassette 6 (i.e., which side the head of paper in the paper cassette 6 should be on); and (c) How to set paper 3 into the MP tray 7, or specifically:

(c1) Which direction the obverse side of paper should face in the MP tray 7; and (c2) Orientation of paper in the MP tray 7 (i.e., which side the head of paper in the MP tray 7 should be on).

Specifically, the instructions are provided as follows: "Set paper into the Paper Cassette or MP Tray according to the figures below. For the Paper Cassette, put the paper with the obverse side facing up (b1) and with the head of paper at the front (b2). For the MP Tray, put the paper with the obverse side facing down (c1) and with the head of paper in first (c2). Click the OK button to print the even-numbered pages."

The first instruction screen P70 further includes a cassette instruction P12 and an MP-tray instruction P13 below the text box P11. The cassette instruction P12 provides pictorial instructions on how to set paper 3 into the paper cassette 6. The MP-tray instruction P13 provides pictorial instructions on how to set paper 3 into the MP tray 7.

Thus the first instruction screen P70 is provided, and the user can obtain the textual information from the text box P11 and the image information from the cassette instruction P12 and the MP-tray instruction P13 on how to set paper 3. Thereby, the user can readily set paper 3 into the paper cassette 6 or the MP tray 7 for the first half of duplex printing.

The first instruction screen P70 includes, at the bottom thereof, "OK" button P14 and "Cancel" button P15 placed next to each other. If the user sets paper 3 according to the first instruction screen P70 and clicks "OK" button P14, returning to FIG. 25, "OK" is determined at step S51. Then the CPU 87 executes an even-numbered page printing process at step S26 in a similar manner to the above aspect. The printed paper 3 is ejected onto the catch tray 4, and the first half of duplex printing is finished.

Thereafter steps S27 to S32 are executed in a similar manner to the above aspect. When an odd-numbered page printing process at step S32 is finished (i.e., the second half of duplex printing is finished), the printed paper 3 is ejected onto the catch tray 4.

Figure 27:
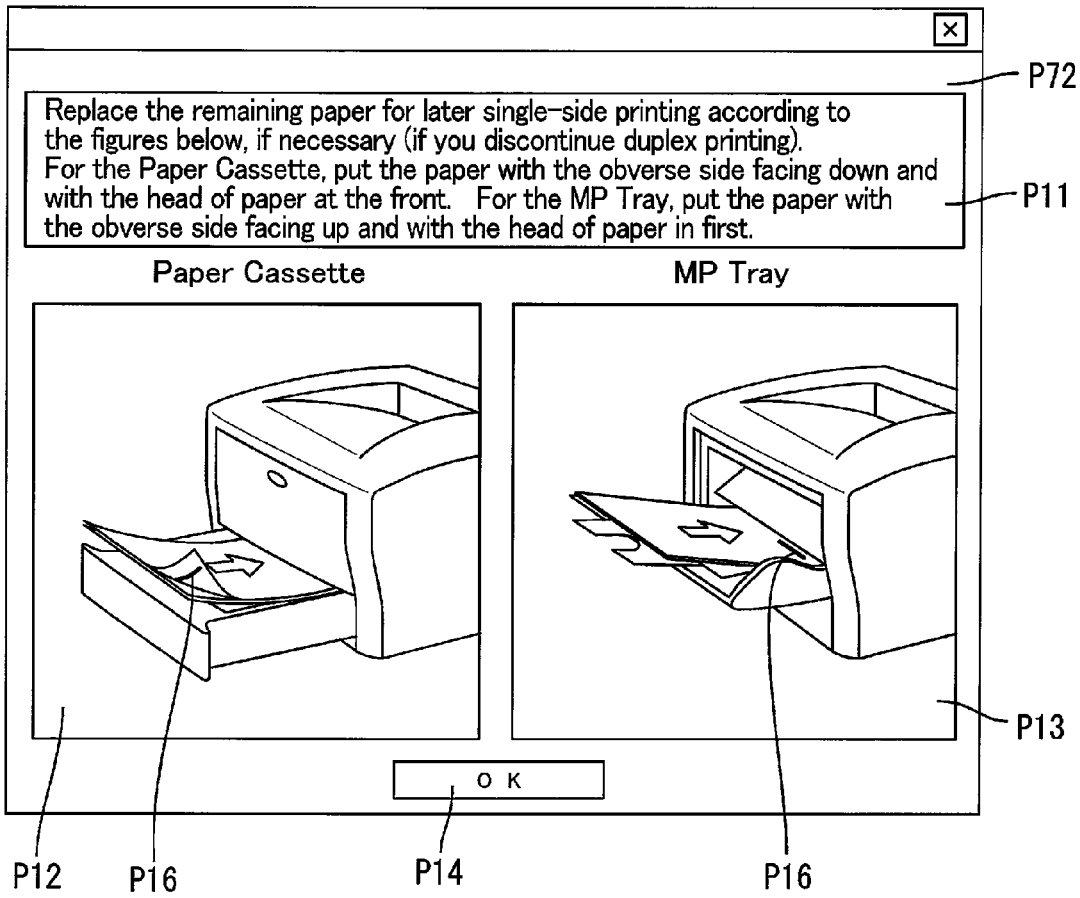
FIG. 27 shows an example of a second instruction screen.

At the end of the duplex printing for two-faced paper, the CPU 87 executes a second display process at step S53 for causing the display device 84 to display a second instruction screen P72 as shown in FIG. 27. The second instruction screen P72 directs the user to reverse the remaining paper in the paper cassette 6 or the MP tray 7 for later single-side printing if necessary.

Note that the user should reverse paper 3 in the paper cassette 6 or the MP tray 7 at the beginning of duplex printing, if paper 3 previously set into the paper cassette 6 or the MP tray 7 for single-side printing is diverted to use for the present duplex printing.

In the case that the user has reversed paper in the paper cassette 6 or the MP tray 7 for the first half of duplex printing according to the first instruction screen P70, the reversed paper may remain in the paper cassette 6 or the MP tray 7. In this case, if single-side printing is performed later, an image may be printed on the reverse side of paper during the single-side printing, contrary to the user's expectation.

In view of this, according to the present aspect, the second instruction screen P72 is provided for the user. As shown in FIG. 27, the second instruction screen P72 includes a text box P11 at the top thereof, which provides instructions in words. The text box P11 provides recommendations or instructions on:

(b) How to set paper 3 into the paper cassette 6, or specifically:

(b1) Which direction the obverse side of paper should face in the paper cassette 6; and (b2) Orientation of paper in the paper cassette 6 (i.e., which side the head of paper in the paper cassette 6 should be on);

(c) How to set paper 3 into the MP tray 7, or specifically:

(c1) Which direction the obverse side of paper should face in the MP tray 7; and (c2) Orientation of paper in the MP tray 6 (i.e., which side the head of paper in the MP tray 7 should be on); and (d) Replacement of paper 3 for later single-side printing.

Specifically, the recommendations or instructions are provided as follows:

"Replace the remaining paper (d) for later single-side printing according to the figures below, if necessary (if you discontinue duplex printing). For the Paper Cassette, put the paper with the obverse side facing down (b1) and with the head of paper at the front (b2). For the MP Tray, put the paper with the obverse side facing up (c1) and with the head of paper in first (c2)."

The second instruction screen P72 further includes a cassette instruction P12 and an MP-tray instruction P13 below the text box P11. The cassette instruction P12 provides pictorial instructions on how to set paper 3 into the paper cassette 6. The MP-tray instruction P13 provides pictorial instructions on how to set paper 3 into the MP tray 7.

Thus the second instruction screen P72 is provided, and the user can obtain the textual information from the text box P11 and the image information from the cassette instruction P12 and the MP-tray instruction P13 on how to set paper 3.

Thereby, if necessary, the user can readily replace the remaining paper in the paper cassette 6 or the MP tray 7 for later single-side printing. Further, images can be prevented from being printed on the reverse side of the remaining paper during later single-side printing.

If the user clicks "OK" button P14 provided at the bottom of the second instruction screen P72, returning to FIG. 25, the second display process at step S53 is finished. Then the duplex printing process for two-faced paper terminates.

Figure 28:
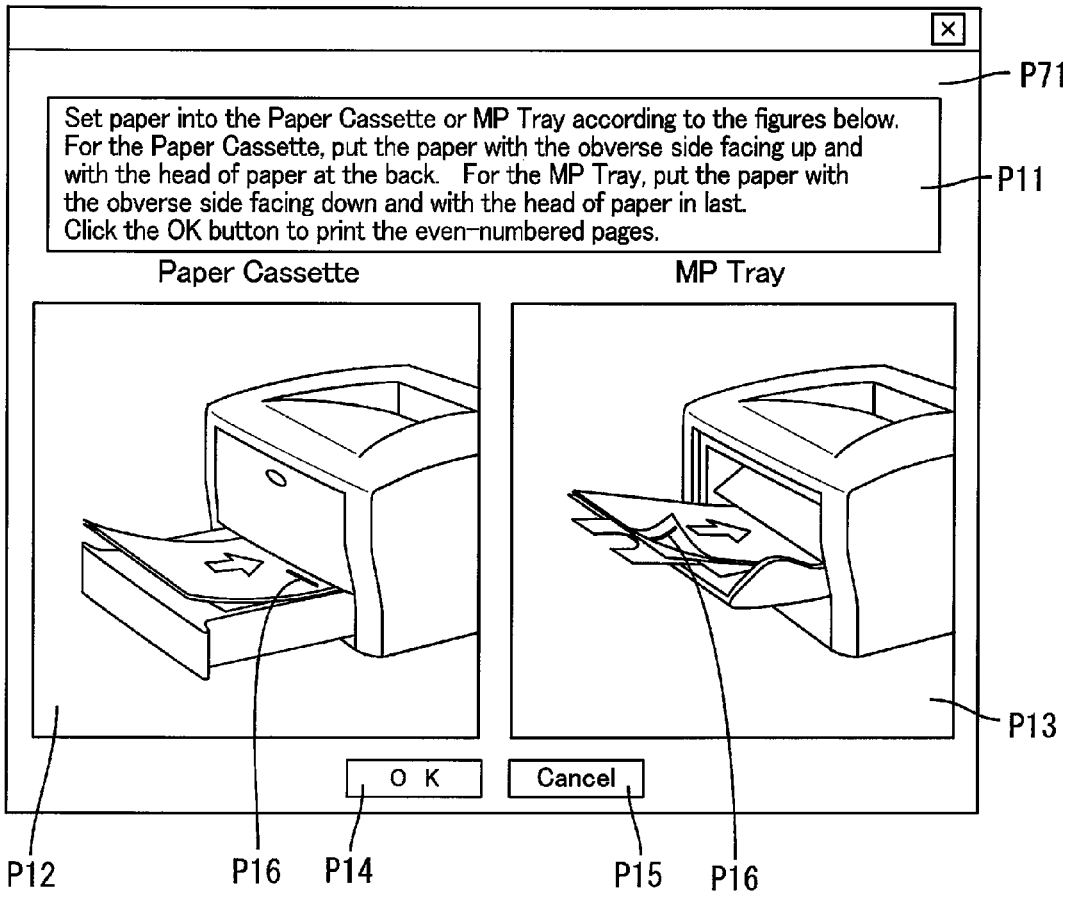
FIG. 28 shows an example of the first instruction screen.

On the other hand, if No is determined at step S21 and Yes is determined at step S24 (i.e., if one of "Flip on Top Edge" and "Flip on Bottom Edge" has been selected on the advanced setting screen P60 as shown in FIG. 13), the CPU 87 executes a first display process "D" at step S52 for causing the display device 84 to display a first instruction screen P71 as shown in FIG. 28. The first instruction screen P71 provides, for the user, instructions on how to place paper 3 into the paper cassette 6 or the MP tray 7 for the first half of duplex printing.

As shown in FIG. 28, the first instruction screen P71 includes a text box P11 at the top thereof, which provides instructions in words. The text box P11 provides instructions on:

(b) How to set paper 3 into the paper cassette 6, or specifically:

(b1) Which direction the obverse side of paper should face in the paper cassette 6; and (b2) Orientation of paper in the paper cassette 6 (i.e., which side the head of paper in the paper cassette 6 should be on); and (c) How to set paper 3 into the MP tray 7, or specifically:

(c1) Which direction the obverse side of paper should face in the MP tray 7; and (c2) Orientation of paper in the MP tray 7 (i.e., which side the head of paper in the MP tray 7 should be on).

Specifically, instructions are provided as follows:

"Set paper into the Paper Cassette or MP Tray according to the figures below. For the Paper Cassette, put the paper with the obverse side facing up (b1) and with the head of paper at the back (b2). For the MP Tray, put the paper with the obverse side facing down (c1) and with the head of paper in last (c2). Click the OK button to print the even-numbered pages".

The first instruction screen P71 further includes a cassette instruction P12 and an MP-tray instruction P13 below the text box P11. The cassette instruction P12 provides pictorial instructions on how to set paper 3 into the paper cassette 6. The MP-tray instruction P13 provides pictorial instructions on how to set paper 3 into the MP tray 7.

Thus the first instruction screen P71 is provided, and the user can obtain the textual information from the text box P11 and the image information from the cassette instruction P12 and the MP-tray instruction P13 on how to set paper 3. Thereby, the user can readily set paper 3 into the paper cassette 6 or the MP tray 7 for the first half of duplex printing.

If the user sets paper 3 according to the first instruction screen P71 and clicks "OK" button P14, returning to FIG. 25, "OK" is determined at step S51. Then the CPU 87 executes the even-numbered page printing process at step S26. The printed paper 3 is ejected onto the catch tray 4, and the first half of duplex printing is finished.

Thereafter the CPU 87 executes steps S27 to S32 and step S53 in a similar manner to the above. Then the duplex printing process for two-faced paper terminates.

If the user clicks "Cancel" button P15 or P34 on the first instruction screen P70 or P71, or on the reinsert instruction screen P30 or P40, the duplex printing is canceled. Then the duplex printing process skips to step S53, and thereby the second instruction screen P72 is displayed for the user. If the user clicks "OK" button on the second instruction screen P72, the duplex printing process terminates. Then the printing process shown in FIG. 11 terminates.

In the duplex printing process shown in FIG. 25, steps S21, S24, S50-S52, S27-S31 and S53 are executed based on the display control program of the present aspect.

The code of the display control program corresponding to the first display process "C" at step S50 is an example of "first display code", and the CPU 87 executing the first display process "C" is an example of "a first means". The code of the display control program corresponding to the first display process "D" at step S52 is also an example of "first display code", and the CPU 87 executing the first display process "D" is an example of "a first means". The code of the display control program corresponding to the second display process at step S53 is an example of "second display code", and the CPU 87 executing the second display process is an example of "a second means".

In the above aspect shown in FIGS. 1 to 24, the first instruction screen P10 or P20 provides information about the number of sheets to be used for duplex printing, and therefore the user should accurately count the sheets when he/she sets paper 3 for the first half of duplex printing. This is bothersome to the user especially when printing of a bulky file is performed.

In the present aspect, the first instruction screen P70 or P71 does not provide information about the number of sheets to be used for duplex printing, and the user can set paper 3 without counting. Therefore the present aspect is effective for printing of a bulky file.

In the present aspect, the first instruction screen P70 or P71 provides information about paper orientation and whether the obverse side of paper should face up or down, similarly to the above aspect. Thereby the user can readily set paper 3 for the first half of duplex printing.

Further, in the present aspect, the second instruction screen P72 directs the user to replace the remaining paper for later single-side printing at the end of duplex printing. Thereby images can be prevented from being printed, contrary to the user's expectation, on the reverse side of the remaining paper during later single-side printing.

<Another Illustrative Aspect>

Another illustrative aspect different from the aspects shown in FIGS. 1 to 24 or FIGS. 25 to 28 will be explained with reference to FIGS. 29 through 36. In the above aspects, printing of even-numbered pages is performed during the first half of duplex printing, and printing of odd-numbered pages is performed during the second half of duplex printing. In contrast, according to the present aspect, printing of odd-numbered pages is performed during the first half of duplex printing, and printing of even-numbered pages is performed during the second half of duplex printing.

Further, the present aspect has difference from the above aspect (shown in FIGS. 1 to 24) in a duplex printing process for two-faced paper executed at step S13 of FIG. 11. The other portions are similar to the above aspect shown in FIGS. 1 to 24. Therefore the same components and steps are designated by the same symbols as the above aspect, and redundant explanations are omitted.

Figure 29:
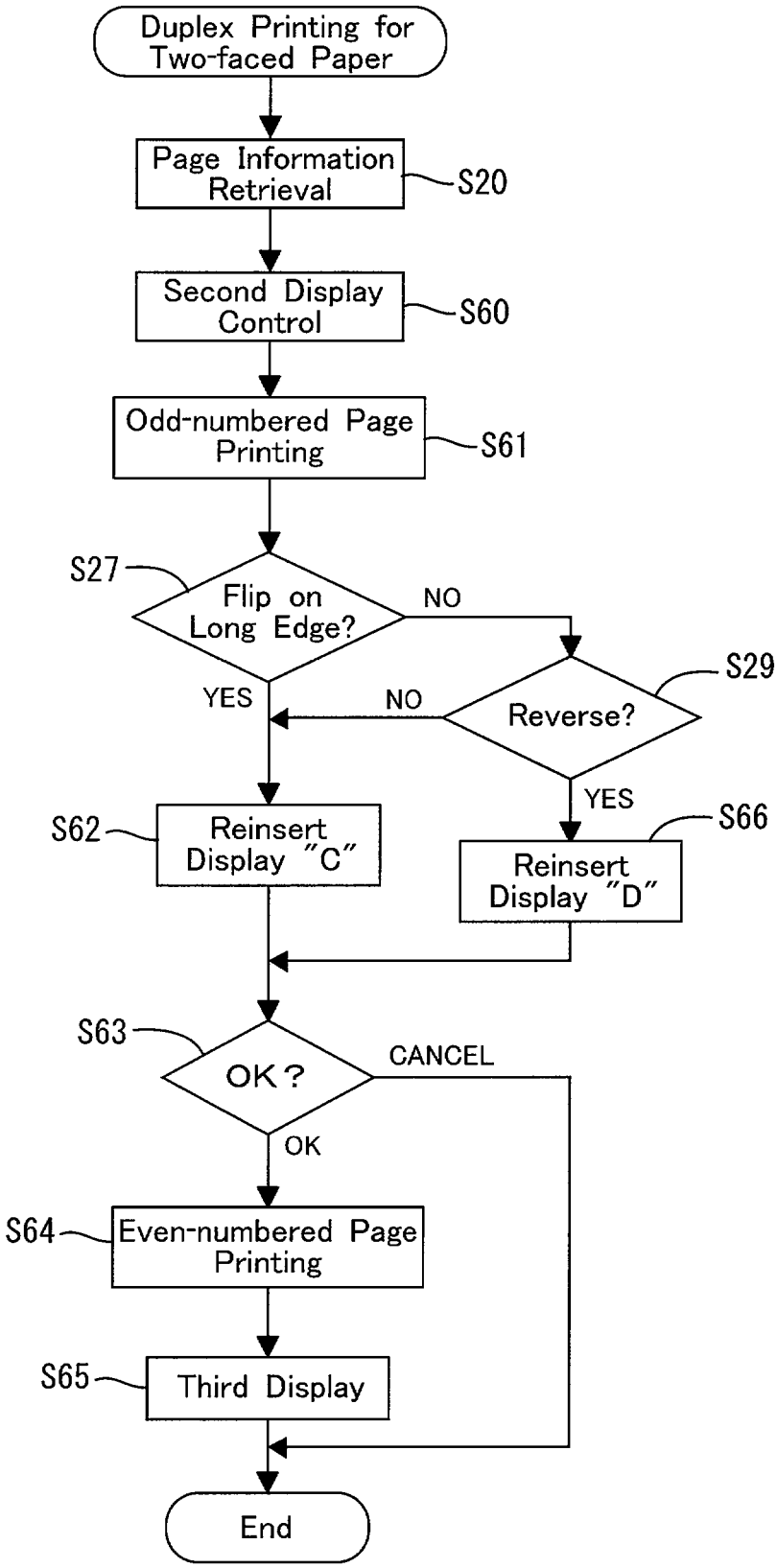
FIG. 29 is a flowchart of a duplex printing process for printing on two-faced paper according to an illustrative aspect other than the aspects shown in FIGS. 1 to 24 or FIGS. 25 to 28.

FIG. 29 shows details of the duplex printing process for two-faced paper, which is executed at step S13 according to the present aspect. First, at step S20, the CPU 87 obtains the page information of a file to be printed from a control process executed based on the printer driver. The page information includes information related to the number n of pages. Using this information, the number of sheets to be actually used for printing is calculated as the integral part of (n+1)/2 at step S20.

In the present aspect, odd-numbered pages are printed during the first half of duplex printing as described above. That is, images should be printed as upright images on the obverse side 76 of paper 3 during the first half of duplex printing.

Figure 30A:
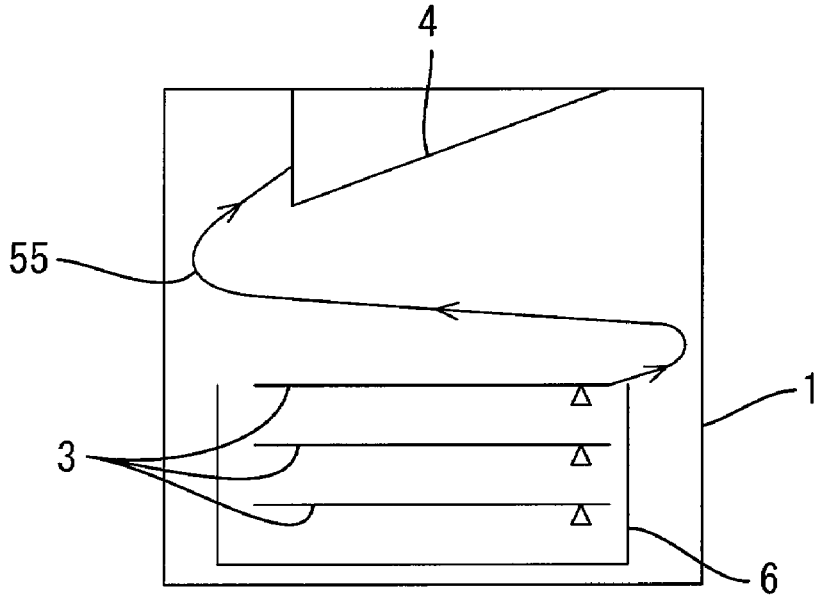
FIG. 30A is a schematic diagram showing how to set paper into the paper cassette for the first half of duplex printing.
Figure 31A:
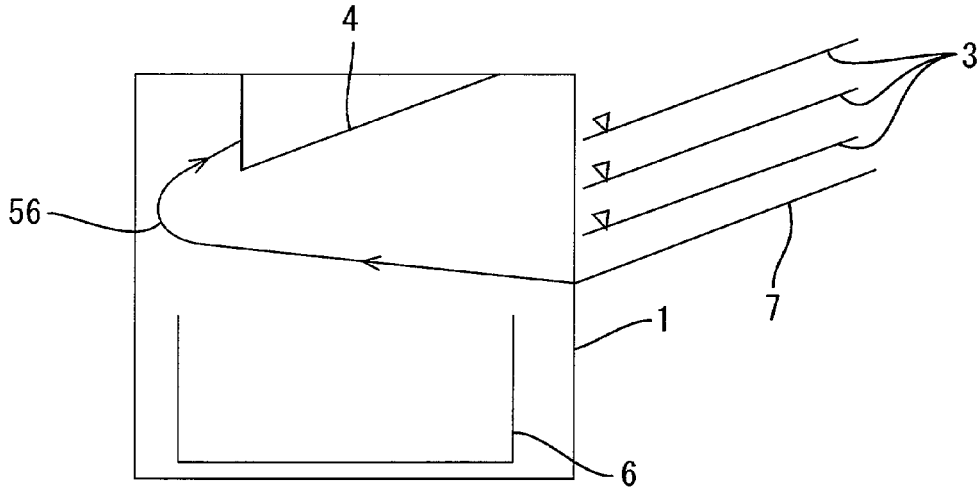
FIG. 31A is a schematic diagram showing how to set paper into the MP tray for the first half of duplex printing.

This can be achieved by setting paper 3 into the paper cassette 6 with the obverse side 76 facing down and with the head of paper 3 at the front (first-out end) of the paper cassette 6 as shown in FIG. 30A, or alternatively by setting paper 3 into the MP tray 7 with the obverse side 76 facing up and with the head of paper 3 at the back (first-in end) of the MP tray 7 as shown in FIG. 31A.

That is, paper 3 should be set in a similar manner to the way that is set for single-side printing (See FIGS. 6A and 7A). Therefore, paper 3 previously set into the paper cassette 6 or the MP tray 7 for single-side printing can be directly diverted to use for the present duplex printing.

In this case, the user may be confused, if the first instruction screen P10 (shown in FIG. 16) or P20 (shown in FIG. 21) is provided on the display device 84 at the beginning of the duplex printing as in the above aspect.

In view of this, according to the present aspect, the CPU 87 executes a second display control process at step S60 of FIG. 29 for preventing a first instruction screen from being displayed on the display device 84. Next, the CPU 87 executes an odd-numbered page printing process at step S61.

During the odd-numbered page printing process, the CPU 87 sorts the odd-numbered pages of an image file to be printed, and arranges the odd-numbered pages in ascending order. The CPU 87 sends the resultant data to the laser printer 1, and thereby causes the laser printer 1 to print the odd-numbered pages in ascending order.

Figure 30B:
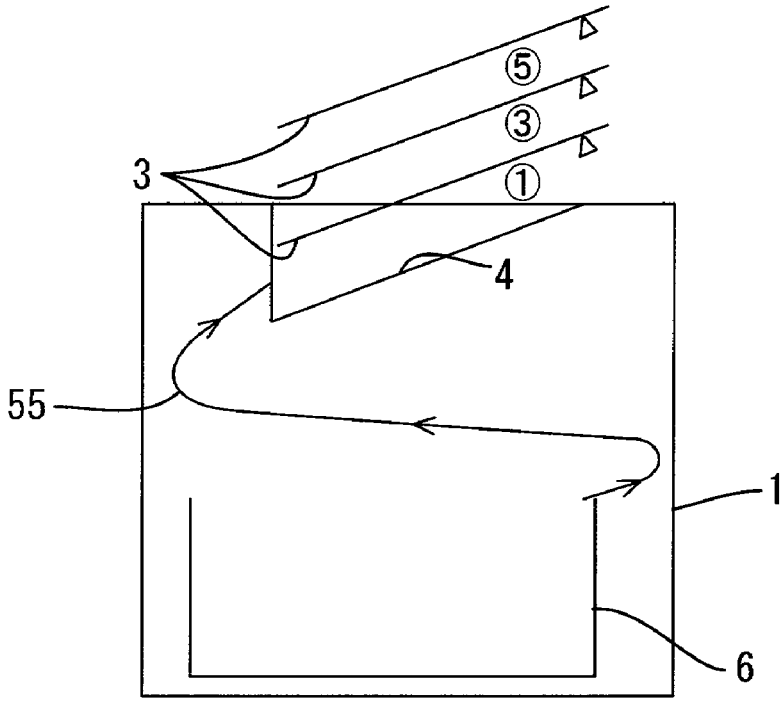
FIG. 30B is a schematic diagram showing how the printed paper is ejected onto the catch tray at the end of the first half of duplex printing.
Figure 31B:
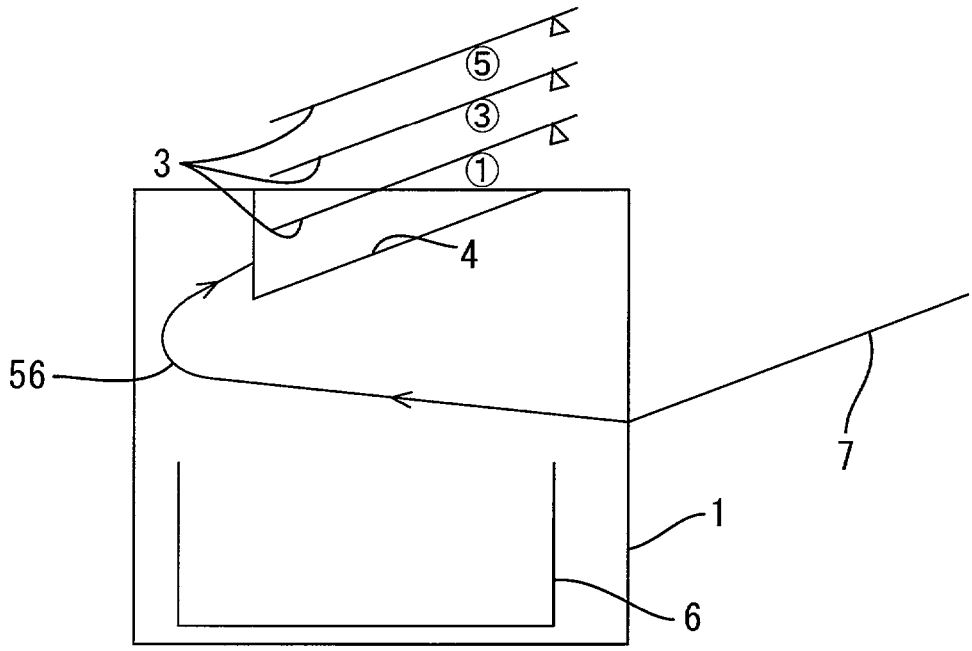
FIG. 31B is a schematic diagram showing how the printed paper is ejected onto the catch tray at the end of the first half of duplex printing.

Thus the odd-numbered pages are printed on the obverse side 76 of the paper 3, and the printed paper 3 is ejected onto the catch tray 4 as shown in FIG. 30B or 31B. Then the first half of duplex printing is finished.

According to the present aspect, when the user requests duplex printing, printing of the odd-numbered pages is thus immediately performed without a first instruction screen being provided for the user.

Next, returning to FIG. 29, it is determined at step S27 whether one of "Flip on Left Edge" and "Flip on Right Edge" has been selected on the advanced setting screen. If No is determined at step S27, it is determined at step S29 whether one of "Flip on Top Edge" and "Flip on Bottom Edge" has been selected on the advanced setting screen.

Figure 33:
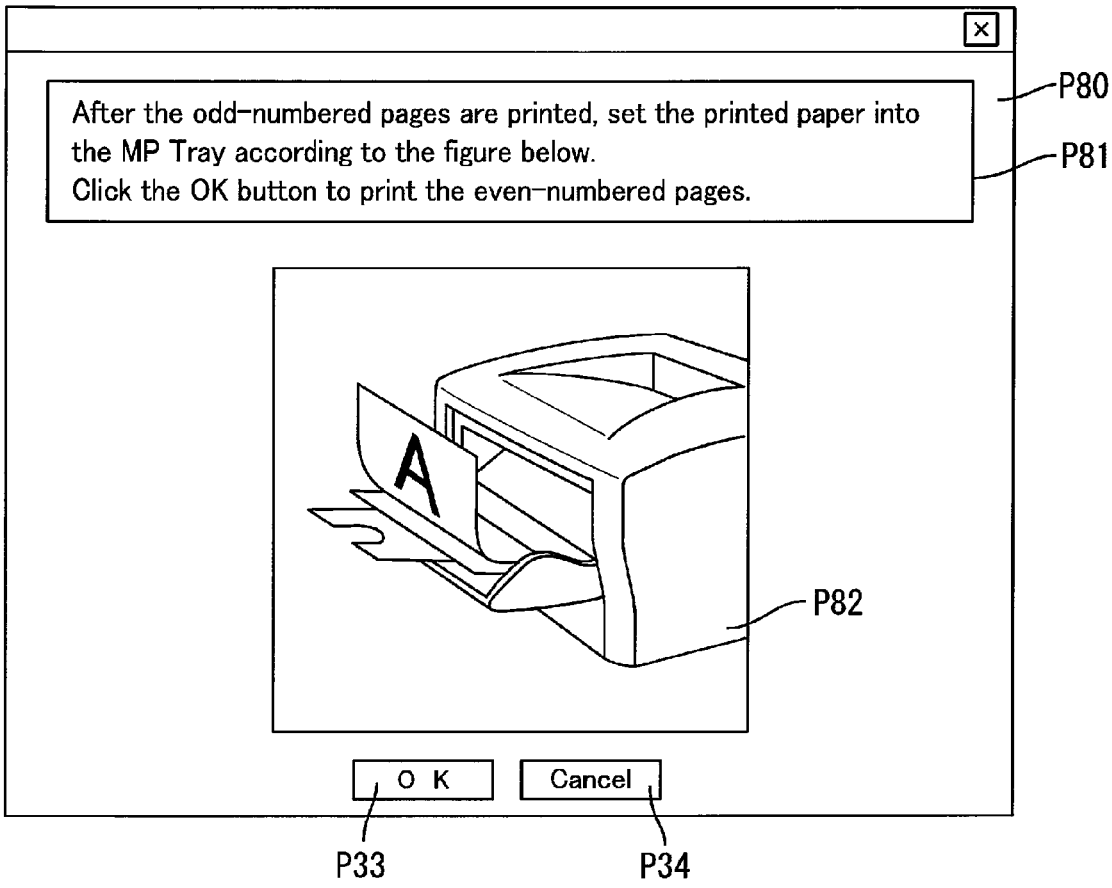
FIG. 33 shows an example of a reinsert instruction screen.

If Yes is determined at step S27 or No is determined at step S29 (i.e., if any of "Flip on Left Edge", "Flip on Right Edge", "Flip on Top Edge (No Reverse)" and "Flip on Bottom Edge (No Reverse)" has been selected as shown in FIG. 12), the CPU 87 executes a reinsert display process "C" (described below) at step S62 for causing the display device 84 to display a reinsert instruction screen P80 as shown in FIG. 33. The reinsert instruction screen P80 shows how to set the printed paper 3 for the second half of duplex printing.

When the first half of duplex printing is finished (i.e., the odd-numbered page printing process at step S61 is finished), the user should refeed the printed paper 3, which has been ejected onto the catch tray 4, to the MP tray 7 for the second half of duplex printing.

Figure 32A:
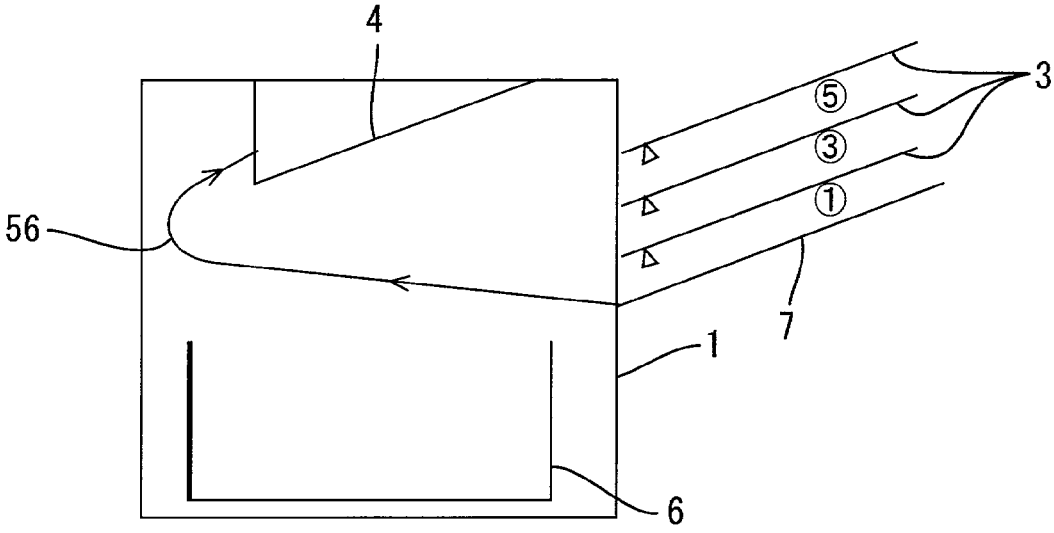
FIG. 32A is a schematic diagram showing how to set paper into the MP tray for the second half of duplex printing.

When any of "Flip on Left Edge", "Flip on Right Edge", "Flip on Top Edge (No Reverse)" and "Flip on Bottom Edge (No Reverse)" has been thus selected, images should be printed as upright images on the reverse side 77 of the printed paper 3 during the second half of duplex printing. This can be achieved by setting the printed paper 3 into the MP tray 7 as shown in FIG. 32A.

That is, the user should set paper 3 into the MP tray 7 with the obverse side 76 facing down and with the head of paper 3 at the back (first-in end) of the MP tray 7 (i.e., with the printed side facing down and with the top of the printed image at the back).

For helping the user, in the present aspect, the CPU 87 executes the reinsert display process "C" at step S62 for causing the display device 84 to display the reinsert instruction screen P80. The reinsert instruction screen P80 provides, for the user, instructions on how to place paper 3 in the MP tray 7.

As shown in FIG. 33, the reinsert instruction screen P80 includes a text box P81 at the top thereof, which provides instructions in words. Specifically, the instructions are provided as follows:

"After the odd-numbered pages are printed, set the printed paper into the MP Tray according to the figure below. Click the OK button to print the even-numbered pages."

The reinsert instruction screen P80 further includes an MP-tray instruction P82 below the text box P81. The MP-tray instruction P82 provides pictorial instructions on how to set paper 3 into the MP tray 7. Specifically, the MP-tray instruction P82 shows that the printed paper 3 should be set into the MP tray 7 with the printed side facing down and with the top of the printed image in first (i.e., with the top of the printed image at the back of the MP tray 7).

Thus the reinsert instruction screen P80 is provided, and thereby the user can readily set paper 3 into the MP tray 7 for the second half of duplex printing.

The reinsert instruction screen P80 includes, at the bottom thereof, "OK" button P33 and "Cancel" button P34 placed next to each other. If the user sets the printed paper 3 according to the reinsert instruction screen P80 and clicks "OK" button P33, returning to FIG. 29, "OK" is determined at step S63. Then the CPU 87 executes an even-numbered page printing process at step S64.

During the even-numbered page printing process, the CPU 87 sorts the even-numbered pages from the image file to be printed, and arranges the even-numbered pages in descending order. The CPU 87 sends the resultant data to the laser printer 1, and thereby causes the laser printer 1 to print the even-numbered pages in descending order.

Figure 32B:
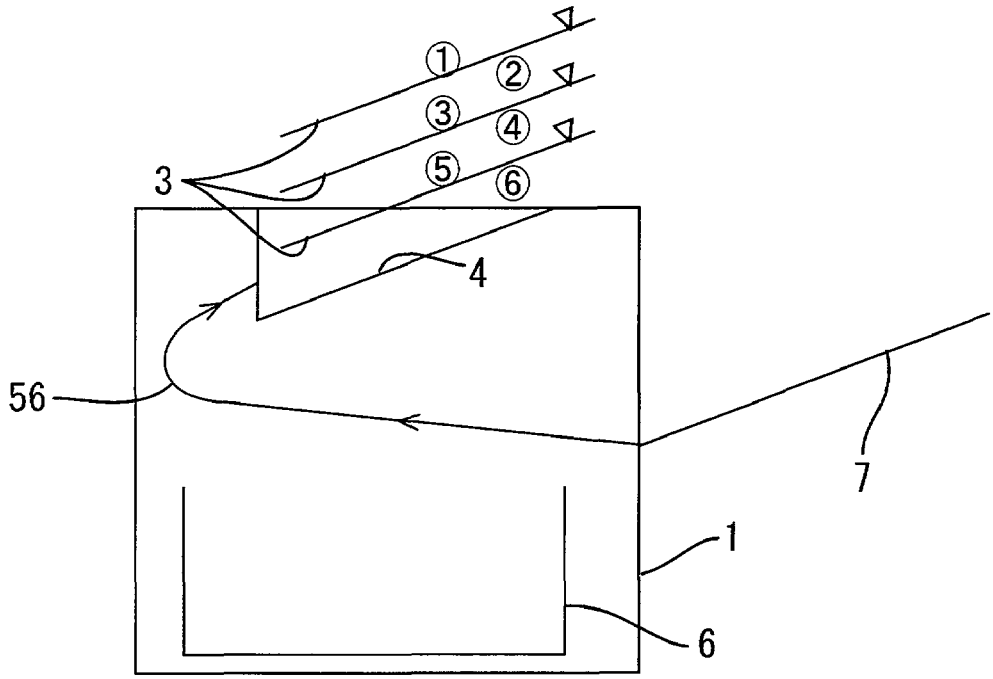
FIG. 32B is a schematic diagram showing how the printed paper is ejected onto the catch tray at the end of the second half of duplex printing.

Thus the even-numbered pages are printed on the reverse side 77 of the paper 3, and the printed paper 3 is ejected onto the catch tray 4 as shown in FIG. 32B. Then duplex printing for two-faced paper is finished, and the printing results include sheets on which the upright images are printed on both of the obverse sides 76 and the reverse sides 77.

Note that the printed sheets are ejected and stacked onto the catch tray 4 with the first page (Page 1) at the top of the stack and facing up as shown in FIG. 32B. In contrast, during single-side printing, the printed sheets are ejected and stacked onto the catch tray 4 with the first page at the bottom of the stack and facing down as shown in FIG. 6B or 7B.

Therefore, in the case that the just-printed (two-side-printed) sheets are bound together with single-side-printed sheets ejected onto the same catch tray 4, the just-printed sheets should be reversed on the catch tray 4 so that the sheets to be bound are in order.

Figure 34:
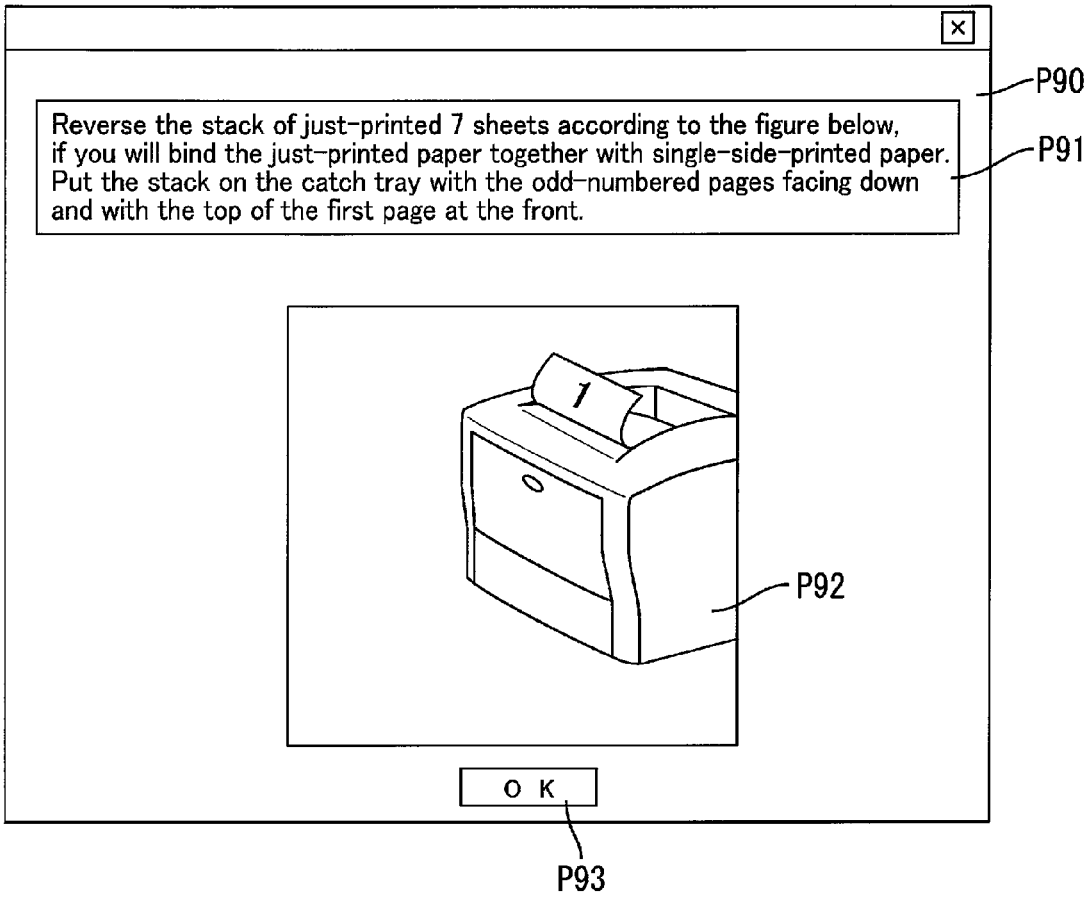
FIG. 34 shows an example of a third instruction screen.

In view of this, according to the present aspect, the CPU 87 executes a third display process at step S65 of FIG. 29 for causing the display device 84 to display a third instruction screen P90 as shown in FIG. 34. The third instruction screen P90 provides, for the user, instruction to reverse the printed paper 3 on the catch tray 4. The third instruction screen P90 is an example of "a reversal instruction screen".

As shown in FIG. 34, the third instruction screen P90 includes a text box P91 at the top thereof, which provides instructions in words. The text box P91 provides instructions on:

(v) The number of printed sheets to be reversed; and (w) How to reverse the printed sheets.

Specifically, the instructions are provided as follows:

"Reverse the stack of just-printed 7 sheets (as (v)) according to the figure below, if you will bind the just-printed paper together with single-side-printed paper. Put the stack on the catch tray with the odd-numbered pages facing down and with the top of the first page at the front (w)."

The third instruction screen P90 further includes a C-tray instruction P92 below the text box P91. The C-tray instruction P92 provides pictorial instructions on how to reverse the printed sheets on the catch tray 4. Specifically, the C-tray instruction P92 shows that the printed sheets should be reversed on the catch tray 4 so that the odd-numbered pages face down.

Thus the third instruction screen P90 is provided, and the user can obtain the textual information from the text box P91 and the image information from the C-tray instruction P92. Thereby, the user can readily reverse the just-printed sheets so that the sheets to be bound are in order. The user does not need to determine the number of just-printed sheets by himself/herself or identify the just-printed sheets on the catch tray 4. Thus the user's burden can be reduced.

The C-tray instruction P92 includes "OK" button P93 at the bottom thereof. If the user clicks "OK" button P93, returning to FIG. 29, the third display process at step S65 is finished. Then the duplex printing process for two-faced paper shown in FIG. 29 terminates.

Figure 36:
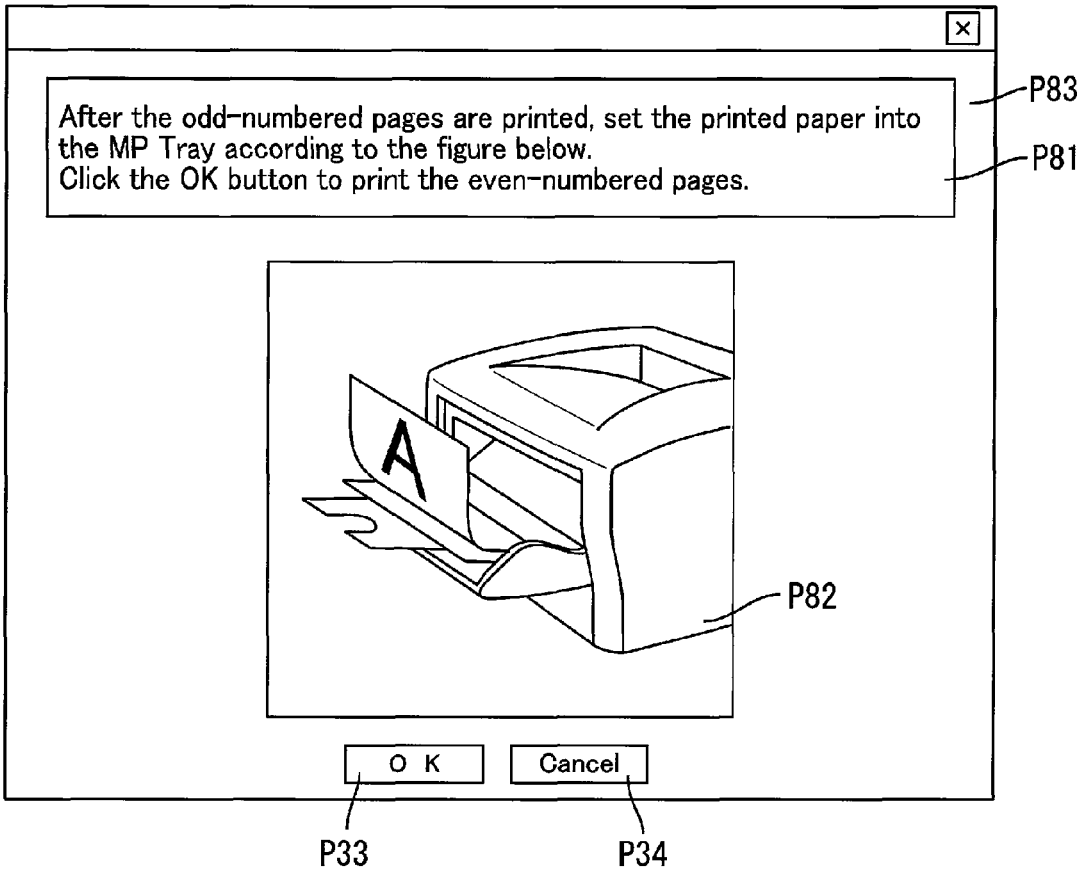
FIG. 36 shows an example of the reinsert instruction screen.

On the other hand, if No is determined at step S27 and Yes is determined at step S29 (i.e., one of "Flip on Top Edge" and "Flip on Bottom Edge" has been selected on the advanced setting screen), the CPU 87 executes a reinsert display process "D" (described below) at step S66 for causing the display device 84 to display a reinsert instruction screen P83 as shown in FIG. 36. The reinsert instruction screen P83 shows how to set the printed paper 3 for the second half of duplex printing.

When the first half of duplex printing is finished (i.e., the odd-numbered page printing process at step S61 is finished), the user should refeed the printed paper 3, which has been ejected onto the catch tray 4, to the MP tray 7 for the second half of duplex printing.

Figure 35A:
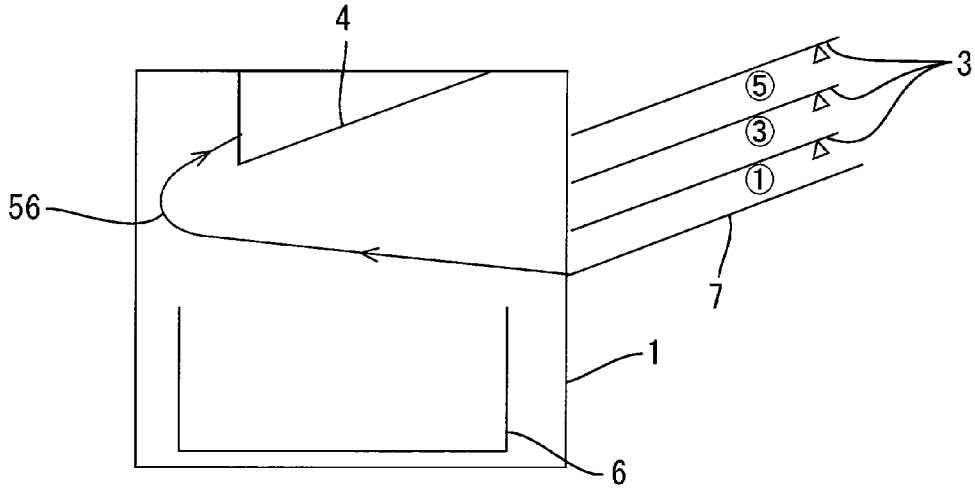
FIG. 35A is a schematic diagram showing how to set paper into the MP tray for the second half of duplex printing.

When one of "Flip on Top Edge" and "Flip on Bottom Edge" has been thus selected on the advanced setting screen, the even-numbered pages of images should be printed as inverted images on the reverse side 77 of the printed paper 3 as shown in FIG. 18 during the second half of duplex printing. This can be achieved by setting paper 3 into the MP tray 7 as shown in FIG. 35A. That is, the user should set the printed paper 3 into the MP tray 7 with the obverse side 76 facing down and with the head of paper 3 at the front (last-in end) of the MP tray 7 (i.e., the printed side facing down and the top of the printed image at the front).

In this case, the user likely determines the proper orientation of the paper 3 based on the logo 75 or the upright images printed on the obverse side 76 of the paper 3, so that inverted images can be printed on the reverse side 77 of the paper 3. This is complicated, and therefore the user may be confused about how to set the printed paper 3 into the MP tray 7.

In view of this, according to the present aspect, the CPU 87 executes the reinsert display process "D" at step S66 for causing the display device 84 to display the reinsert instruction screen P83. The reinsert instruction screen P83 provides, for the user, instructions on how to place the printed paper 3 in the MP tray 7.

The reinsert instruction screen P83 is similar to the above reinsert instruction screen P80 (shown in FIG. 33), and has difference in how to set the printed paper 3 shown therein. Therefore the similar section is designated by the same symbol, and redundant explanations are omitted.

As shown in FIG. 36, the reinsert instruction screen P83 includes a text box P81 and an MP-tray instruction P82. The MP-tray instruction P82 provides pictorial instructions on how to set the printed paper 3 into the MP tray 7. Specifically, the MP-tray instruction P82 shows that the printed paper 3 should be set into the MP tray 7 with the printed side facing down and with the top of the printed image in last (i.e., with the top of the printed image at the front of the MP tray 7).

Thus the reinsert instruction screen P83 is provided, and thereby the user can readily set the printed paper 3 into the MP tray 7 for the second half of duplex printing.

If the user sets the printed paper 3 according to the reinsert instruction screen P83 and clicks "OK" button P33, returning to FIG. 29, "OK" is determined at step S63. Then the CPU 87 executes the even-numbered page printing process at step S64, and thereby the even-numbered pages are printed on the reverse side 77 of the paper 3.

Figure 35B:
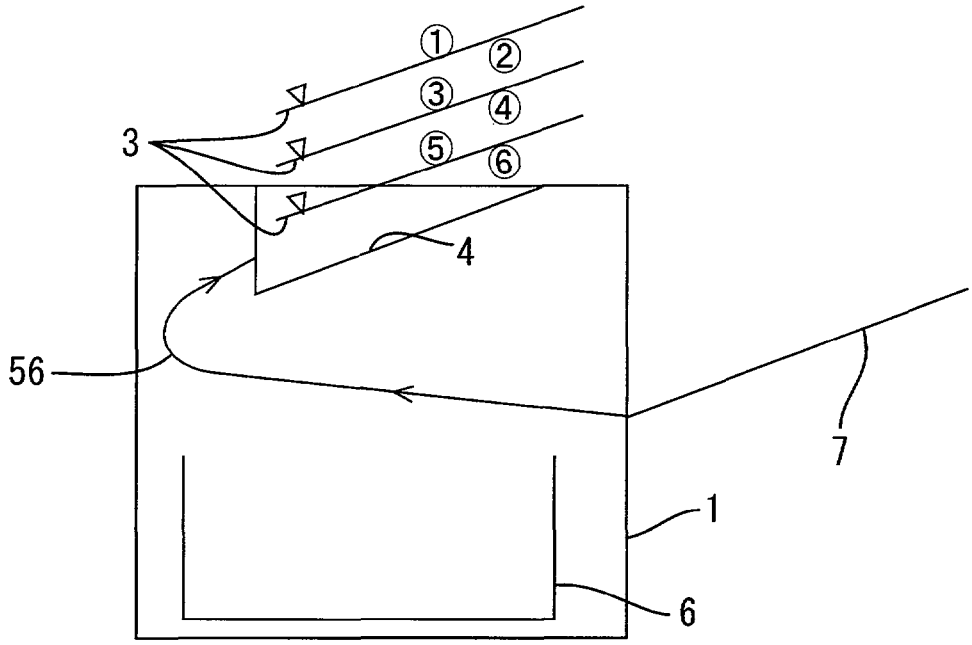
FIG. 35B is a schematic diagram showing how the printed paper is ejected onto the catch tray at the end of the second half of duplex printing.

The printed paper 3 is ejected onto the catch tray 4 as shown in FIG. 35B. Then duplex printing for two-faced paper is finished, and the printing results include sheets on which the upright images are printed on the obverse sides 76 and the inverted images are printed on the reverse sides 77.

At the end of the duplex printing process for two-faced paper, the CPU 87 executes the third display process at step S65 of FIG. 29 for causing the display device 84 to display the third instruction screen P90 as shown in FIG. 34. If the user clicks "OK" button P93, the third display process is finished and then the duplex printing process for two-faced paper terminates.

If the user clicks "Cancel" button P34 on the reinsert instruction screen P80 or P83, the duplex printing is canceled, and thereby the duplex printing process immediately terminates.

In the duplex printing process shown in FIG. 29, steps S20, S60, S27, S29, S62, S63, S65 and S66 are executed based on the display control program of the present aspect. The code of the display control program corresponding to the third display process at step S65 is an example of "third display code", and the CPU 87 executing the third display process is an example of "directing reversal means".

As described above, the present aspect is effective for a construction in which printing of odd-numbered pages is performed during the first half of duplex printing. Further, the present aspect is effective when the user will bind two-side-printed paper together with single-side-printed paper.

<Another Illustrative Aspect>

Another illustrative aspect different from the aspects shown in FIGS. 1 to 24, FIGS. 25 to 28 or FIGS. 29 to 36 will be explained with reference to FIG. 37. The present aspect has difference from the above aspect (shown in FIG. 1 to 24) in a duplex printing process for plain paper (shown in FIG. 23) executed at step S14 of FIG. 11. The other portions are similar to the aspect shown in FIGS. 1 to 24. Therefore the same components or steps are designated by the same symbols, and redundant explanations are omitted.

In the above aspect shown in FIGS. 1 to 24, the feed display process is executed at step S40 of FIG. 23, and thereby the feed instruction screen P50 is provided for the user as a simple instruction for setting paper 3 for the first half of duplex printing. In contrast, according to the present aspect, the CPU 87 executes a first display control process at step S70 of FIG. 37 for preventing a feed instruction screen from being displayed on the display device 84.

In the duplex printing process for plain paper, the user does not need to think about whether paper 3 should face up or down in the paper cassette 6 or MP tray 7, when he/she sets paper 3 for the first half of duplex printing.

That is, paper 3 may be set in a similar manner to the way that is set for single-side printing, and therefore paper 3 previously set into the paper cassette 6 or the MP tray 7 for single-side printing can be directly diverted to use for the present duplex printing.

In this case, the user may be confused or irritated, if the feed instruction screen P50 (shown in FIG. 24) is provided on the display device 84 at the beginning of duplex printing as in the above aspect.

Figure 37:
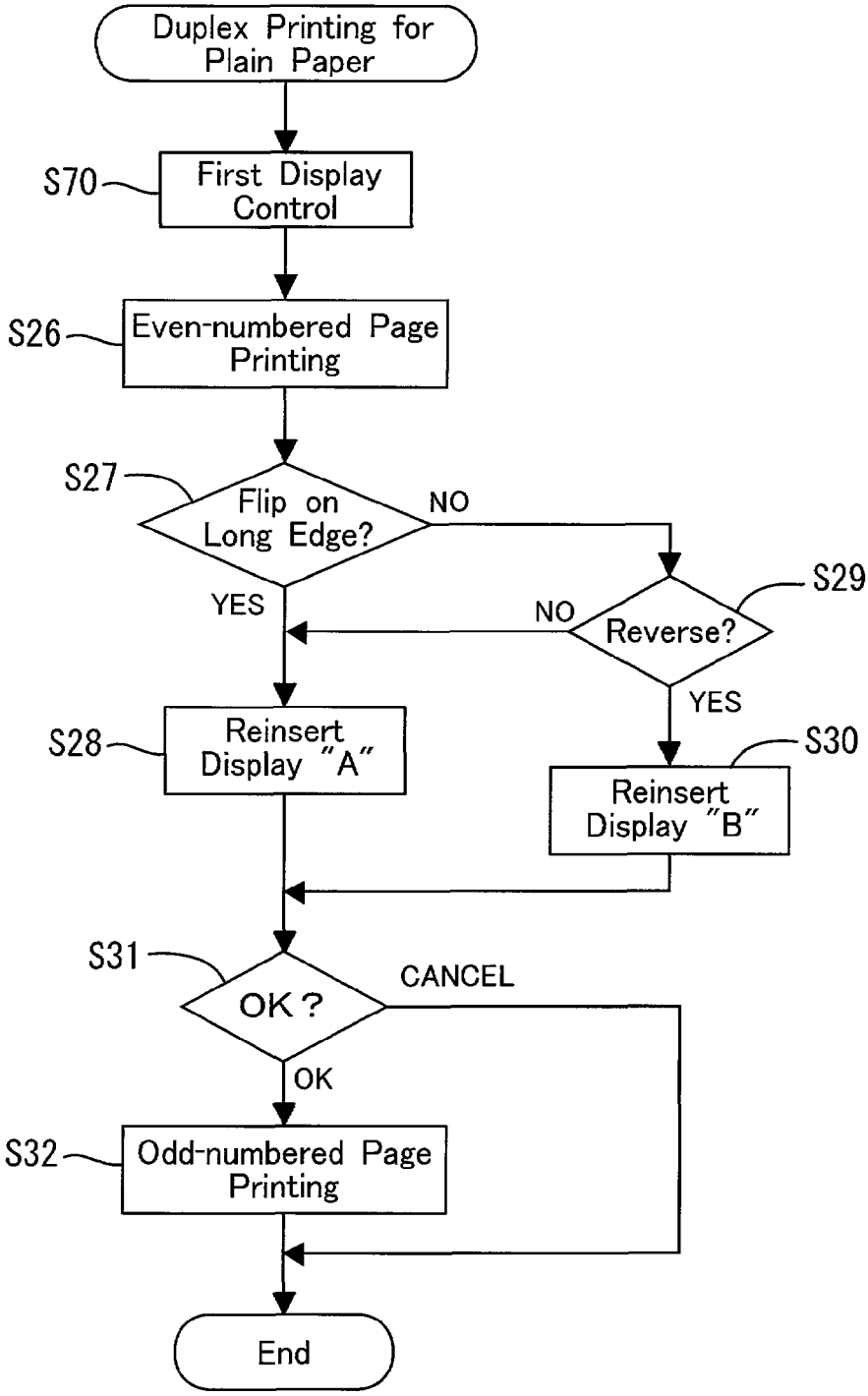
FIG. 37 is a flowchart of a duplex printing process for printing on plain paper according to an illustrative aspect other than the aspects shown in FIGS. 1 to 24, FIGS. 25 to 28 or FIGS. 29 to 36.

In view of this, according to the present aspect, the CPU 87 executes the first display control process at step S70 of FIG. 37 for preventing a feed instruction screen from being displayed on the display device 84.

Next, the CPU 87 executes an even-numbered page printing process at step S26, and thereby the even-numbered pages are printed on one side of plain paper. The printed paper is ejected onto the catch tray 4, and the first half of duplex printing is finished.

According to the present aspect, when the user requests duplex printing using plain paper, printing of even-numbered pages is thus immediately performed without a feed instruction screen being provided for the user. According to this construction, the user can be prevented from being confused or irritated by unnecessary instructions.

When the even-numbered page printing process at step S26 is finished (i.e., the first half of duplex printing is finished), steps S27 to S32 are thereafter executed in a similar manner to the above aspect (shown in FIGS. 1 to 24), and thereby the second half of duplex printing is performed. When the odd-numbered page printing process at step S32 is finished, the duplex printing process for plain paper terminates.

In the duplex printing process shown in FIG. 37, steps S 70 and S27-S31 are executed based on the display control program of the present aspect.

<Another Illustrative Aspect>

Figure 38:
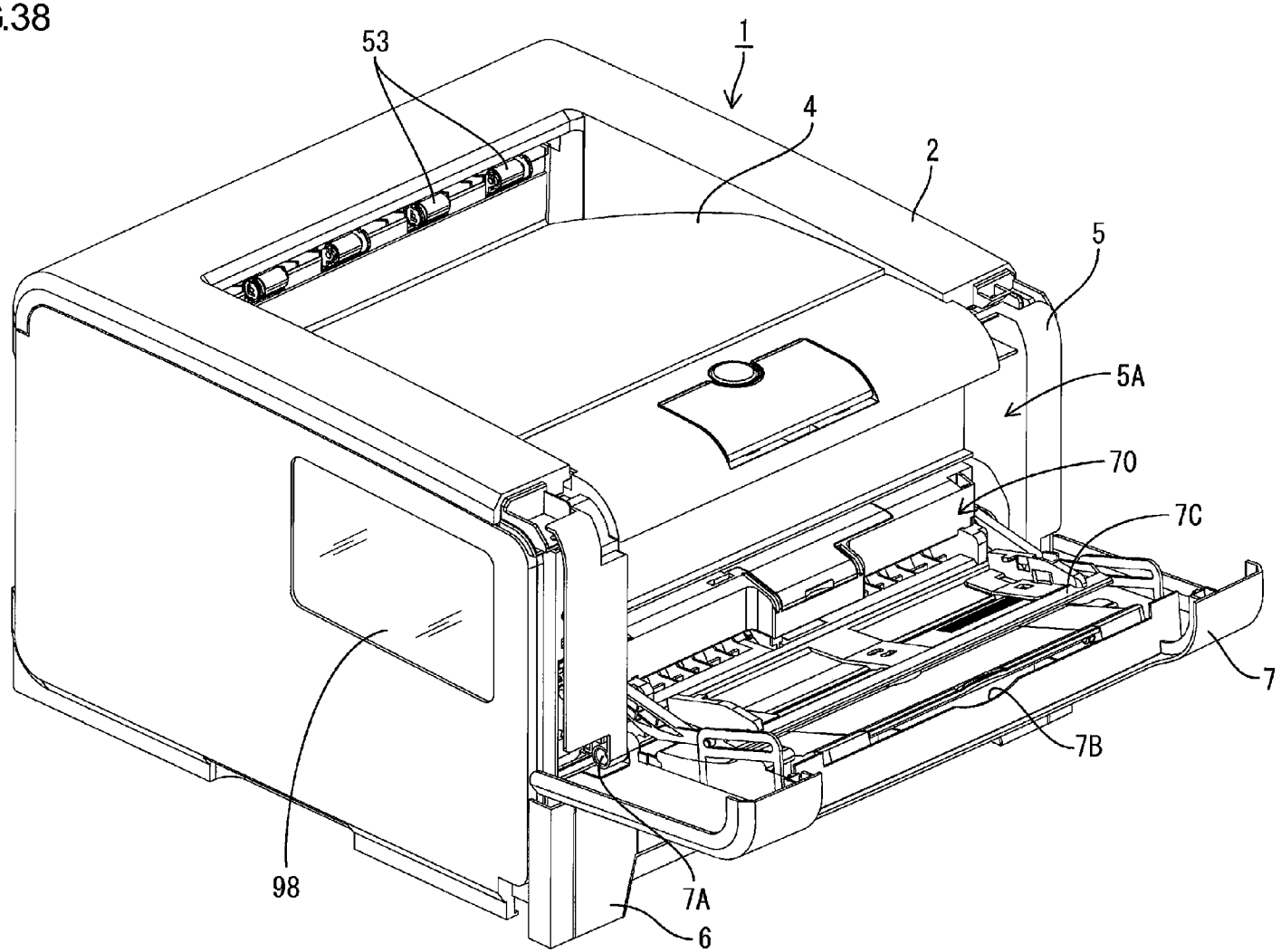
FIG. 38 is an overall perspective view of a laser printer according to an illustrative aspect other than the aspects shown in FIGS. 1 to 24, FIGS. 25 to 28, FIGS. 29 to 36 or FIG. 37.

Another illustrative aspect different from the aspects shown in FIGS. 1 to 24, FIGS. 25 to 28, FIGS. 29 to 36 or FIG. 37 will be explained with reference to FIGS. 38 and 39. FIG. 38 is a perspective view of a laser printer 1 according to the present aspect. The laser printer 1 includes a display unit 98 (i.e., an example of "a display apparatus") on the left-hand sidewall. On-screen user interface and the like can be displayed on the display unit 98.

Figure 39:
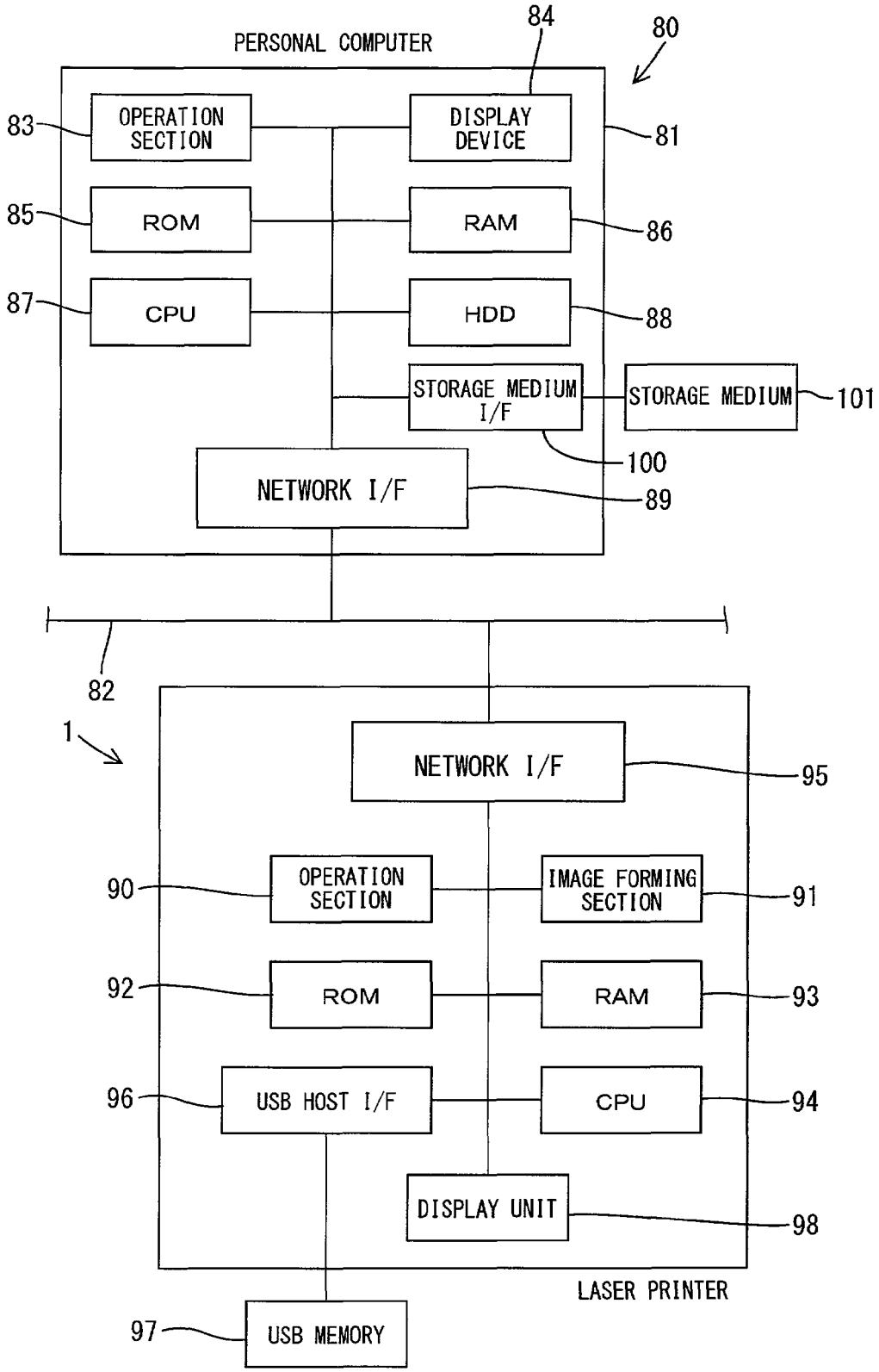
FIG. 39 is a block diagram showing the general configuration of an image forming system.

FIG. 39 is a block diagram showing an image forming system 80 of the present aspect. According to the present aspect, instruction screens such as a first instruction screen P10 or P20 are displayed on the display unit 98 of the laser printer 1. A user can externally input information via the operation section 90 of the laser printer 1 in response to the instruction screens displayed on the display unit 98.

The other constructions are similar to the aspect shown in FIGS. 1 to 24. Therefore the same components are designated by the same symbols, and redundant explanations are omitted.

A personal computer 81 is connected to the laser printer 1 via a LAN cable 82 as shown in FIG. 39. In some cases, the laser printer 1 may be located away from the personal computer 81. In such a case, the user should alternate between the personal computer 81 and the laser printer 1 during duplex printing, if the instruction screens are provided on the display device 84 of the personal computer 81 as in the above aspects. This may trouble the user.

In view of this, according to the present aspect, instruction screens such as a first instruction screen P10 or P20 are provided on the display unit 98 of the laser printer 1. Thereby the user does not have to alternate between the personal computer 81 and the laser printer 1 during duplex printing.

<Other Illustrative Aspects>

The present invention is not limited to the aspects explained in the above description made with reference to the drawings. The following aspects may be included in the technical scope of the present invention, for example.

(1) In the aspect shown in FIGS. 38 and 39, the CPU 87 of the personal computer 81 causes the display unit 98 of the laser printer 1 to display the instruction screens such as a first instruction screen P10 or P20. However the present invention is not limited to this construction. Instead of the CPU 87, the CPU 94 of the laser printer 1 may cause the display unit 98 to display the instruction screens. That is, the display control program may be executed by the CPU 94 of the laser printer 1.

In this case, the display control program can be stored in the ROM 92 of the laser printer 1, for example. The CPU 94 of the laser printer 1 is an example of "a processor", and the CPU 94 executing the display control program is an example of "a display controller". The CPU 94 executing a first display process is an example of "a first means". Further, the printer driver can be stored in the ROM 92 of the laser printer 1 and executed by the CPU 94. The CPU 94 executing the printer driver is an example of "a printer controller" in this case.

(2) In the above aspects, two-faced paper 3 has a company logo 75 at its top. However, the logo 75 may be printed anywhere on the obverse side 76 of paper 3. Paper 3 with a logo 75 is an illustrative example of headed paper (i.e., paper in which the head of the obverse side can be identified). The above aspects are especially effective for duplex printing using headed paper. In the case that paper with a logo at its bottom is used, for example, the user can perceive the line P16, which is displayed for representing a logo 75 in the instruction screens, simply as a symbol for the head of paper 3.

(3) Further, two-faced paper 3 does not need to include a logo or the like. That is, duplex printing can be performed using two-faced paper 3 in which two sides are distinguishable by surface quality or the like but its head cannot be identified. In this case, the user can perceive the line P16, which is displayed for representing a logo 75 in the instruction screens, simply as a symbol for the obverse side 76 of paper.

(4) In the above aspects, a user can select the two-faced mode on the advanced setting screen P60 to request printing by use of two-faced paper, and instructions on paper orientation and the like are displayed when the user has selected the two-faced mode. However, the present invention is not limited to this construction. A headed mode as a special mode of the two-faced mode may be additionally provided for printing on headed paper.

In this case, the line P16 representing the head of paper is shown in the first or second instruction screen P10, P20 or P72 only if the user has selected the headed mode, while simpler indication merely representing the obverse side of paper is shown in the first or second instruction screen P10, P20 or P72 if the user has selected the normal two-faced mode. In the normal two-faced mode, the indication representing the reverse side (i.e., an example of "a distinctive side") of paper instead of the obverse side may be provided in the first instruction screen P10 or P20.

(5) Conversely, only a single mode may be provided for duplex printing. In this case, two-faced mode or headed mode is not provided, that is, the "Two-faced Mode" checkbox P62 is not provided on the advanced setting screen P60 shown in FIG. 12 or 13. In the printing process shown in FIG. 11, steps S12 and S14 can be eliminated, and thereby the duplex printing process for two-faced paper shown in FIG. 14 is always executed at step S13 when the user has selected the duplex mode on the advanced setting screen P60. That is, the first instruction screen P10 or P20 is always displayed on the display device 84 at the beginning of duplex printing.

(6) In the aspect shown in FIG. 25 to 28, the second instruction screen P72 for directing for replacement of the remaining paper is displayed after the odd-numbered page printing process at step S32 is finished. However, the second instruction screen P72 may be displayed in the middle of the odd-numbered page printing process. That is, the second instruction screen P72 can be displayed at any time between step S31 and the end of the duplex printing. Alternatively, the second instruction screen P72 may be displayed at the beginning of next printing, if necessary based on the previous printing mode.

(7) In the aspect shown in FIG. 29 to 36, the third instruction screen P90 for directing for reversal of the printed sheets on the catch tray is displayed after the even-numbered page printing process at step S64 is finished. However, the third instruction screen P90 may be displayed in the middle of the even-numbered page printing process. That is, the third instruction screen P90 can be displayed at any time after "OK" is determined at step S63. What is required is that the third instruction screen P90 is provided for the user by the time the actual printing performed by the laser printer 1 is finished.

(8) In the above aspects, an image is printed on paper 3 in the middle of the paper path 55 or 56 of the laser printer 1, so that the top of the image is on the first-in side (downstream side) of the paper 3. However, the present invention is not limited to this construction. An image may be printed on paper 3 so that the top of the image is on the last-in side (upstream side) of the paper 3. In this case, the line P16, which is displayed for representing a logo 75 in the instruction screens, should be drawn on the side opposite to that of the above aspects.

(9) Further, two print-direction modes (e.g., portrait mode and landscape mode) may be provided. That is, in addition to the portrait mode provided in the above aspects, the landscape mode may be provided. In this case, a user can select the Print-Direction Mode on the basic setting screen, for example, and the instruction screens according to the selected Duplex Type and the selected Print-Direction Mode are displayed for the user.

(10) In the above aspects, the odd-numbered pages are printed in ascending order during the first half or second half of duplex printing, and the even-numbered pages are printed in descending order during the first half or second half of duplex printing. However, the present invention is not limited to these constructions.

During the first half of duplex printing, the odd-numbered pages or even-numbered pages may be printed in ascending order, or alternatively in descending order. Further, during the second half of duplex printing, the even-numbered pages or odd-numbered pages may be printed in ascending order, or alternatively in descending order. What is required is that printing results according to the user's requirements can be obtained at the end of duplex printing.

However, it is preferable that pages printed on sheets ejected onto the catch tray 4 at the end of duplex printing are in ascending order or descending order of page number (i.e., in the order such as Page 1, Page 2, Page 3, Page 4 and so on, from the top or bottom of the stack of sheets).

(11) In the above aspects, the paper 3 is fed from the MP tray 7 during the second half of duplex printing. However, the present invention is not limited to this construction. The paper 3 may be fed from the paper cassette 6 during the second half of duplex printing. In this case, a user should set the printed paper 3 into the paper cassette 6 for the second half of duplex printing.

Alternatively, the paper cassette 6 and the MP tray 7 may be provided as paper-rest options, from which the user can select the paper rest (the paper cassette 6 or MP tray 7), used for the second half of duplex printing, on the advanced setting screen, for example. In this case, the reinsert instruction according to the user's selection is displayed for the user at the beginning of the second half of duplex printing.

(12) Further, for the first half of duplex printing, the paper cassette 6 and the MP tray 7 may be provided as paper-rest options. In this case, a user can select the paper cassette 6 or the MP tray 7 for the first half of duplex printing, and the first instruction screen according to the user's selection is displayed for the user at the beginning of duplex printing.

(13) In the above aspects, the catch tray 4 is provided on the upper portion of the laser printer 1. However, another catch tray as a side catch tray may be additionally provided on the back side of the laser printer 1. In this case, an opening approaching the sheet discharge path 53 is formed through the back wall of the laser printer 1, and the side catch tray is attached to the back wall so as to continue into the opening.

The printed paper 3 may be ejected onto the side catch tray at the end of the first half of duplex printing, while the printed paper 3 may be ejected onto the catch tray 4 at the end of the second half of duplex printing. Conversely, the printed paper 3 may be ejected onto the catch tray 4 at the end of the first half of duplex printing, while the printed paper 3 may be ejected onto the side catch tray at the end of the second half of duplex printing. Alternatively, the printed paper 3 may be ejected onto the side catch tray at the ends of the first half and second half of duplex printing.

(14) In the above aspects, the personal computer 81 and the laser printer 1 are connected to each other via the LAN cable 82. However, the present invention is not limited to this construction. What is required is that communication between the personal computer 81 and the laser printer 1 is enabled. For example, the two may be connected to each other via a USB cable.

(15) In the above aspects, the USB memory 97 is included as an illustrative example of a storage medium externally connectable to the laser printer 1. However, the storage medium is not limited to the USB memory 97. A memory card such as CompactFlash(™), SmartMedia(™) or Memory Stick(™) may be used instead.

What is claimed is:

1. An image forming system comprising:

an image forming apparatus having a paper rest;

a display apparatus;

a memory for storing a printer driver and a display control program; and a processor capable of accessing said memory and executing said printer driver and said display control program, said display control program being executed interfacing with said printer driver being executed, said processor further being capable of communicating to said image forming apparatus and said display apparatus, wherein:

said processor is capable of controlling said image forming apparatus by execution of said printer driver so that manual duplex printing is performed by printing an image on one side of a sheet during a first half of manual duplex printing and thereafter printing an image on the other side of the manually-fed printed sheet during a second half of manual duplex printing; and said processor causes said display apparatus through said display control program to display a first instruction screen at a beginning of manual duplex printing for showing how to set said sheet onto said paper rest for the first half of manual duplex printing, said first instruction screen including instruction on whether a distinctive side of said sheet should face up or down on said paper rest.

2. An image forming system as in claim 1, wherein said display apparatus is integrated with said image forming apparatus.

3. An image forming system as in claim 1, wherein:

said image forming apparatus has a plurality of paper rests as said paper rest; and said first instruction screen displays how to set said sheet onto at least one of said paper rests from which said sheet is capable of being fed for the first half of manual duplex printing.

4. A display controller configured to control a display apparatus in an image forming system that includes a printer controller for controlling an image forming apparatus having a paper rest, said printer controller being capable of causing said image forming apparatus to perform manual duplex printing by printing an image on one side of a sheet during a first half of manual duplex printing and thereafter printing an image on the other side of the manually-fed printed sheet during a second half of manual duplex printing, said display controller interfacing with said printer controller and comprising:

a first means for causing said display apparatus to display a first instruction screen at a beginning of manual duplex printing for displaying how to set said sheet onto said paper rest for the first half of manual duplex printing, said first instruction screen including instruction on whether a distinctive side of said sheet should face up or down on said paper rest.

5. A display controller as in claim 4, wherein:

said printer controller is capable of providing two-faced mode of manual duplex printing for enabling printing by use of a two-faced sheet as said sheet; and said display controller causes said display apparatus to display said first instruction screen only when manual duplex printing is performed in the two-faced mode.

6. A display controller as in claim 4, wherein said first instruction screen includes instruction on orientation of said sheet on said paper rest.

7. A display controller as in claim 4, wherein said printer controller causes said image forming apparatus to print at least one even-numbered page during the first half of manual duplex printing.

8. A display controller as in claim 7, further comprising:

a second means for causing said display apparatus to display a second instruction screen at the end of manual duplex printing for directing for replacement of the remaining paper on said paper rest.

9. A display controller as in claim 4, wherein said first instruction screen includes instruction on the number of sheets to be used as said sheet for the manual duplex printing.

10. A display controller as in claim 4, wherein:

said image forming apparatus has a sheet stacker on which printed paper is stacked; and said printer controller causes said image forming apparatus to print an odd-numbered page during the first half of manual duplex printing, said display controller further comprising:

a directing reversal means for causing said display apparatus to display a reversal instruction screen at the end of manual duplex printing for directing reversal of said sheet on said sheet stacker.

11. A display controller as in claim 10, wherein said reversal instruction screen includes instruction on the number of sheets to be reversed as said sheet.

12. A display control method for use in an image forming system that includes an image forming apparatus, a display apparatus and a printer controller, said image forming apparatus having a paper rest, said printer controller being capable of controlling said image forming apparatus so that manual duplex printing is performed by printing an image on one side of a sheet during a first half of manual duplex printing and thereafter printing an image on the other side of the manually-fed printed sheet during a second half of manual duplex printing, said display control method comprising:

displaying a first instruction screen on said display apparatus at a beginning of manual duplex printing for displaying how to set said sheet onto said paper rest for the first half of manual duplex printing, said first instruction screen including instruction on whether a distinctive side of said sheet should face up or down on said paper rest.

13. A display control method as in claim 12, wherein:

said printer controller is capable of providing two-faced mode of manual duplex printing for enabling printing by use of a two-faced sheet as said sheet; and said first instruction screen is displayed on said display apparatus only when manual duplex printing is performed in the two-faced mode.

14. A display control method as in claim 12, wherein said first instruction screen includes instruction on orientation of said sheet on said paper rest.

15. A display control method as in claim 12, wherein said printer controller causes said image forming apparatus to print at least one even-numbered page during the first half of manual duplex printing.

16. A display control method as in claim 15, further comprising:

displaying a second instruction screen on said display apparatus at the end of manual duplex printing for directing replacement of the remaining paper on said paper rest.

17. A display control method as in claim 12, wherein said first instruction screen includes instruction on the number of sheets to be used as said sheet for the manual duplex printing.

18. A display control method as in claim 12, wherein:

said image forming apparatus has a sheet stacker on which printed paper is stacked; and said printer controller causes said image forming apparatus to print an odd-numbered page during the first half of manual duplex printing, said display control method further comprising:

displaying a reversal instruction screen on said display apparatus at the end of manual duplex printing for directing reversal of said sheet on said sheet stacker.

19. A display control method as in claim 18, wherein said reversal instruction screen includes instruction on the number of sheets to be reversed as said sheet.

20. A computer readable medium having a computer program product including a display control program and operable to implement a display control method in an image forming system that includes an image forming apparatus, a display apparatus and a processor, said image forming apparatus having a paper rest, said processor being capable of controlling said image forming apparatus so that manual duplex printing is performed by printing an image on one side of a sheet during a first half of manual duplex printing and thereafter printing an image on the other side of the manually-fed printed sheet during a second half of manual duplex printing, said processor further being capable of executing said display control program for controlling said display apparatus, said display control program comprising:

first display code for causing said display apparatus to display a first instruction screen at a beginning of manual duplex printing for displaying how to set said sheet onto said paper rest for the first half of manual duplex printing, said first instruction screen including instruction on whether a distinctive side of said sheet should face up or down on said paper rest.

* * * * *